US011424565B2

(12) United States Patent
Someya et al.

(10) Patent No.: US 11,424,565 B2
(45) Date of Patent: Aug. 23, 2022

(54) CONNECTOR ASSEMBLY AND CONNECTOR PAIR

(71) Applicant: Molex, LLC, Lisle, IL (US)

(72) Inventors: Toshiyuki Someya, Yamato (JP); Daiki Tanaka, Yamato (JP); Satoru Teruki, Yamato (JP); Yuki Seki, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 17/087,645

(22) Filed: Nov. 3, 2020

(65) Prior Publication Data

US 2021/0135385 A1 May 6, 2021

Related U.S. Application Data

(60) Provisional application No. 62/930,585, filed on Nov. 5, 2019.

(30) Foreign Application Priority Data

May 7, 2020 (JP) ..... JP2020-082058

(51) Int. Cl.
*H01R 12/71* (2011.01)
*H01R 13/52* (2006.01)
(Continued)

(52) U.S. Cl.
CPC ..... *H01R 12/716* (2013.01); *H01R 13/504* (2013.01); *H01R 13/5202* (2013.01); *H01R 13/6581* (2013.01)

(58) Field of Classification Search
CPC ..... H01R 12/716; H01R 12/57; H01R 12/79; H01R 13/504; H01R 13/405; H01R 12/78;
(Continued)

(56) References Cited

U.S. PATENT DOCUMENTS 9,065,228 B2 * 6/2015 Nishimura ..... H01R 13/6594
2014/0213079 A1 * 7/2014 Nishimura ..... H01R 13/405 439/78
(Continued)

FOREIGN PATENT DOCUMENTS

CN 202633548 U 12/2012
CN 104425981 A 3/2015
(Continued)

*Primary Examiner* — Abdullah A Riyami
*Assistant Examiner* — Nelson R. Burgos-Guntin

(57) ABSTRACT

A connector assembly can be attached to a surface of a substrate and has high airtightness to improve reliability. The connector assembly includes: a connector including a connector body and a terminal attached to the body; and a protective member including a wall extending in a longitudinal direction or a width direction of the body and an accommodation unit in which at least a part of four sides of a periphery is defined by the wall, the protective member being attached to the surface of the substrate with the connector accommodated in the accommodation unit. The protective member includes a protective member body made of an insulating material and a protective metal fitting made of a conductive metal integrally formed with the protective member body, and the protective member is placed on the surface of the substrate while coupled to the connector with the connector accommodated in the accommodation unit.

27 Claims, 44 Drawing Sheets

(51) Int. Cl.
*H01R 13/504* (2006.01)
*H01R 13/6581* (2011.01)

(58) Field of Classification Search
CPC .. H01R 12/73; H01R 43/005; H01R 13/5219; H01R 13/5216; H01R 13/502; H01R 13/40; H01R 13/46
See application file for complete search history.

(56) References Cited

U.S. PATENT DOCUMENTS

| | | | | |
|---|---|---|---|---|
| 2014/0370749 | A1* | 12/2014 | Kato | H01R 13/6597 439/607.31 |
| 2015/0140840 | A1* | 5/2015 | Nishimura | H01R 13/6594 439/74 |
| 2015/0140841 | A1* | 5/2015 | Watanabe | H01R 43/18 439/74 |
| 2017/0033505 | A1* | 2/2017 | Ozeki | H01R 12/716 |
| 2017/0098900 | A1* | 4/2017 | Kobuchi | H01R 12/716 |
| 2018/0358729 | A1* | 12/2018 | Chen | H01R 13/20 |
| 2019/0082534 | A1* | 3/2019 | Hoang | H05K 1/144 |
| 2019/0082538 | A1* | 3/2019 | Hoang | H05K 1/0243 |
| 2020/0044374 | A1* | 2/2020 | Ishida | H01R 12/721 |
| 2020/0335893 | A1* | 10/2020 | Chen | H01R 13/6273 |
| 2021/0135385 | A1* | 5/2021 | Someya | H01R 13/5202 |
| 2021/0143567 | A1* | 5/2021 | Someya | H01R 13/5219 |

FOREIGN PATENT DOCUMENTS

| | | | |
|---|---|---|---|
| CN | 104682047 | A | 6/2015 |
| CN | 105375140 | A | 3/2016 |
| CN | 107181076 | A | 9/2017 |
| CN | 207459247 | U | 6/2018 |
| JP | 5444515 | B1 | 3/2014 |
| JP | 2015050132 | A | 3/2015 |
| JP | 2015106529 | A | 6/2015 |
| JP | 2015115200 | A | 6/2015 |
| JP | 2016189244 | A | 11/2016 |
| JP | 2017-152201 | A | 8/2017 |
| KR | 101707143 | B1 | 2/2017 |
| TW | 201707291 | A | 2/2017 |
| WO | 2018/163546 | A1 | 9/2018 |

* cited by examiner

Prior art

CONNECTOR ASSEMBLY AND CONNECTOR PAIR

RELATED APPLICATIONS

This application claims the benefit of Japanese Application No. 2020-082058, filed on May 7, 2020, which claims priority from U.S. Provisional Application No. 62/930,585, filed on Nov. 5, 2019 each of which are incorporated herein by reference in their entirety.

TECHNICAL FIELD

The present invention relates to a connector assembly and a connector pair.

BACKGROUND ART

Connectors such as a substrate-to-substrate connector have been used to electrically connect a pair of parallel circuit boards to each other. Such connectors are attached to each of opposing surfaces of the pair of circuit boards, and fitted together to secure electric conduction. A technique of providing a protective member to surround a periphery of the connector has been proposed in order to prevent dust from invading the connector for example, see Patent Document 1.

FIG. 44 is a perspective view illustrating a known connector assembly.

In FIG. 44, a receptacle connector 801 is one of a pair of substrate-to-substrate connectors, and is mounted on a surface of a first substrate (not illustrated). The receptacle connector 801 includes a housing 811 made of resin or the like and a plurality of metallic terminals 861 mounted to the housing 811.

A protective member 891 is a frame member, which has a frame shape in planar view and is made of resin or the like. The protective member 891 includes an opening portion 895 in which the receptacle connector 801 is accommodated. A tip of a protrusion 892 protruding toward an inside of the opening portion 895 abuts on an outside wall surface of the housing 811. A lower attachment surface 893 of the protective member 891 abuts on a surface of the first substrate.

In this state, a plug connector (not illustrated) as the other of the pair of substrate-to-substrate connectors is fitted in the receptacle connector 801 while mounted on a surface of a second substrate (not illustrated). In this case, the plug connector is inserted into the opening portion 895 from above in the drawing, and fitted in the receptacle connector 801 of the opening portion 895, and the surface of the second substrate abuts on an upper attachment surface 894 of the protective member 891. Consequently, a periphery of the receptacle connector 801 fitted in the plug connector is surrounded by the protective member 891, and the lower attachment surface 893 and the upper attachment surface 894 of the protective member 891 contact with the surfaces of the first substrate and the second substrate opposed to each other, so that dust is prevented from invading the inside of the substrate-to-substrate connector from surroundings.

Prior Art Documents: Patent Documents: Patent Document 1: WO 2018/163546

SUMMARY

However, in the known connector assembly, the lower attachment surface 893 and the upper attachment surface 894 of the protective member 891 are only pressed against and closely contact with the surfaces of the substrates, so that airtightness between the lower attachment surface 893 and the upper attachment surface 894 and the surfaces of the substrates is not necessarily sufficient, and sometimes the dust invades the substrate-to-substrate connector through between the lower attachment surface 893 and the upper attachment surface 894 and the surfaces of the substrates.

An object of the present invention is to solve the problem of the known connector assembly, and to provide a high-reliability connector assembly and connector pair, which have a simple configuration, can be easily and certainly attached to the surface of the substrate, and maintain high air-tightness to improve reliability.

According to one aspect of the present invention, a connector assembly includes: a connector including a connector body and a terminal attached to the connector body; and a protective member including a wall extending in a longitudinal direction or a width direction of the connector body and an accommodation unit in which at least a part of four sides of a periphery is defined by the wall, the protective member being attached to the surface of the substrate with the connector accommodated in the accommodation unit. The protective member includes a protective member body made of an insulating material and a protective metal fitting made of a conductive metal integrally formed with the protective member body, and the protective member is placed on the surface of the substrate while coupled to the connector with the connector accommodated in the accommodation unit.

In the connector assembly, preferably the protective metal fitting includes a portion exposed from the protective member body in an inside surface of the protective member and a portion exposed from the protective member body in an opposing substrate side surface of the protective member.

In another connector assembly, preferably the portion exposed from the protective member body in the inside surface includes a portion that holds a connector body of the connector accommodated in the accommodation unit while engaging with the connector body.

In the connector assembly, preferably the protective metal fitting includes a portion exposed from the protective member body in inside surfaces of a first wall of the protective member extending in the longitudinal direction of the connector body and a second wall of the protective member extending in the width direction of the connector body and a portion exposed from the protective member body in a side surface of a mounting substrate of the protective member.

In the connector assembly, preferably the protective member is constructed with a pair of half bodies, the half bodies are constructed with the first wall extending in the longitudinal direction of the connector body and the second wall extending in the width direction of the connector body, one end of the second wall being connected to one end of the first wall, and an open unit exists between the other end of the first wall and the other end of the second wall of one of the half bodies and between the other end of the second wall and the other end of the first wall of the other half body.

In the connector assembly, preferably the protective member includes one second wall extending in the width direction of the connector body and a pair of first walls extending in the longitudinal direction of the connector body, one ends of the first walls being connected to both ends of the second wall, and an open unit exists between the other end of one of the first walls and the other end of the other first wall.

In the connector assembly, preferably the protective member is constructed with a pair of first walls extending in the longitudinal direction of the connector body, and an open unit exists between both ends of one of the first walls and both ends of the other first wall.

Preferably the connector assembly further includes an interposing member interposed between the connector and the protective member. The interposing member couples the connector and the protective member together while maintaining a positional relationship between the connector and the protective member constant.

In the connector assembly, preferably the connector further includes a reinforcing metal fitting attached to the connector body, and the interposing member includes a main body and a protective member outside holding arm and a connector holding arm, which extend from the main body, the protective member outside holding arm includes an engagement unit holding the protective member from an outside, and the connector holding arm includes a holder holding the reinforcing metal fitting.

In the connector assembly, preferably the interposing member further includes a protective member inside holding arm extending from the main body, and the protective member inside holding arm includes an engagement unit holding the protective member from an inside.

According to another aspect of the present invention, a connector pair includes: the connector assembly; and an opposing connector fitted in the connector.

In the connector pair, preferably the opposing connector is fitted in the connector in a state in which the connector and protective member are fixed to the surface of the substrate after coupled together and placed on the surface of the substrate.

According to the present invention, the connector assembly and the connector pair can be easily and certainly attached to the substrate surface while having the simple configuration, and the high airtightness can be certainly maintained to improve the reliability.

BRIEF DESCRIPTION OF THE DRAWINGS

FIG. 3A is a view illustrating the first connector mounted on the substrate, and FIG. 3B is a view illustrating the second connector mounted on the substrate.

FIG. 6A is a view illustrating the protective member seen obliquely from above, and FIG. 6B is a view illustrating the protective member seen obliquely from below.

FIG. 9A is a top view, FIG. 9B is a sectional view taken along a line B-B in FIG. 9A, and FIG. 9C is a sectional view taken along a line C-C in FIG. 9A.

FIG. 10A is a top view, FIG. 10B is a side view, FIG. 10C is a rear view, and FIG. 10D is a perspective view.

FIG. 13A is a top view, FIG. 13B is a side view, FIG. 13C is a bottom view, and FIG. 13D is a rear view.

FIG. 16A is a view illustrating the second connector mounted on the substrate, and FIG. 16B is a view illustrating the first connector mounted on the substrate.

FIG. 19A is a view illustrating the protective member seen obliquely from above, and FIG. 19B is a view illustrating the protective member seen obliquely from below.

FIG. 21A is a top view, and FIG. 21B is a sectional view taken along a line D-D in FIG. 21A.

FIG. 22A is a view illustrating only the protective member, and FIG. 22B is a view illustrating a positional relationship between the first connector and the protective member.

FIG. 24A is a view illustrating the interposing member seen obliquely from above, and FIG. 24B is a view illustrating the interposing member seen obliquely from below.

FIG. 26A is a view illustrating a state in which the protective member is temporarily held by the first connector, and FIG. 26B is a view illustrating a state in which the first connector and the protective member are mounted on the substrate.

FIG. 27A is a view illustrating only the protective member, and FIG. 27B is a view illustrating the positional relationship between the second connector and the protective member.

FIG. 29A is a view illustrating the interposing member seen obliquely from above, and FIG. 29B is a view illustrating the interposing member seen obliquely from below.

FIG. 31A is a view illustrating a state in which the protective member is temporarily held by the second connector, and FIG. 31B is a view illustrating a state in which the second connector and the protective member are mounted on the substrate.

FIG. 32A is a view illustrating only the protective member, and FIG. 32B is a view illustrating a positional relationship between a first connector and the protective member.

FIG. 34A is a view illustrating only the interposing member, and FIG. 34B is a view illustrating a state in which the first connector and the protective member are coupled together using the interposing member.

FIG. 35A is a view illustrating only the protective member, and FIG. 35B is a view illustrating a positional relationship between a second connector and the protective member.

FIG. 37A is a view illustrating only the interposing member, and FIG. 37B is a view illustrating a state in which the second connector and the protective member are coupled together using the interposing member.

FIG. 38A is a view illustrating only the protective member, and FIG. 38B is a view illustrating a positional relationship between a first connector and the protective member.

FIG. 40A is a view illustrating only the interposing member, and FIG. 40B is a view illustrating a state in which the first connector and the protective member are coupled together using the interposing member.

FIG. 41A is a view illustrating only the protective member, and FIG. 41B is a view illustrating a positional relationship between a second connector and the protective member.

FIG. 43A is a view illustrating only the interposing member, and FIG. 43B is a view illustrating a state in which the second connector and the protective member are coupled together using the interposing member.

DETAILED DESCRIPTION OF THE PREFFERED EMBODIMENTS

Embodiments will hereinafter be described in detail with reference to the drawings.

Figure 1:
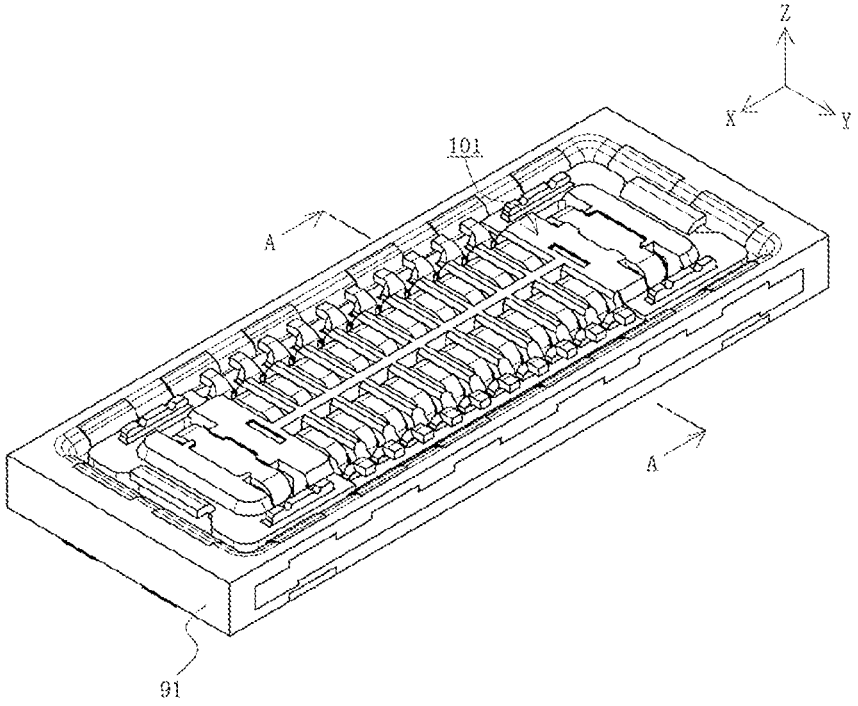
FIG. 1 is a perspective view illustrating a first connector and a second connector fitted together in Embodiment 1 when the first connector and the second connector are seen from a second connector side.
Figure 2:
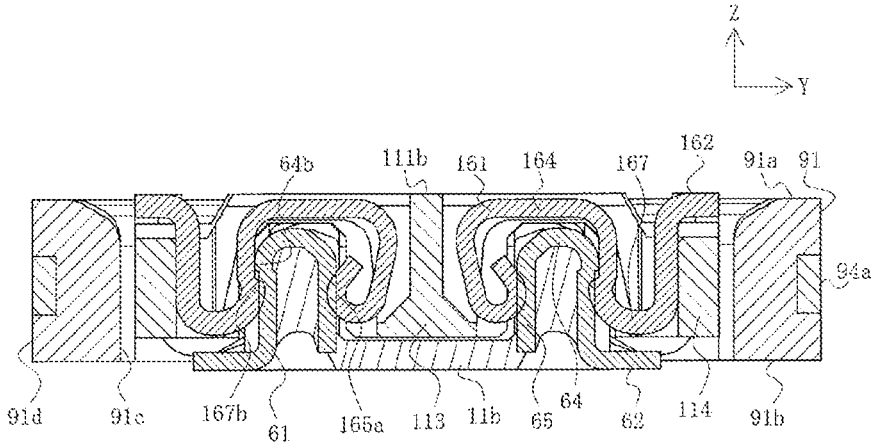
FIG. 2 is a sectional view illustrating the first connector and the second connector fitted together in Embodiment 1, and a sectional view taken along a line A-A in FIG. 1.
Figure 3A:
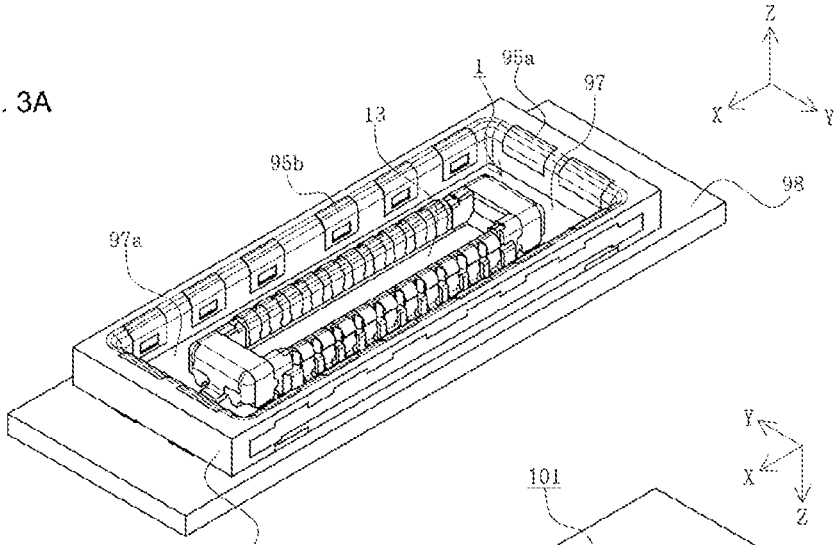
FIGS. 3A and 3B are perspective views illustrating the first connector and the second connector mounted on substrates in Embodiment 1.
Figure 3B:
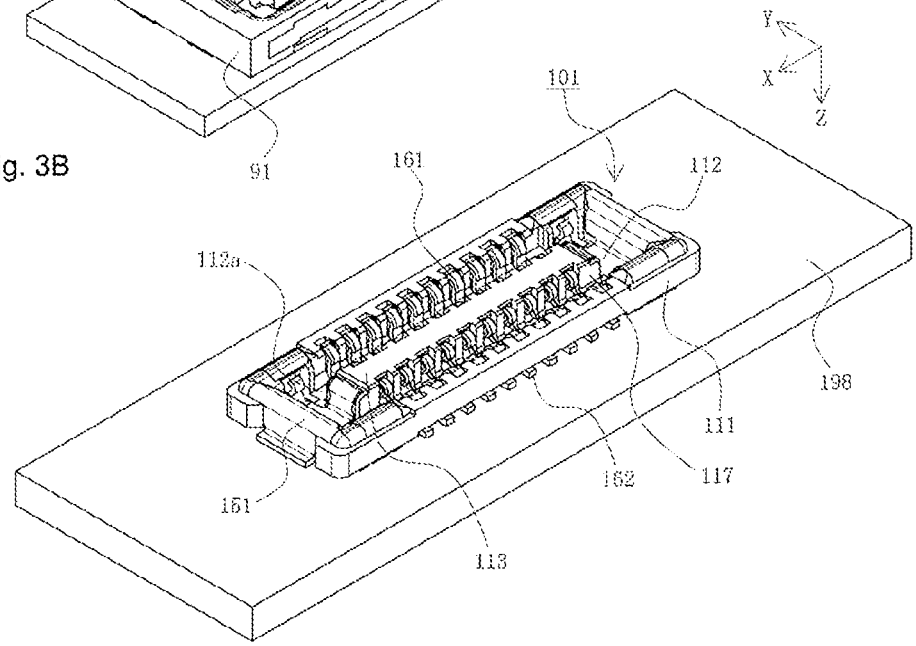
Figure 4:
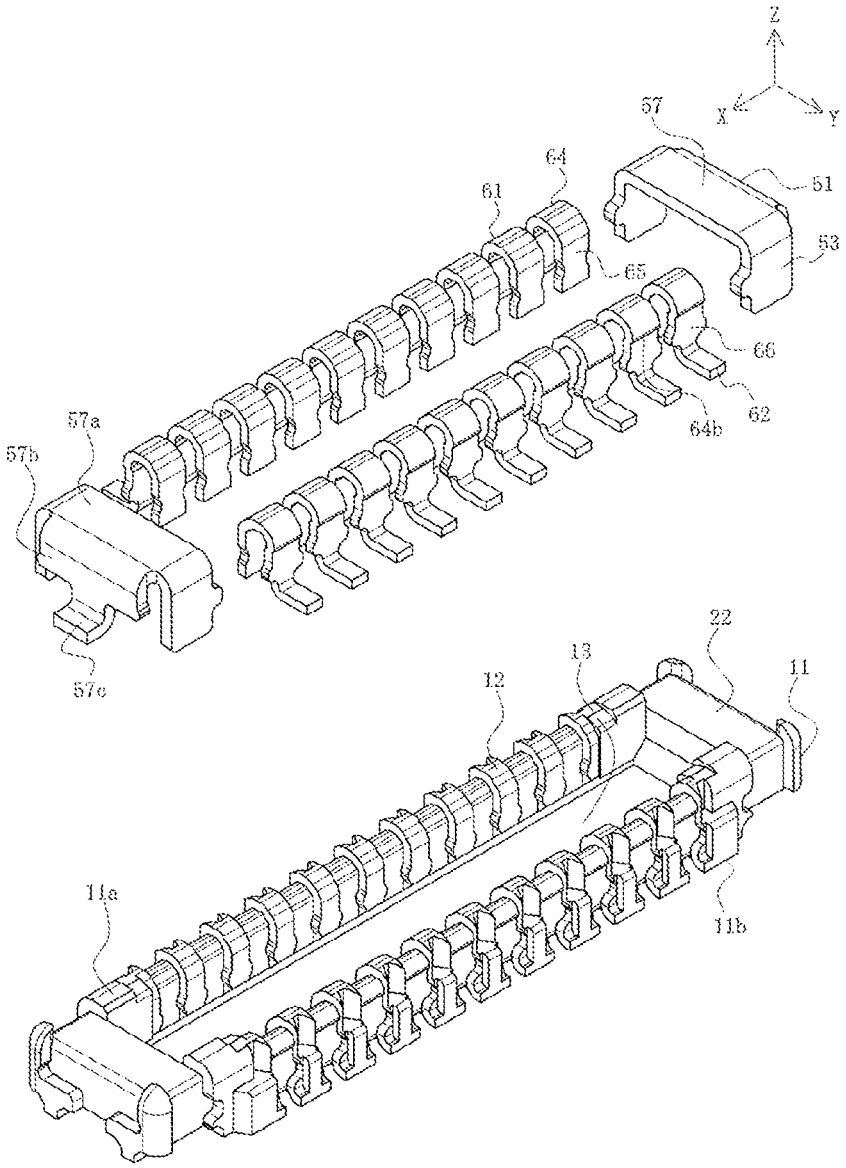
FIG. 4 is an exploded view illustrating the first connector of Embodiment 1.
Figure 5:
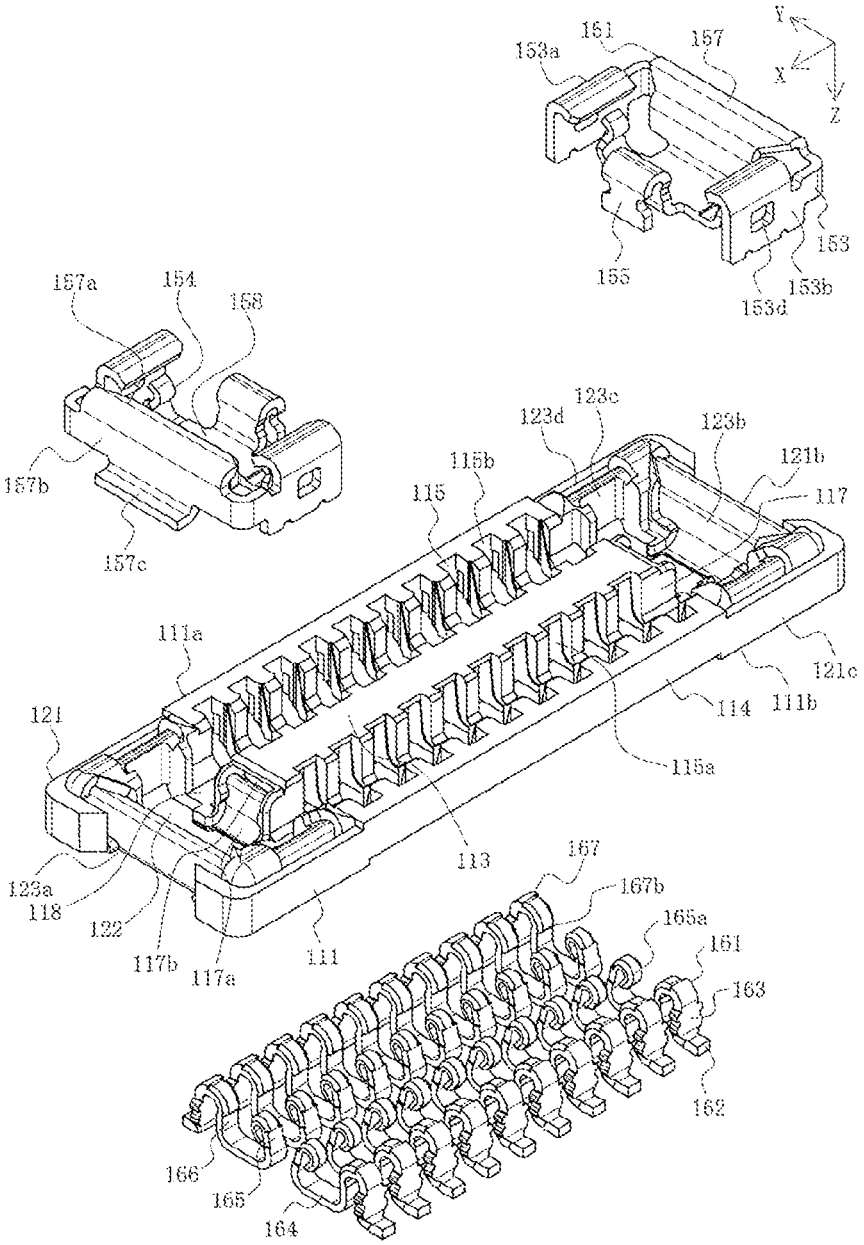
FIG. 5 is an exploded view illustrating the second connector of Embodiment 1.
Figure 6A:
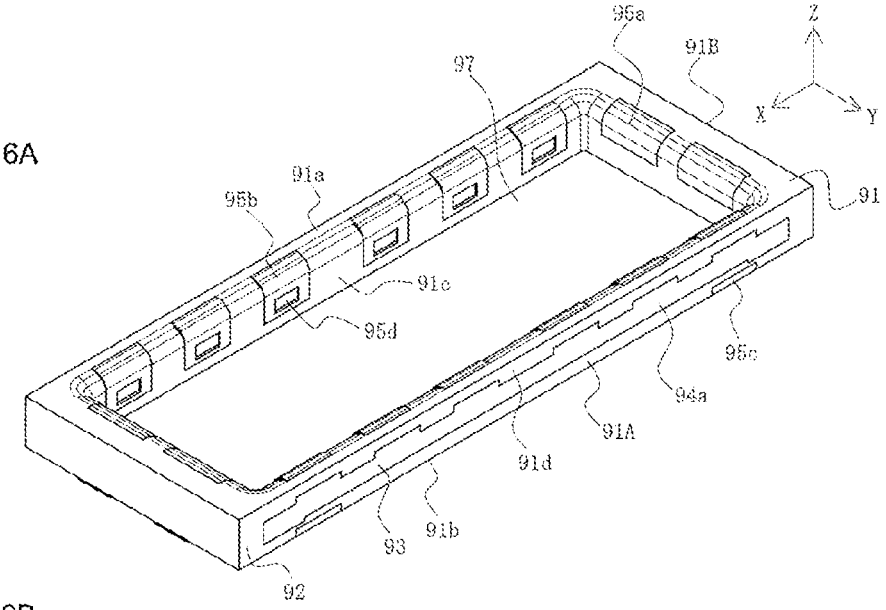
FIGS. 6A and 6B are perspective views illustrating a protective member of Embodiment 1.
Figure 6B:
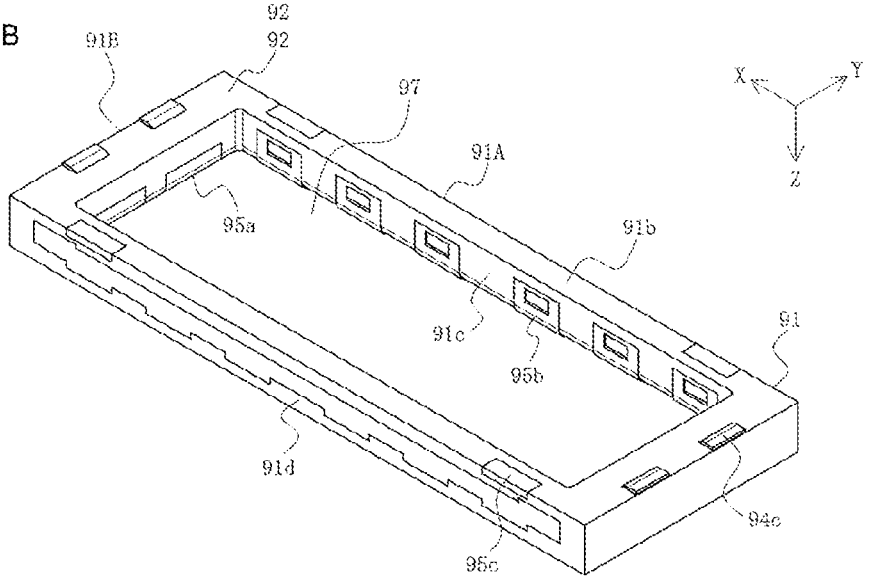
Figure 7:
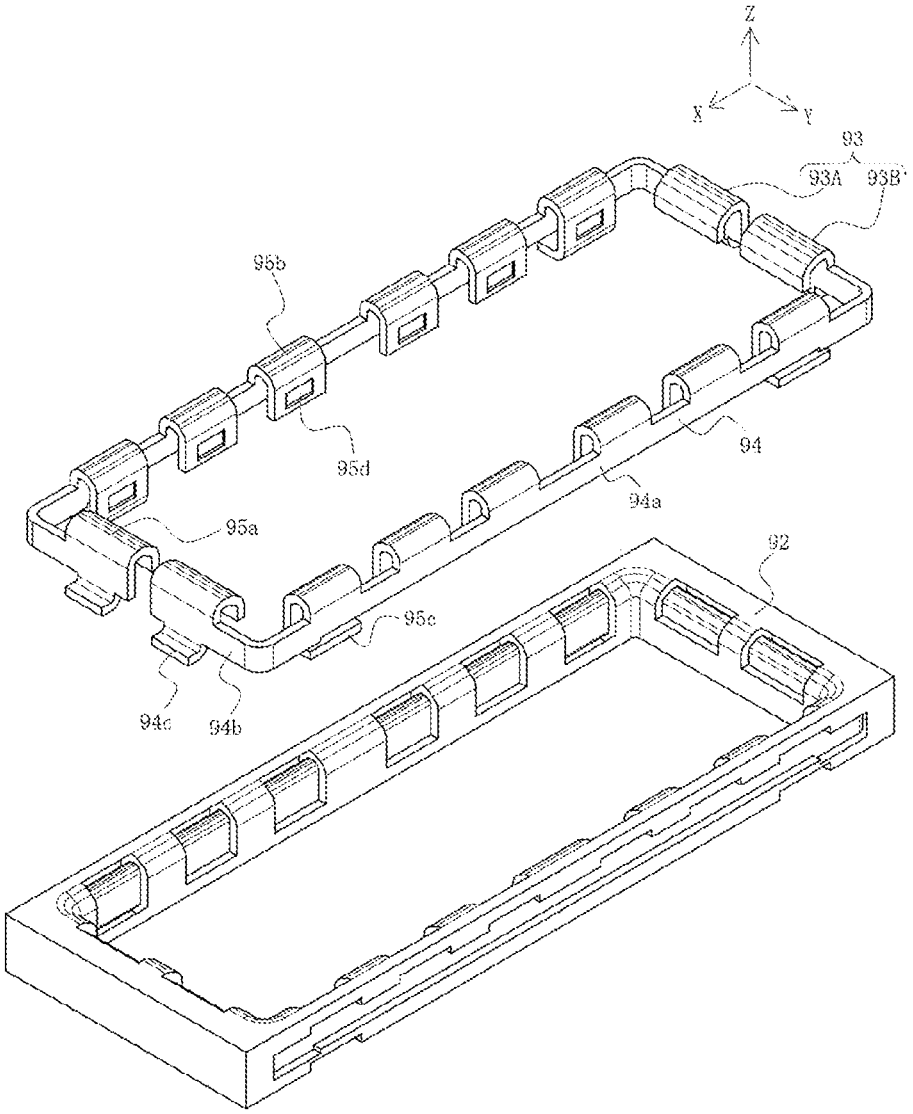
FIG. 7 is an exploded view illustrating the protective member of Embodiment 1.
Figure 8:
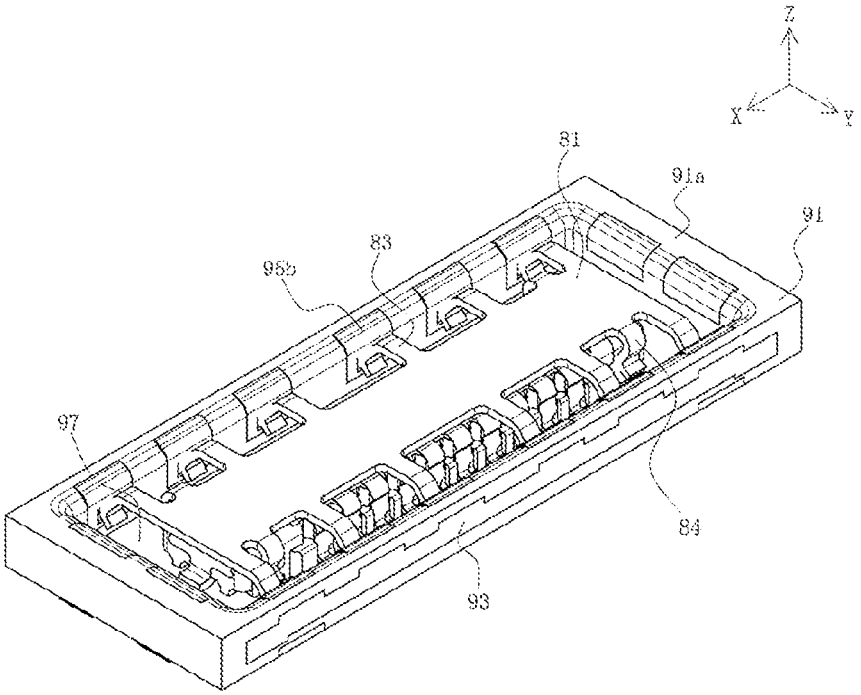
FIG. 8 is a perspective view illustrating a state in which the protective member is temporarily held by the first connector in Embodiment 1.
Figure 9A:
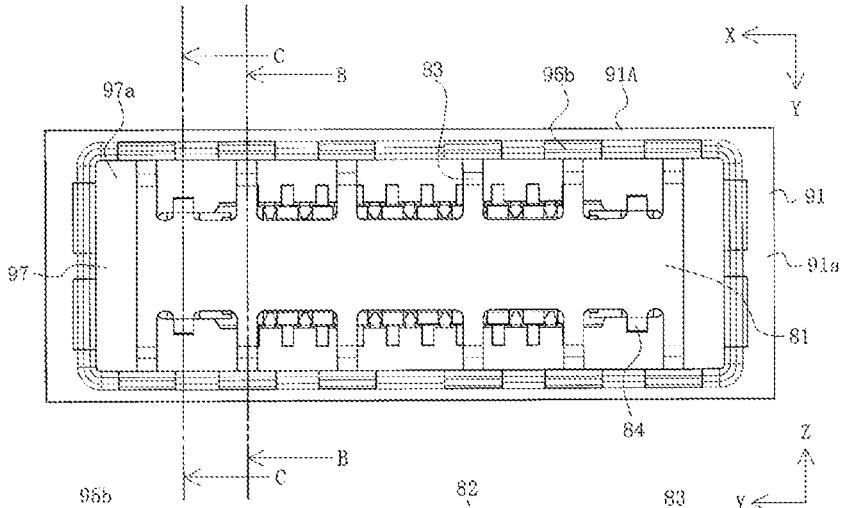
FIGS. 9A-9C are three-plane drawings illustrating a state in which the protective member is temporarily held in the first connector in Embodiment 1.
Figure 9B:
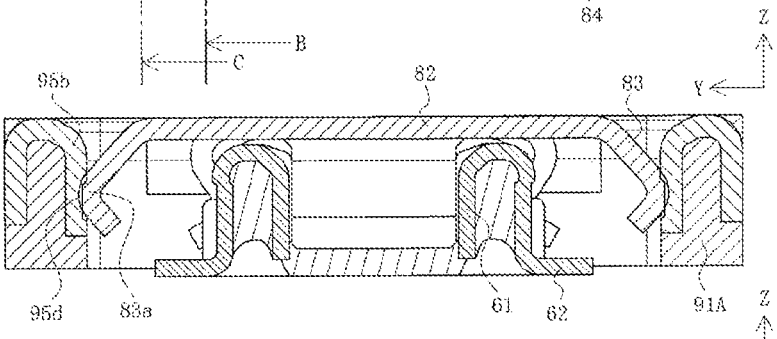
Figure 9C:
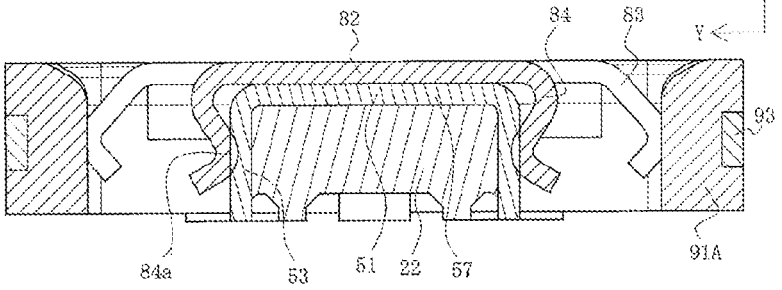
Figure 10D:
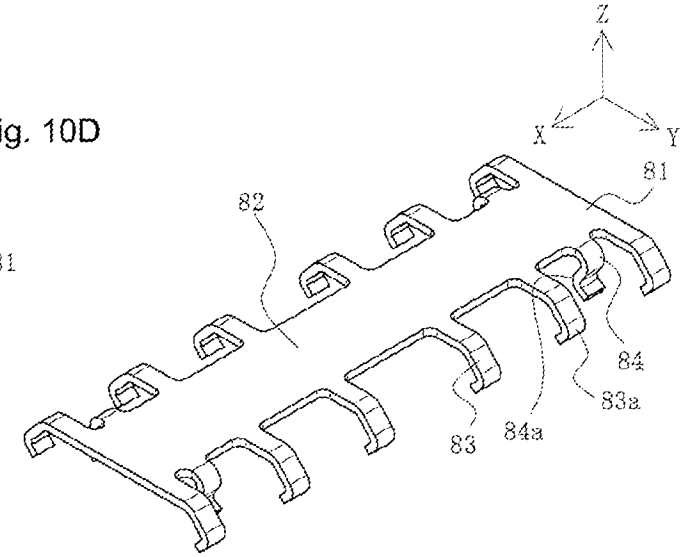
FIGS. 10A-10D are four-plane drawings illustrating an interposing member of Embodiment 1.
Figure 10C:
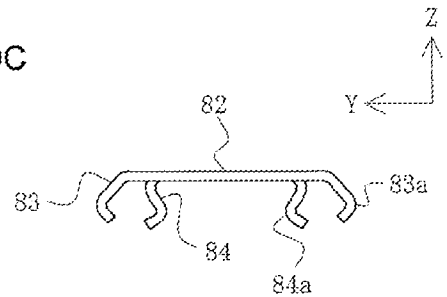
Figure 10A:
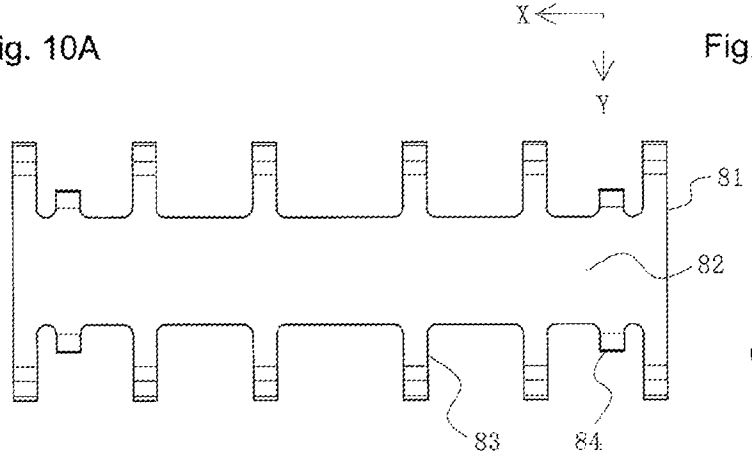
Figure 10B:
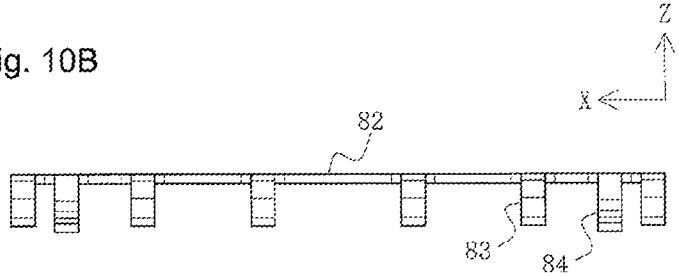

FIG. 1 is a perspective view illustrating a first connector and a second connector fitted together in Embodiment 1 when the first connector and the second connector are seen from a second connector side, FIG. 2 is a sectional view illustrating the first connector and the second connector fitted together in Embodiment 1 and a sectional view taken along a line A-A in FIG. 1, FIGS. 3A and 3B are perspective views illustrating the first connector and the second connector mounted on substrates in Embodiment 1, FIG. 4 is an exploded view illustrating the first connector of Embodiment 1, FIG. 5 is an exploded view illustrating the second connector of Embodiment 1, FIGS. 6A and 6B are perspective views illustrating a protective member of Embodiment 1, FIG. 7 is an exploded view illustrating the protective member of Embodiment 1, FIG. 8 is a perspective view illustrating a state in which the protective member is temporarily held by the first connector in Embodiment 1, FIGS. 9A-9C are three-plane drawings illustrating a state in which the protective member is temporarily held in the first connector in Embodiment 1, and FIGS. 10A-10D are four-plane drawings illustrating an interposing member of Embodiment 1. FIG. 3A is a view illustrating the first connector mounted on the substrate, and FIG. 3B is a view illustrating the second connector mounted on the substrate. FIG. 6A is a view illustrating the protective member seen obliquely from above, and FIG. 6B is a view illustrating the protective member seen obliquely from below. FIG. 9A is a top view, FIG. 9B is a sectional view taken along a line B-B in FIG. 9A, and FIG. 9C is a sectional view taken along a line C-C in FIG. 9A. FIG. 10A is a top view, FIG. 10B is a side view, FIG. 10C is a rear view, and FIG. 10D is a perspective view.

In the drawings, a first connector 1 is a connector of Embodiment 1, and is one of a pair of substrate-to-substrate connectors that is a connector pair. The first connector 1 is a surface mount type connector mounted on a surface of a first substrate 98 that is a substrate as a mounting member, and is fitted in a second connector 101 that is an opposing connector of the connector pair. The second connector 101 is the other of the pair of substrate-to-substrate connectors, is a surface mount type connector mounted on a surface of a second substrate 198 that is the substrate as the mounting member, and is fitted in the first connector 1 that is an opposing connector of the connector pair. As illustrated in FIG. 3A, a protective member 91 that is a frame member having a frame shape in planar view is attached to the surface of the first substrate 98, and the first connector 1 is attached to and mounted on the surface of the first substrate 98 while accommodated in an accommodation unit 97 of the protective member 91. As illustrated in FIGS. 1 and 2, when the first connector 1 and the second connector 101 are fitted together, the second connector 101 is also accommodated in the accommodation unit 97 of the protective member 91, and the protective member 91 surrounds the peripheries of the first connector 1 and the second connector 101 fitted together. Note that the first substrate 98 and the second substrate 198 are not illustrated in FIGS. 1 and 2.

The first connector 1 and the second connector 101 of Embodiment 1 are preferably used to electrically connect the first substrate 98 and the second substrate 198 as the substrate, and can also be used to electrically connect other members. For example, the first substrate 98 and the second substrate 198 are a printed circuit board, a flexible flat cable (FFC), and a flexible circuit board (FPC), which are used in electronic devices, but may be any type of substrate.

In Embodiment 1, expressions indicating directions such as top, bottom, left, right, front, rear, and the like used to describe a configuration and operation of each unit of the first connector 1, the second connector 101, the protective member 91, and the like are relative rather than absolute, and are proper when each unit of the first connector 1, the second connector 101, the protective member 91, and the like are in positions illustrated in the drawings, but should be changed and interpreted according to a change in position when the posture changes.

The first connector 1 is what is called a plug connector type, and includes a first housing 11 as a connector body integrally formed using an insulating material such as a synthetic resin. As illustrated in the drawings, the first housing 11 has a substantially rectangular thick plate-like shape that is a substantially rectangular parallelepiped. An elongated recessed groove 13 extending in a longitudinal direction (X-axis direction) of the first housing 11 and a first protrusion 12 as an elongated protrusion defining an outside of the recessed groove 13 and extending in the longitudinal direction of the first housing 11 are integrally formed on the side fitted in the second connector 101 of the first housing 11, namely, on the side of a fitting surface 11*a* (the side in a positive Z-axis direction). The first protrusion 12 is formed along both sides of the recessed groove 13 and along both sides of the first housing 11. For example, the first connector 1 has dimensions of a length of about 5.2 mm, a width of about 1.9 mm, and a thickness of about 0.5 mm. However, the dimensions can be changed as appropriate.

The first terminal 61 as a terminal is attached to each of the first protrusions 12. A plurality (for example, 10) of first terminals 61 are formed at a predetermined pitch (for example, about 0.35 mm). The pitch and the number of the first terminals 61 can be appropriately changed. In the recessed groove 13, the side mounted on the first substrate 98, namely, the side of a mounting surface 11*b* (the side in a negative Z-axis direction) is closed by a bottom plate.

A first protrusion end 22 as a fitting guide is disposed on each of both sides in the longitudinal direction of the first housing 11. The first protrusion end 22 is a thick member extending in a width direction (Y-axis direction) of the first housing 11, both ends of the first protrusion end 22 are connected to both ends in the longitudinal direction of the first protrusion 12, and an upper surface of the first protrusion end 22 has a substantially rectangular shape. In a state in which the first connector 1 and the second connector 101 are fitted together, the first protrusion end 22 functions as an insertion protrusion inserted into a fitting recess 122 of a second protrusion end 121 included in the second connector 101. A first reinforcing metal fitting 51 that is a reinforcing metal fitting is attached to the first protrusion end 22.

The first terminal 61 and the first reinforcing metal fitting 51 may be held while press-fitted in the first housing 11. However, in this case, the first terminal 61 and the first reinforcing metal fitting 51 will be described as a member integrated with the first housing 11 by over-molding (insert molding). Thus, it should be noted that although the first terminal 61 and the first reinforcing metal fitting 51 do not exist apart from the first housing 11, for convenience, in FIG. 4, the first terminal 61 and the first reinforcing metal fitting 51 are illustrated apart from the first housing 11.

The first terminal 61 is a member integrally formed by performing processing such as punching and bending on a conductive metal plate, and includes a first contact unit 65, a connection unit 64 connected to an upper end of the first contact unit 65, a second contact unit 66 connected to an outer end of the connection unit 64, and a tail 62 connected to a lower end of the second contact unit 66. The tail 62 extends toward an outside of the first housing 11 and is connected to a connection pad coupled to a conductive trace of the first substrate 98 by soldering or the like. The conductive trace is typically a signal line. Additionally, the surfaces of the first contact unit 65, the connection unit 64, and the second contact unit 66 are exposed to each side surface of the first protrusion 12 and the fitting surface 11*a*. On the side of the second contact unit 66 in the connection unit 64, a protrusion portion 64*b* protruding toward the outside in the width direction of the first housing 11 is formed at a boundary with the second contact unit 66.

The first reinforcing metal fitting 51 is a member integrally formed by performing processing such as punching or bending on a metal plate, and includes a center cover 57 as a main body covering the outside of the first protrusion end 22 and a side cover 53 connected to both the left and right ends of the center cover 57.

The center cover 57 includes a protrusion end upper cover 57*a* extending in the width direction of the first housing 11 and covering a major portion of an upper surface of the first protrusion end 22, a connection cover 57*b* that is connected to an outside end edge of the first protrusion end 22 in the protrusion end upper cover 57*a* while bent by about 90 degrees, and a tail 57*c* that is bent and connected to the lower end of the connection cover 57*b* and extends to ward the outside in a front-back direction (X-axis direction), namely, in the longitudinal direction of the first housing 11. The tail 57*c* is connected to the connection pad coupled to the conductive trace of the first substrate 98 by soldering or the like. The conductive trace is typically a power line or a ground lines. The lower end of the side cover 53 is similarly connected to the connection pad of the first substrate 98 by soldering and the like.

The second connector 101 is what is called a receptacle connector type, and includes a second housing 111 as a connector body integrally formed using an insulating material such as a synthetic resin. As illustrated in the drawings, the second housing 111 has a substantially rectangular thick plate-like shape that is a substantially rectangular parallelepiped, and a substantially rectangular recess 112 that is fitted in the first housing 11 of the first connector 1 is formed on the side on which the first connector 1 is fitted, namely, on the side of the fitting surface 111*a* (the side in the negative Z-axis direction), a periphery of the recess 112 being surrounded. For example, the second connector 101 has dimensions of a length (a size in the X-axis direction) of about 6.0 mm, a width (a size in the Y-axis direction) of about 2.0 mm, and a thickness (a size in the Z-axis direction) of about 0.6 mm. However, the dimensions can be changed as appropriate.

A second protrusion 113 as an islet fitted in the recessed groove 13 of the first connector 1 is integrally formed with the second housing 111 in the recess 112, and a sidewall 114 extending parallel to the second protrusion 113 is integrally formed with the second housing 111 on both sides (the side of the positive Y-axis direction and the side of the negative Y-axis direction) of the second protrusion 113. The second protrusion 113 and the sidewall 114 protrude upward (negative Z-axis direction) from a bottom plate 118 defining the bottom surface of the recess 112, and extend in the longitudinal direction (X-axis direction) of the second housing 111. Consequently, a recessed groove 112*a* that is an elongated recess extending in the longitudinal direction of the second housing 111 is formed as a part of the recess 112 on both the sides of the second protrusion 113.

A second terminal accommodating inside cavity 115*a* having a recessed groove shape is formed in side surfaces on both the sides of the second protrusion 113. A second terminal accommodating outside cavity 115*b* having a recessed groove shape is formed in a side surface on the inside of the sidewall 114. The second terminal accommodating inside cavity 115*a* and the second terminal accommodating outside cavity 115*b* are coupled together and are integrated with each other at the bottom surface of the recessed groove 112*a*, so that the second terminal accommodating inside cavity 115*a* and the second terminal accommodating outside cavity 115*b* are described as a second terminal accommodating cavity 115 when collectively described. The second terminal accommodating cavity 115 is formed so as to pierce the bottom plate 118 in the plate-thickness direction (Z-axis direction).

In Embodiment 1, the second terminal accommodating cavity 115 is formed on both the sides in the width direction (Y-axis direction) of the second housing 111 while arranged in the longitudinal direction of the second housing 111. Specifically, a plurality (for example, 10) of second terminal accommodating cavities 115 are formed on both the sides of the second protrusion 113 at a predetermined pitch (for example, about 0.35 mm). The pitch and the number of the second terminal accommodating cavity 115 can be changed as appropriate. A plurality of second terminals 161, which are a terminal accommodated in each of the second terminal accommodating cavities 115 and attached to the second housing 111, are also disposed at a similar pitch on both the sides of the second protrusion 113.

The second terminal 161 is a member integrally formed by performing processing such as punching and bending on a conductive metal plate, and includes a held unit 163, a tail 162 connected to the lower end of the held unit 163, an upper connection unit 167 connected to the upper end of the held unit 163, a second contact unit 166 connected to the lower end of the upper connection unit 167 and opposed to the held unit 163, a lower connection unit 164 connected to the lower end of the second contact unit 166, and an inside connection unit 165 connected to an end of the lower connection unit 164 on the opposite side to the second contact unit 166.

The held unit 163 is a portion that is fitted in and held by the second terminal accommodating outside cavity 115*b* while extending in a fitting direction (Z-axis direction), namely, in the thickness direction of the second housing 111. The tail 162 is bent and connected to the held unit 163, extends in a left-right direction (Y-axis direction), namely, outward in the width direction of the second housing 111, and is connected to the connection pad coupled to the conductive trace of the second substrate 198 by soldering or the like. The conductive trace is typically a signal line. The upper connection unit 167 is a portion that is curved so as to protrude upward (negative Z-axis direction).

The second contact unit 166 extending downward (positive Z-axis direction) is connected to the lower end of the upper connection unit 167 on the opposite side to the held unit 163. The upper connection unit 167 includes a protrusion portion 167*b* protruding inward in the width direction of the second housing 111 at the lower end of the upper connection unit 167. The lower connection unit 164 is a portion including a substantially U-shaped side surface connected to the lower end of the second contact unit 166. A first contact unit 165*a* curved by about 180 degrees is connected to the upper end of the inside connection unit 165 so as to protrude upward and toward the second contact unit 166.

The second terminal 161 is fitted in the second terminal accommodating cavity 115 from the side of the mounting surface 111*b* that is the lower surface (a surface in the positive Z-axis direction) of the second housing 111, and the held unit 163 is sandwiched from both the sides by the sidewalls of the second terminal accommodating outside cavity 115*b* formed on the side surface on the inside of the sidewall 114, whereby the second terminal 161 is fixed to the second housing 111. In this state, namely, in the state in which the second terminal 161 is loaded into the second housing 111, the first contact unit 165*a* and the second contact unit 166 are positioned on the right and left sides of the recessed groove 112*a* and face each other. The second terminal 161 is a member integrally formed by processing a metal plate, and thus has a certain degree of elasticity. As is clear from the shape, an interval between the first contact unit 165*a* and the second contact unit 166 facing each other can be elastically changed. That is, when the first terminal 61 included in the first connector 1 is inserted between the first contact unit 165*a* and the second contact unit 166, the interval between the first contact unit 165*a* and the second contact unit 166 is elastically elongated.

The second terminal 161 may be integrated with the second housing 111 by over-molding (insert molding).

The second protrusion end 121 as a fitting guide is disposed on each of both the sides in the longitudinal direction of the second housing 111. The fitting recess 122 is formed as part of the recess 112 in each second protrusion end 121. The fitting recess 122 is a substantially rectangular recess, and is connected to both the ends in the longitudinal direction of each recessed groove 112*a*. In the state in which the first connector 1 and the second connector 101 are fitted together, the first protrusion end 22 included in the first connector 1 is inserted in the fitting recess 122.

The second protrusion end 121 includes a sidewall extension 121*c* as a sidewall of the second protrusion end 121 extending in the longitudinal direction of the second housing 111 from both the ends in the longitudinal direction of the sidewall 114 and an end wall 121*b* extending in the width direction of the second housing 111, both ends of the end wall 121*b* being connected to the sidewall extension 121*c*. In each second protrusion end 121, the end wall 121*b* and the sidewall extension 121*c* connected to both the ends of the end wall 121*b* form a continuous and substantially U-shaped sidewall and define three sides of the substantially rectangular fitting recess 122. In the end wall 121*b*, an outer end recess 123*a* recessed into the outside surface is formed, and an inner end recess 123*b* recessed into the inside surface is formed. An inside recess 123*c* recessed into the inside surface is formed in the sidewall extension 121*c*. A slit-shaped intermediate recess 123*d* piercing in the vertical direction is formed between the inside surface and the outside surface.

A recessed island end recess 117*a* is formed in an end face in the longitudinal direction (the surface opposed to the end wall 121*b*) of an island end 117, which is the end in the longitudinal direction of the second protrusion 113. A slit-shaped island recess 117*b* piercing in the vertical direction is formed at a boundary with the island end recess 117*a* in the upper surface of the island end 117.

A second reinforcing metal fitting 151 as a reinforcing metal fitting attached to the second housing 111 is attached to the second protrusion end 121. The second reinforcing metal fitting 151 is a member integrally formed by performing processing such as punching or bending on the metal plate, and includes an end wall cover 157 as a main body covering the outside of the end wall 121*b* of the second protrusion end 121, a connection arm 153 connected to the left and right ends of the end wall cover 157, a bottom surface cover 158 connected to the end wall cover 157 and covering a bottom surface of the fitting recess 122, and an island end cover 155 connected to the bottom surface cover 158, and a pair of right and left contact arms 154.

The second reinforcing metal fitting 151 may be pressed into and held by the second housing 111. However, in this case, the second reinforcing metal fitting 151 and the second housing 111 will be described as a member integrated with another by over-molding (insert molding). For this reason, each unit of the second housing 111 to which the second reinforcing metal fitting 151 is attached, such as the outer end recess 123*a*, the inner end recess 123*b*, the intermediate recess 123*d*, the island end recess 117*a*, and the island recess 117*b*, does not necessarily exist in the form as illustrated in FIG. 5 while being separated from the second reinforcing metal fitting 151. However, it should be noted that the illustration in FIG. 5 is merely done for convenience.

The end wall cover 157 includes an end wall upper cover 157*a* extending in the width direction of the second housing 111 and covering a major portion of the upper surface of the end wall 121*b*, and an end wall outer cover 157*b* extending downward from an outside end edge of the end wall 121*b* in the end wall upper cover 157*a*, and a tail 157*c* that is bent and connected to the lower end of the end wall outer cover 157*b* and extends outward in the front-back direction (X-axis direction), namely, in the longitudinal direction of the second housing 111.

The end wall upper cover 157*a* is an incline portion extending diagonally downward from the upper end of the end wall 121*b* toward the fitting recess 122, and is accommodated in a portion near the upper end in the inner end recess 123*b* with the outer surface of the inclined portion exposed. Thus, the vicinity of the upper end of the inner surface on the end side in the longitudinal direction of the second housing 111 in the fitting recess 122 is an inclined surface covered with the end wall upper cover 157*a*. Almost all of the outer end recess 123*a* of the end wall 121*b* is covered with the end wall outer cover 157*b*. The tail 157*c* is connected to the connection pad coupled to the conductive trace of the second substrate 198 by soldering or the like. The conductive trace is typically a power line or a ground line.

The connection arm 153 is a member that is bent and connected to each of both the ends in the width direction (Y-axis direction) of the end wall cover 157, the member extending toward the center in the longitudinal direction of the second housing 111. A substantially rectangular flat plate-shaped side plate 153*b* is formed on the tip of each connection arm 153, and a sidewall upper cover 153*a* is connected to the upper end of the side plate 153*b*.

When the second reinforcing metal fitting 151 and the second housing 111 are integrated with each other, the major portion of the connection arm 153 is embedded in the second protrusion end 121, and the major portion of the side plate 153*b* is embedded in the sidewall extension 121*c* in a posture in which the major portion of the side plate 153*b* is accommodated in the intermediate recess 123*d* formed in the sidewall extension 121*c*. Thus, the outside or the inside of the side plate 153*b* is covered with an insulating material, such as a synthetic resin, which forms the second housing 111. A through-hole 153*d* piercing the side plate 153*b* in the plate pressure direction is formed in the side plate 153*b*, and the outside portion and the inside portion of the sidewall extension 121*c* are coupled together through the through-hole 153*d*. Thus, the sidewall extension 121*c* is strongly integrated with the side plate 153*b*, and exerts high strength even when the width dimension is small and thin.

The dimension in the fitting direction, namely, in the vertical direction (Z-axis direction) of the side plate 153*b* is larger than that of the sidewall extension 121*c*, and the vicinity of the upper end and the vicinity of the lower end of the side plate 153*b* are exposed above and below the sidewall extension 121*c*. Preferably the lower end face of the side plate 153*b* is flush with the lower surface of the tail 157*c*, abuts on the surface of the second substrate 198, and is connected to the connection pad coupled to the power line or the ground line by soldering or the like. Consequently, the strength of the sidewall extension 121*c* and the side plate 153*b* integrated with each other is further improved.

When the second reinforcing metal fitting 151 and the second housing 111 are integrated with each other, the portion near the tip of the island end cover 155 is embedded in the second protrusion 113 in a posture in which the portion near the tip of the island end cover 155 is accommodated in the island recess 117*b*, and the major portion of the island end cover 155 is exposed to the end of the second protrusion 113 so as to cover the whole island end recess 117*a*. Consequently, the end of the second protrusion 113 is covered with the integrated island end cover 155, so that the end of the second protrusion 113 is certainly protected. The end wall cover 157 is integrated with the end wall 121*b*, and the island end cover 155 is integrated with the second protrusion 113 at both the ends in the longitudinal direction of the second reinforcing metal fitting 151, so that the strength of the second reinforcing metal fitting 151 is improved.

Each of the pair of right and left contact arms 154 is an elongated plate member with a base end that is connected to the side edge of the bottom surface of the bottom surface cover 158, and is an elastic piece that is curved so as to have a substantially S-shape as seen from the front-back direction. The contact arm 154 is curved so as to protrude outward in the width direction of the second housing 111, and the vicinity of the tip of the contact arm 154 functions as a spring that is elastically displaceable in the width direction of the second housing 111. In the vicinity of the tip of the contact arm 154, the portion that is curved so as to protrude toward the center in the width direction of the second housing 111 elastically contacts with the first reinforcing metal fitting 51 of the first connector 1 when the first connector 1 and the second connector 101 are fitted together to insert the first protrusion end 22 into the fitting recess 122.

The connector assembly of Embodiment 1 includes the first connector 1 and the protective member 91. The protective member 91 is a frame member having a rectangular shape in planar view. As illustrated in FIGS. 6A and 6B, the protective member 91 includes a first wall 91A as a pair of parallel long sides extending linearly in the longitudinal direction (X-axis direction) and a second wall 91B as a pair of parallel short sides extending linearly in the width direction (Y-axis direction), and both the ends of each first wall 91A and both the ends of each second wall 91B are connected so as to form a right angle. Four sides of the periphery of the accommodation unit 97 having a rectangular shape in planar view are defined by the first wall 91A and the second wall 91B. The sectional shapes of the first wall 91A and the second wall 91B are a substantial rectangle. The upper surfaces (the surfaces in the positive Z-axis direction) of the first wall 91A and the second wall 91B are a flat surface opposed to the surface of the second substrate 198, and constitute a second substrate side surface 91*a* as one of the substrate side surfaces of the protective member 91. The lower surfaces (the surface in the negative Z-axis direction) of the first wall 91A and the second wall 91B are a flat surface opposed to the surface of the first substrate 98, and constitute a first substrate side surface 91*b* as the other substrate side surface of the protective member 91. The side surfaces of the first wall 91A and the second wall 91B facing the accommodation unit 97 are a flat surface, and constitute an inside surface 91*c*. In Embodiment 1, because the protective member 91 is mounted on the surface of the first substrate 98 together with the first connector 1, the first substrate side surface 91*b* can be referred to as a mounting substrate side surface, and the second substrate side surface 91*a* can be referred to as an opposing substrate side surface.

The dimension in a height direction (Z-axis direction) of the protective member 91, namely, the interval between the second substrate side surface 91*a* and the first substrate side surface 91*b* is set to be smaller than the interval between the mounting surface 11*b* of the first housing 11 and the mounting surface 111*b* of the second housing 111 in the state in which the first connector 1 and the second connector 101 are fitted together as illustrated in FIG. 2. This enables the first connector 1 mounted on the surface of the first substrate 98 and the second connector 101 mounted on the surface of the second substrate 198 to be prevented from interference of fitting together. The dimension of the accommodation unit 97 is set to be larger than the outside dimension of the second connector 101. Consequently, the second connector 101 can be accommodated in the accommodation unit 97.

The protective member 91 includes a protective housing 92 as a protective member body integrally made of an insulating material such as a synthetic resin and a protective metal fitting 93 as a reinforcing metal fitting that is a member integrally formed by punching, bending, or the like on the conductive metal plate. The protective metal fitting 93 includes a protective metal fitting right member 93A and a protective metal fitting left member 93B corresponding to a right half in the width direction and a left half in the width direction of the protective member 91, and the protective metal fitting right member 93A and the protective metal fitting left member 93B have a shape that is symmetrical with respect to an X-Z plane passing through the center in the width direction of the protective member 91. For this reason, the protective metal fitting right member 93A and the protective metal fitting left member 93B are described as the protective metal fitting 93 when collectively described.

The protective metal fitting 93 does not exist apart from the protective housing 92 because the protective metal fitting 93 is a member that is integrated with the protective housing 92 by over-molding (insert molding). However, it is noted that, for convenience, the protective metal fitting 93 is illustrated in FIG. 7 so as to be separated from the protective housing 92. The strength of the protective member 91 is improved by including the protective metal fitting 93. The electrically conductive protective metal fitting 93 functions as an electromagnetic shield, which allows the improvement of shielding properties of the first connector 1 and the second connector 101 fitted together. The protective metal fitting 93 may be omitted if not required. However, in this case, only the protective member 91 including the protective metal fitting 93 will be described.

The protective metal fitting 93 includes an elongate belt-shaped belt frame 94 and a first wall engaging unit 95*b* and a second wall engaging unit 95*a*, which are connected to the upper end of the belt frame 94. The belt frame 94 includes a first belt frame 94*a* that extends linearly in the longitudinal direction (X-axis direction) and is disposed on the first wall 91A and a second belt frame 94*b* that is connected to both the ends of the first belt frame 94*a*, extends linearly in the width direction (Y-axis direction), and is disposed on the second wall 91B. The second wall engaging unit 95*a* is connected to the upper end of the second belt frame 94*b*, and the first wall engaging unit 95*b* is connected to the upper end of the first belt frame 94*a*. A second wall tail 94*c* is connected to the lower end of the second belt frame 94*b* corresponding to the second wall engaging unit 95*a* in the second belt frame 94*b*, and a first wall extension 95*c* is connected to the lower ends of some first wall engaging units 95*b* (in the example illustrated in the drawing, the first wall engaging unit 95*b* connected near both the ends of the first belt frame 94*a*.

The second wall engaging unit 95*a* has a shape that is curved by about 180 degrees so as to swell upward (positive Z-axis direction), and at least a part of the second wall engaging unit 95*a* is exposed to the second substrate side surface 91*a*, the inside surface 91*c*, and a coupling portion between the second substrate side surface 91*a* and the inside surface 91*c* of the second wall 91B. The second wall tail 94*c* has a shape, which is curved about 90 degrees such that the tip of the second wall tail 94*c* is oriented outward in the longitudinal direction (X-axis direction), and at least a part of the lower surface of the second wall tail 94*c* is exposed to the first substrate side surface 91*b* of the second wall 91B.

The first wall engaging unit 95*b* has a shape that is curved by about 180 degrees so as to swell upward, and at least a part of the first wall engaging unit 95*b* is exposed to the second substrate side surface 91*a*, the inside surface 91*c*, and a coupling portion between the second substrate side surface 91*a* and the inside surface 91*c* of the first wall 91A. An engagement recess 95*d* recessed from the surface is formed as an engagement unit on the portions exposed to the inside surface 91*c* in the first wall engaging unit 95*b*. The first wall extension 95*c* has a shape, which is curved about 90 degrees such that the tip of the first wall extension 95*c* is oriented outward in the width direction (Y-axis direction), and at least a part of the lower surface of the first wall extension 95*c* is exposed to the first substrate side surface 91*b* of the first wall 91A. The first wall extension 95*c* is used to position the protective metal fitting 93 when the protective member 91 is manufactured, and also functions as a reinforcement of the protective member 91. At least a part of the first belt frame 94*a* is exposed to the outside surface 91*d*, which is the side surface of the first wall 91A on the opposite side to the inside surface 91*c*.

In Embodiment 1, as illustrated in FIG. 3A, the protective member 91 is attached to the surface of the first substrate 98 on which the first connector 1 is mounted. In this case, the second wall tail 94*c* is connected to the connection pad coupled to the conductive trace of the first substrate 98 by soldering or the like. The conductive trace is typically a power line or a ground lines. In Embodiment 1, as illustrated in FIG. 8, an interposing member 81 is used to intervene between the first connector 1 and the protective member 91 to control the positional relationship between the first connector 1 and the protective member 91.

The interposing member 81 is a member integrally formed by performing processing such as punching or bending on a metal plate, and includes an interposing body 82 as a main body that is a rectangular flat plate and a protective member holding arm 83 and a connector holding arm 84 as a protective member inside holding arm extending outward in the width direction (Y-axis direction) from the left and right side edges extending in the longitudinal direction (X-axis direction) of the interposing body 82. As long as the interposing member 81 can intervene between the first connector 1 and the protective member 91 to control the positional relationship between the first connector 1 and the protective member 91, the interposing member 81 is not necessarily made of metal, but may be made of an insulating material such as rubber and a synthetic resin or a composite member formed by combining metal and an insulating material.

The protective member holding arm 83 is an elongated plate member, and the protective member holding arms 83 are provided in a same quantity as the first wall engaging units 95*b* (in the example illustrated in the drawing, each six first wall engaging units 95*b* on the right and left) at positions corresponding to the first wall engaging units 95*b* of the protective metal fitting 93 included in the protective member 91. An engagement protrusion 83*a* as an engagement unit protruding toward the outside in the width direction is formed in each protective member holding arm 83. The engagement protrusion 83*a* is bent so as to be oriented toward the obliquely downward outside after extending horizontally outward in the width direction from the side end edge of the interposing body 82, is bent such that the tip of the engagement protrusion 83*a* is oriented toward the obliquely downward inside, and protrudes outward in the width direction in the vicinity of the tip of the protective member holding arm 83.

The connector holding arm 84 is an elongated plate member, and the connector holding arms 84 are provided in a same quantity as the number of right and left outsides of the first protrusion end 22 (in the example illustrated in the drawing, each two outsides on the right and left) at positions corresponding to both the right and left outsides of the first protrusion end 22 at both the ends in the longitudinal direction of the first housing 11 of the first connector 1. A holding protrusion 84*a* is formed as a holder in each connector holding arm 84. The holding protrusion 84*a* is curved and extends so as to be oriented from the side end edge of the interposing member 82 toward the downward inside, is curved such that the tip of holding protrusion 84*a* is oriented toward the downward outside, and swells inward in the width direction in the vicinity of the tip of the connector holding arm 84.

As illustrated in FIGS. 8 and 9A-9C, the first connector 1 and the protective member 91 can be not permanently, but temporarily coupled, and integrally retained using the interposing member 81. That is, the interposing member 81 can function as a temporary holding member, and temporarily hold the first connector 1 and the protective member 91 while coupling the first connector 1 and the protective member 91 together.

In the state of FIGS. 8 and 9A-9C, the engagement protrusion 83*a* of each protective member holding arm 83 of the interposing member 81 engages with the engagement recess 95*d* of each first wall engaging unit 95*b* exposed to the inside surface 91*c* of the protective member 91. In this state, as illustrated in FIG. 9B, the engagement protrusion 83*a* of the pair of left and right protective member holding arms 83 is pressed against the inside in the width direction by the first wall engaging unit 95*b*, and the protective member holding arm 83 is elastically deformed to exert spring force, so that the engagement protrusion 83*a* can certainly maintain the state of engagement with the engagement recess 95*d* by the spring force.

In the state of FIGS. 8 and 9A-9C, the holding protrusion 84*a* of each connector holding arm 84 of the interposing member 81 abuts on the side cover 53 of the first reinforcing metal fitting 51 attached to the first protrusion end 22 of the first housing 11 of the first connector 1. In this state, as illustrated in FIG. 9C, the holding protrusions 84*a* of the pair of left and right connector holding arms 84 is pressed against the outside in the width direction by the side cover 53, and the connector holding arm 84 is elastically deformed to exert the spring force, so that the holding protrusion 84*a* can sandwich the left and right side covers 53 of the first protrusion end 22 from both the left and right sides by the spring force. The lower surface of the interposing body 82 abuts on or is opposed to the upper surface of the center cover 57 of the first reinforcing metal fitting 51.

Thus, as illustrated in FIGS. 8 and 9A-9C, the first connector 1 and the protective member 91 are temporarily coupled together and integrally held while the positional relationship between the first connector 1 and the protective member 91 is maintained constant by the interposing member 81. Thus, the first connector 1 and the protective member 91 temporarily coupled together by the interposing members 81 in the state of FIGS. 8 and 9A-9C are held by a finger of an operator or a conveyance manipulator, whereby the first connector 1 and the protective member 91 are carried and placed at predetermined positions on the surface of the first substrate 98 while the condition is maintained. For example, the protective member 91 is held by the finger of the operator, or the upper surface of the interposing body 82 of the interposing member 81 is sucked using a suction nozzle of the conveyance manipulator, which allows the first connector 1 and the protective member 91 temporarily coupled together and integrated with each other by the interposing member 81 to be conveyed to the predetermined position on the surface of the first substrate 98.

The first connector 1 and the protective member 91 temporarily coupled together and integrated with each other by the interposing member 81 are attached to and mounted at the predetermined position on the surface of the first substrate 98 by a normal surface mounting technique. For example, paste-like solder is previously provided onto the surface of the connection pad formed on the surface of the first substrate 98. When the first connector 1 and the protective member 91 temporarily coupled together by the interposing member 81 are placed at the predetermined position on the surface of the first substrate 98, the paste-like solder is interposed between the tail 62 of the first terminal 61, the tail 57*c* of the first reinforcing metal fitting 51, and the lower end of the side cover 53 and the connection pad corresponding to the second wall tail 94*c* of the protective metal fitting 93. At this point, when what is called solder reflow treatment is performed in the inside of a heating furnace, the paste-like solder melts to solder the tail 62 of the first terminal 61, the tail 57*c* of the first reinforcing metal fitting 51, and the lower end of the side cover 53, and the second wall tail 94*c* of the protective metal fitting 93 and the corresponding connection pads, and the first connector 1 and the protective member 91 are fixed to and mounted on the surface of the first substrate 98.

Subsequently, potting is desirably performed for the purpose of waterproofing. Specifically, a potting agent made of resin such as urethane is applied to the surface of the first substrate 98 around the inside and the outside of the protective member 91. After the potting agent is applied to the surface of the first substrate 98 in the liquid state, treatment such as heating is performed to cure the potting agent, and the first connector 1 and the protective member 91 mounted on the surface of the first substrate 98 are surrounded by a large amount of liquid potting agent. Thus, a gap is blocked by the potting agent even when the gap exists between the first substrate side surface 91*b* of the protective member 91 and the surface of the first substrate 98, so that the airtightness or watertightness is maintained in the accommodation unit 97 of the protective member 91 attached to the surface of the first substrate 98 to an environment of the surface of the first substrate 98 on the outside of the protective member 91.

Subsequently, when the interposing member 81 is removed from the first connector 1 and the protective member 91 attached to the surface of the first substrate 98, the first connector 1 mounted on the front surface of the first substrate 98 can be obtained while accommodated in the accommodation unit 97 of the protective member 91 as illustrated in FIG. 3A. In the accommodation unit 97, a second connector accommodating space 97*a* that is a predetermined space is formed between the periphery of the first connector 1 and the protective member 91. The interposing member 81 can be removed before potting.

Subsequently, the first connector 1 and the second connector 101 are fitted together. In this case, it is assumed that the tail 162 of the second terminal 161, the lower end of the side plate 153*b* of the second reinforcing metal fitting 151, and the tail 157*c* of the end wall cover 157 of the second reinforcing metal fitting 151 are soldered to the connection pad formed on the surface of the second substrate 198, and that the second connector 101 is surface-mounted on the second substrate 198 as illustrated in FIG. 3B. Desirably an adhesive is applied to the surface of the second substrate 198 around the second connector 101. Specifically, an adhesive made of a UV curable, two-pack curable, moisture curable, or thermosetting resin is continuously applied to a portion, which is located around the second connector 101 on the surface of the second substrate 198 and opposed to the second substrate side surface 91*a* of the protective member 91, so as to surround the second connector 101.

The operator opposes the fitting surface 11*a* of the first housing 11 of the first connector 1 to the fitting surface 111*a* of the second housing 111 of the second connector 101, matches the position of the second protrusion 113 of the second connector 101 with the position of the corresponding recessed groove 13 of the first connector 1, and matches the position of the first protrusion end 22 of the first connector 1 with the position of the corresponding fitting recess 122 of the second connector 101, thereby completing the positioning of the first connector 1 and the second connector 101.

At this point, when the first connector 1 and/or the second connector 101 is moved in a direction approaching the opposing side, namely, in the fitting direction (Z-axis direction), the position of the second protrusion 113 of the second connector 101 is inserted into the corresponding recessed groove 13 of the first connector 1, the position of the first protrusion end 22 of the first connector 1 is inserted into the corresponding fitting recess 122 of the second connector 101, and the sidewall 114 and the second protrusion end 121 of the second connector 101 are inserted into the second connector accommodating space 97*a* around the first connector 1. Consequently, when the fitting between the first connector 1 and the second connector 101 is completed, the first terminal 61 and the second terminal 161 enter into a conduction state.

Furthermore, treatment such as heating, ultraviolet irradiation, and pressure imparting is performed to cure the adhesive between the surface of the second substrate 198 around the second connector 101 and the second substrate side surface 91*a* of the protective member 91. Consequently, a gap is blocked by the adhesive even when the gap exists between the second substrate side surface 91*a* of the protective member 91 and the surface of the second substrate 198, so that the airtightness or the watertightness is maintained to the environment of the surface of the second substrate 198 on the outside of the protective member 91 in the accommodation unit 97 of the protective member 91 opposed to the surface of the second substrate 198.

Thus, in the first connector 1 and the second connector 101 fitted together, both the surfaces in the vertical direction (Z-axis direction) are closed by the first substrate 98 and the second substrate 198, all side surfaces in the front-back direction (X-axis direction) and the width direction (Y-axis direction) are closed by the protective member 91, and the space between the surfaces of the first substrate 98 and the second substrate 198 and the first substrate side surface 91*b* and the second substrate side surface 91*a* of the protective member 91 is blocked by the potting agent and the adhesive, so that the high airtightness or watertightness is maintained against the surrounding environment to effectively protect from the invasion of a foreign matter such as moisture or dust.

Thus, in Embodiment 1, the connector assembly includes: the first connector 1 including the first housing 11, the first terminal 61 attached to the first housing 11, and the first reinforcing metal fitting 51 attached to the first housing 11, the first connector 1 being attachable to the surface of the first substrate 98; the pair of parallel first walls 91A extending in the longitudinal direction of the first housing 11; the pair of parallel second walls 91B extending in the width direction of the first housing 11, the pair of parallel second walls 91B being connected to both the ends of the pair of parallel first walls 91A; and the protective member 91 including the accommodation unit 97 in which four sides are defined by the first wall 91A and the second wall 91B, the protective member 91 being attachable to the surface of the first substrate 98 while the first connector 1 is accommodated in the accommodation unit 97, and the protective member 91 can be coupled to the first connector 1 and placed on the surface of the first substrate 98 while the first connector 1 is accommodated in the accommodation unit 97.

Consequently, although the connector assembly has a simple configuration, the connector assembly can be easily and certainly attached to the surface of the first substrate 98, and the high airtightness or watertightness can be certainly maintained to improve reliability.

Furthermore, the protective member 91 includes the protective housing 92 made of an insulating material and the protective metal fitting 93 made of conductive metal integrally formed with the protective housing 92. Thus, the strength of the protective member 91 is improved and the protective metal fitting 93 functions as the electromagnetic shield, so that the shielding properties of the first connector 1 and the second connector 101 are improved.

Furthermore, the connector assembly further includes the interposing member 81 interposed between the first connector 1 and the protective member 91, and the interposing member 81 can couple the first connector 1 and the protective member 91 together while maintaining the positional relationship between the first connector 1 and the protective member 91 constant. Furthermore, the interposing member 81 includes the interposing body 82 and the protective member holding arm 83 and the connector holding arm 84, which extend from the interposing body 82, the protective member holding arm 83 includes the engagement protrusion 83*a* engaging with the protective member 91, and the connector holding arm 84 includes the holding protrusion 84*a* holding the first reinforcing metal fitting 51. Furthermore, the connector pair includes the connector assembly and the second connector 101 fitted in the first connector 1. Furthermore, the second connector 101 can be fitted in the first connector 1 while the first connector 1 and the protective member 91 are fixed to the surface of the first substrate 98 after coupled together and placed on the surface of the first substrate 98.

Additionally, even when the potting is not performed, a sufficient dust-proof effect should be obtained because the gap between the protective member 91 and the surfaces of the first substrate 98 and the second substrate 198 is small.

Next, Embodiment 2 will be described. Note that, for those having the same structure as that of Embodiment 1, descriptions thereof are omitted by giving the same reference numerals thereto. Moreover, descriptions of the same operations and effects as those of Embodiment 1 will be omitted.

Figure 11:
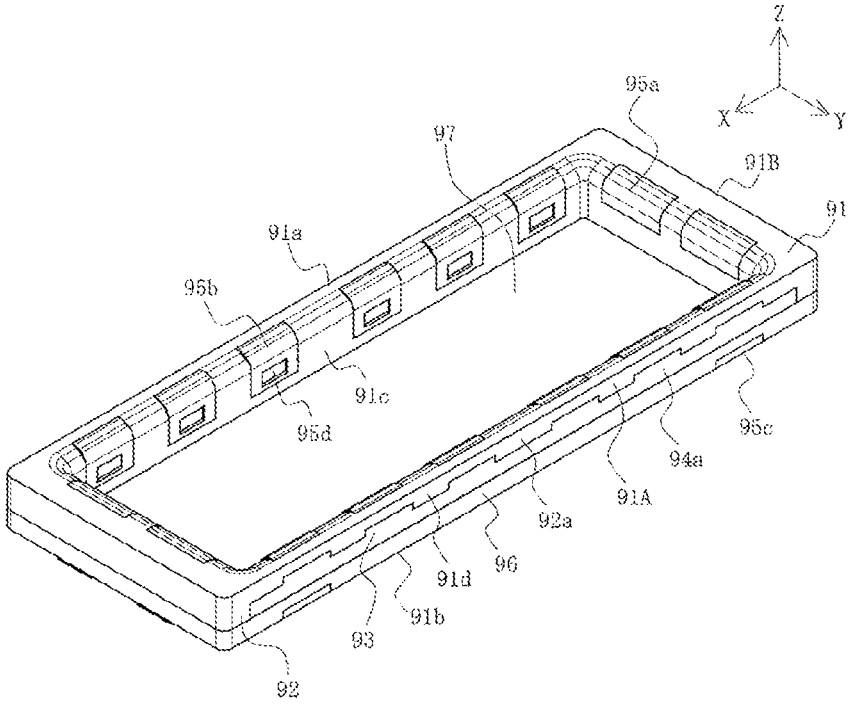
FIG. 11 is a perspective view illustrating a protective member according to Embodiment 2.
Figure 12:
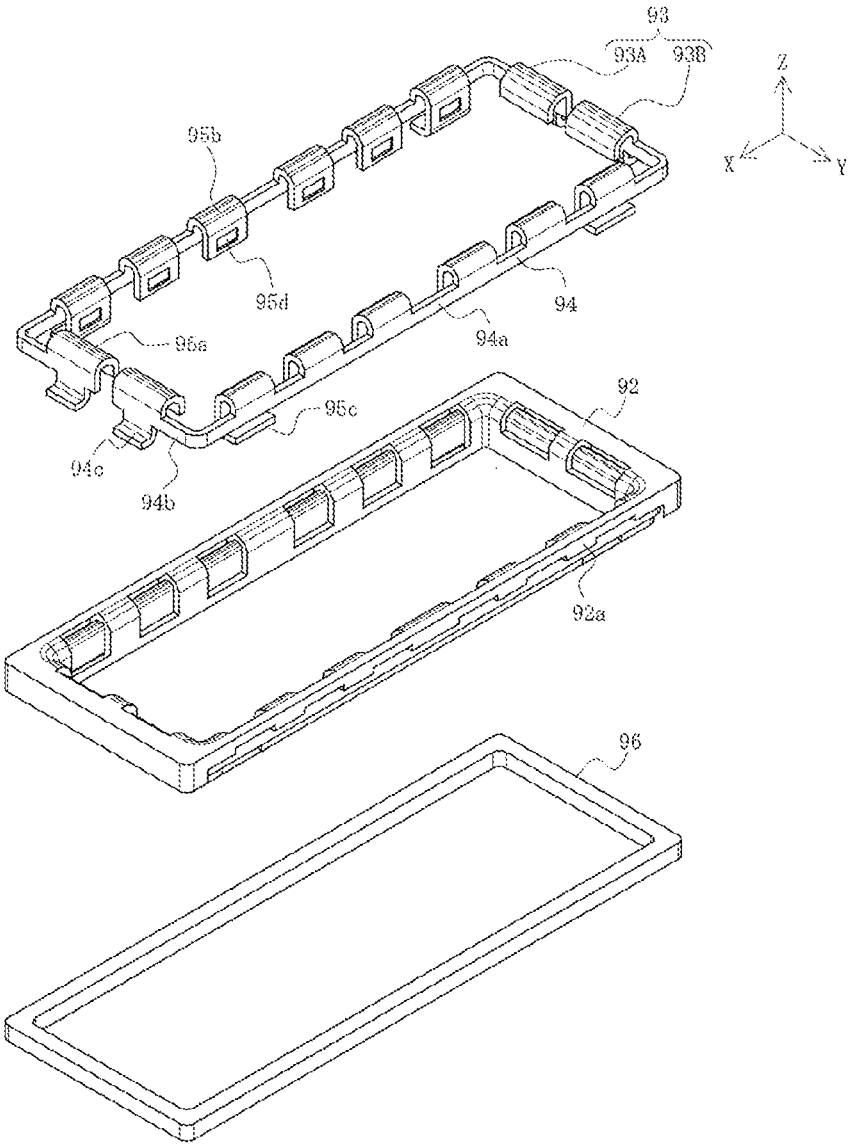
FIG. 12 is an exploded view illustrating the protective member of Embodiment 2.
Figures 13A, 13B, 13C, 13D:
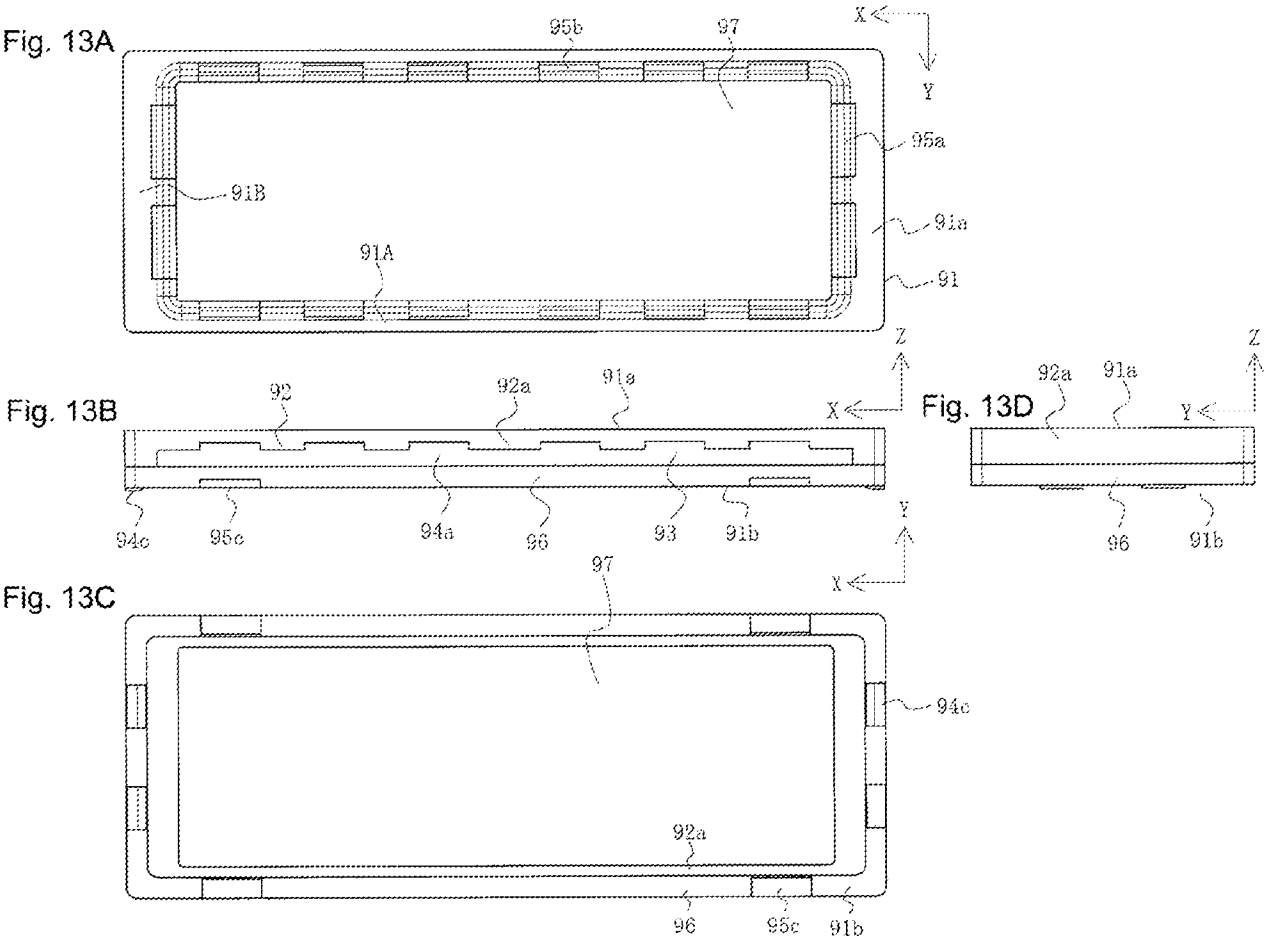
FIGS. 13A-13D are four-plane drawings illustrating the protective member of Embodiment 2.
Figure 14:
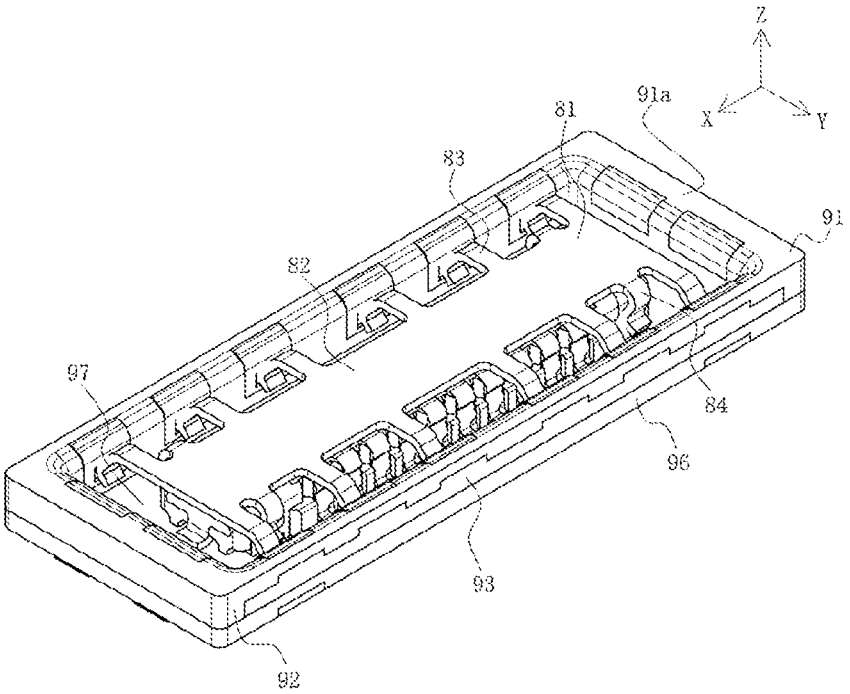
FIG. 14 is a perspective view illustrating a state in which the protective member is temporarily held by the first connector in Embodiment 2.
Figure 15:
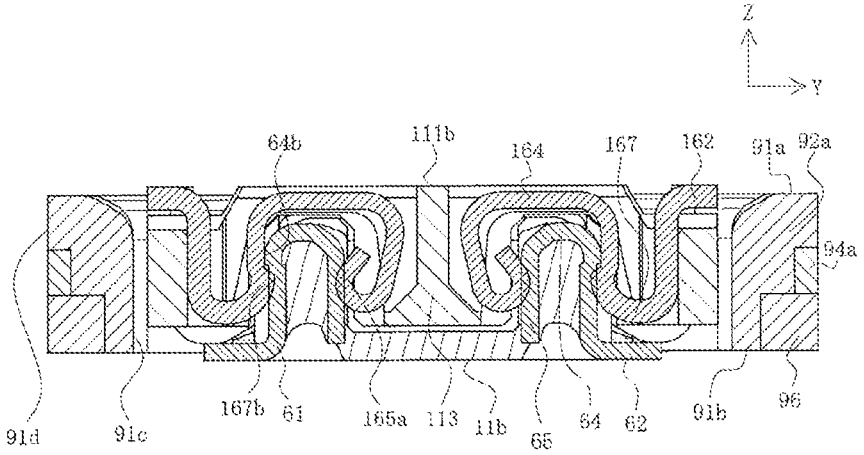
FIG. 15 is a sectional view of the first connector and the second connector fitted together in Embodiment 2, and is a sectional view illustrating the same portion as FIG. 2.

FIG. 11 is a perspective view illustrating a protective member according to Embodiment 2, FIG. 12 is an exploded view illustrating the protective member of Embodiment 2, FIGS. 13A-13D are four-plane drawings illustrating the protective member of Embodiment 2, FIG. 14 is a perspective view illustrating a state in which the protective member is temporarily held by the first connector in Embodiment 2, and FIG. 15 is a sectional view of the first connector and the second connector fitted together in Embodiment 2 and is a sectional view illustrating the same portion as FIG. 2. FIG. 13A is a top view, FIG. 13B is a side view, FIG. 13C is a bottom surface view, and FIG. 13D is a rear surface view.

In Embodiment 2, the protective member 91 includes a hot-melt unit 96 in a part of the protective housing 92 as the protective member body integrally made of an insulating material such as a synthetic resin. For example, the hot-melt unit 96 is a portion made of a hot-melt material similar to a material referred to as a hot-melt adhesive made of a thermoplastic resin such as ethylene vinyl acetate, polyester, polyamide, or polyolefin. The hot-melt unit 96 melts to exert an adhesive property when being heated to about 80° C. to about 200° C. More preferably, the hot-melt material that melts to exert the adhesive property when being heated to 150° C. to 200° C. In forming the protective member 91 by a resin molding method such as two-color molding, a difference between a temperature of a molding die and a melting temperature of the hot-melt material during formation of the hot-melt unit 96 can be increased using the hot-melt material, and the manufacturability of the protective member 91 and performance such as post-molding dimensional accuracy and a handling property can be improved. The portion of the protective housing 92 other than the hot-melt unit 96 is a non-hot-melt unit 92*a* made of a material, such as a liquid crystal polymer, which has a higher melting temperature. The protective member 91 is a member in which the non-hot-melt unit 92*a* and the hot-melt unit 96 are integrally formed by a resin molding method such as what is called two-color molding.

In the example illustrated in the drawings, the hot-melt unit 96 is disposed on the outer peripheral side at the lower end (the end in the negative Z-axis direction) of the protective housing 92, and exposed to the first substrate side surface 91*b* and the outside surface 91*d* of the protective member 91. That is, the hot-melt unit 96 is formed so as to continuously surround the lower end (the side end of the first substrate side surface 91*b*) of the outside surface 91*d* of the protective member 91.

In Embodiment 2, the hot-melt material constituting the hot-melt unit 96 melts together with the solder when the solder reflow treatment, which is heating treatment, is performed in mounting the first connector 1 and the protective member 91 integrated with each other by the interposing member 81 on the surface of the first substrate 98 by a normal surface mounting technique. The melted hot-melt material blocks the gap between the first substrate side surface 91*b* of the protective member 91 and the surface of the first substrate 98, covers the lower end of the outside surface 91*d* of the protective member 91 and the surface of the first substrate 98 near the lower end of the outside surface 91*d* of the protective member 91, and solidifies and adheres with decreasing temperature. Consequently, the airtightness or the watertightness is maintained to the environment of the surface of the first substrate 98 on the outside of the protective member 91 in the accommodation unit 97 of the protective member 91 attached to the surface of the first substrate 98. Potting is not required.

Note that configurations and operations of other components such as the first connector 1, the second connector 101, the protective member 91, and interposing member 81 of Embodiment 2 are the same as those of Embodiment 1, and the description thereof will be omitted.

As described above, in Embodiment 2, the protective member 91 includes the first substrate side surface 91*b* opposed to the surface of the first substrate 98 and the hot-melt unit 96 made of a hot-melt material, at least a portion of the hot-melt unit 96 being exposed to the first substrate side surface 91*b*. Consequently, the hot-melt material melts to block the gap between the first substrate side surface 91*b* of the protective member 91 and the surface of the first substrate 98 by the heating treatment in mounting the first connector 1 and the protective member 91 on the surface of the first substrate 98, so that the airtightness or the watertightness is maintained to the environment of the surface of the first substrate 98 on the outside of the protective member 91 in the accommodation unit 97 of the protective member 91 attached to the surface of the first substrate 98.

Even when the hot-melt unit 96 is not used and even when the potting is not performed, a sufficient dust-proof effect should be obtained because the gap between the protective member 91 and the surfaces of the first substrate 98 and the second substrate 198 is small.

Embodiment 3 will be described below. Note that, for those having the same structure as those of Embodiments 1 and 2, descriptions thereof are omitted by giving the same reference numerals thereto. Moreover, descriptions of the same operations and effects as those of Embodiments 1 and 2 will be omitted.

Figure 16A:
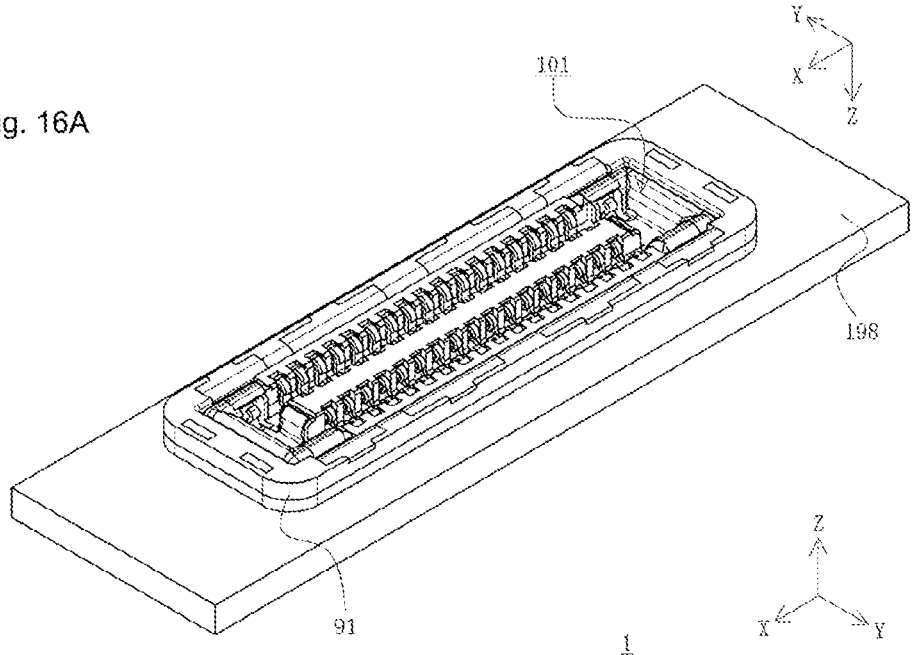
FIGS. 16A and 16B are perspective views illustrating a first connector and a second connector mounted on substrates in Embodiment 3.
Figure 16B:
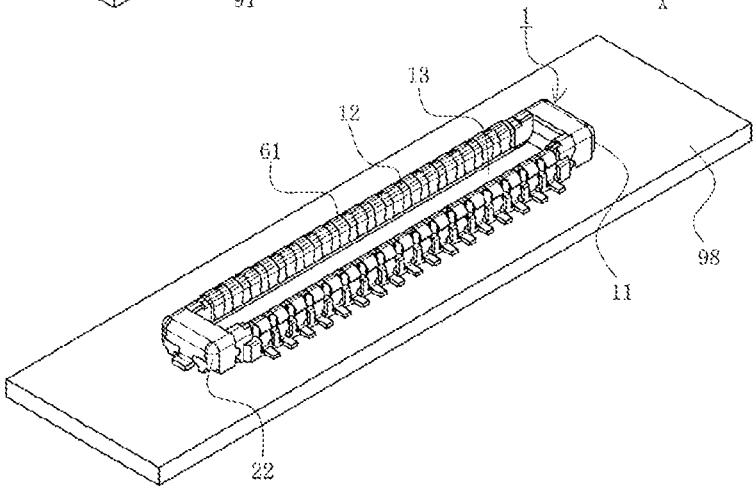
Figure 17:
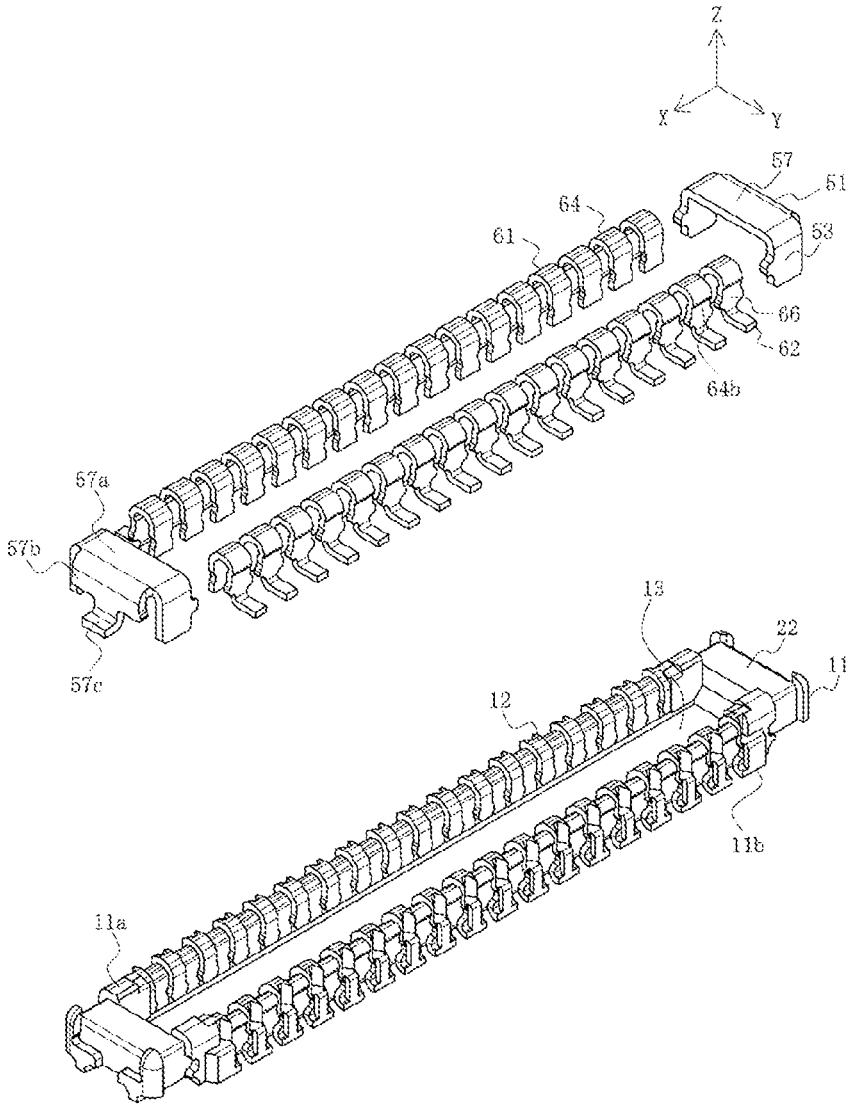
FIG. 17 is an exploded view illustrating the first connector of Embodiment 3.
Figure 18:
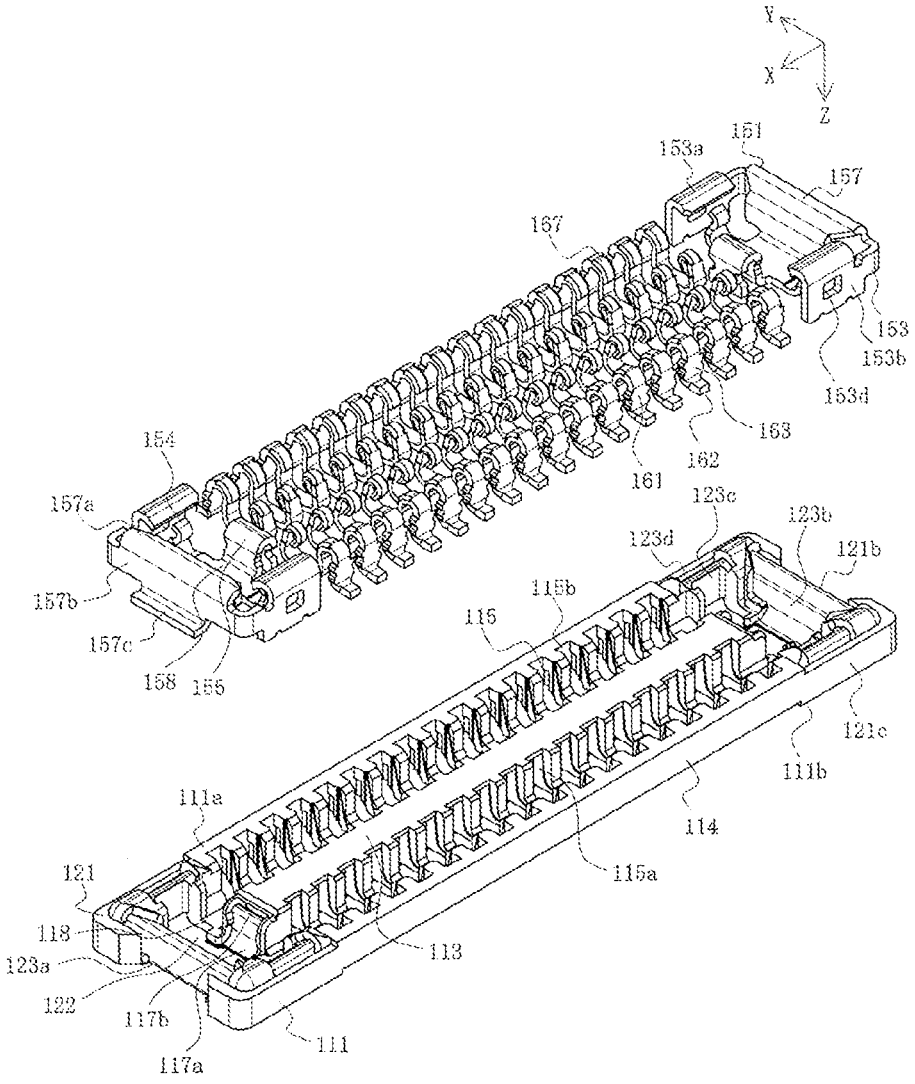
FIG. 18 is an exploded view illustrating the second connector of Embodiment 3.
Figure 19A:
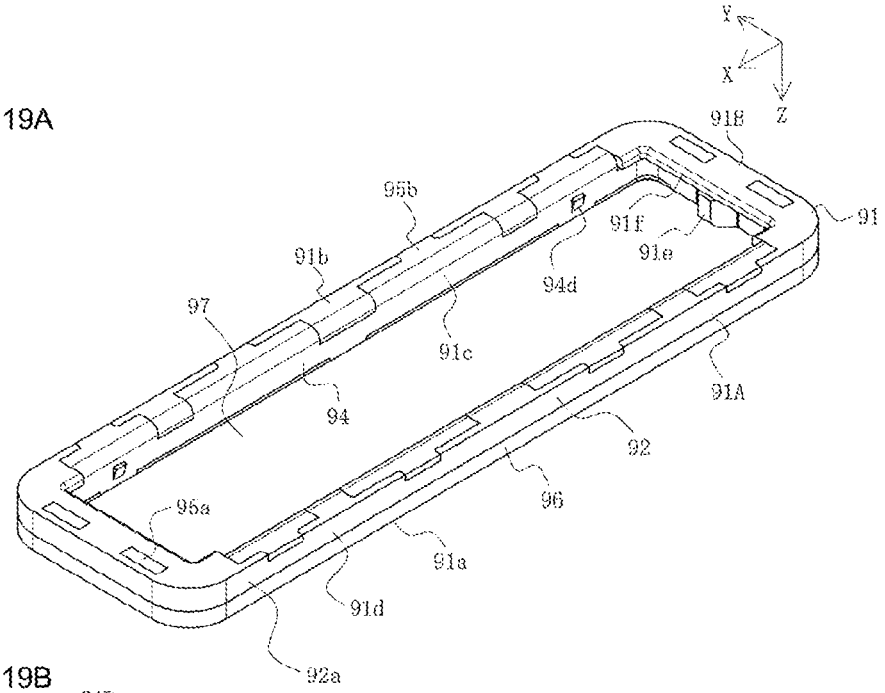
FIGS. 19A and 19B are perspective views illustrating the protective member of Embodiment 3.
Figure 19B:
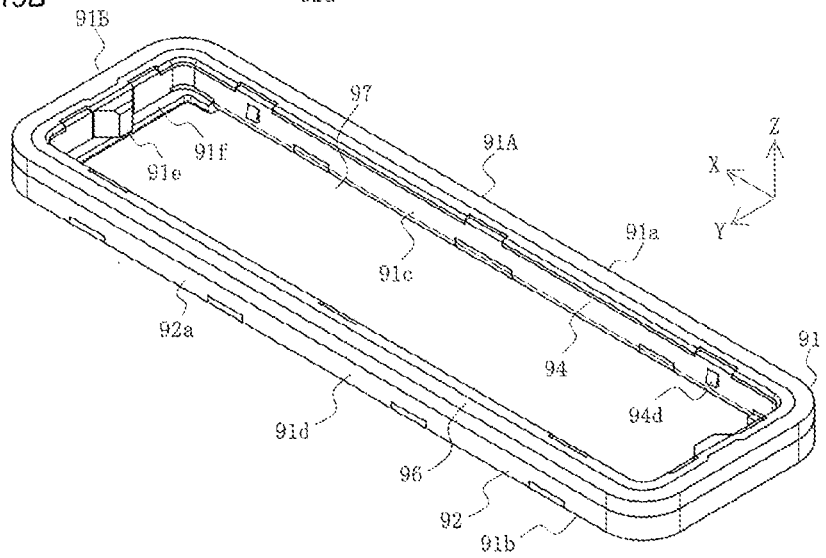
Figure 20:
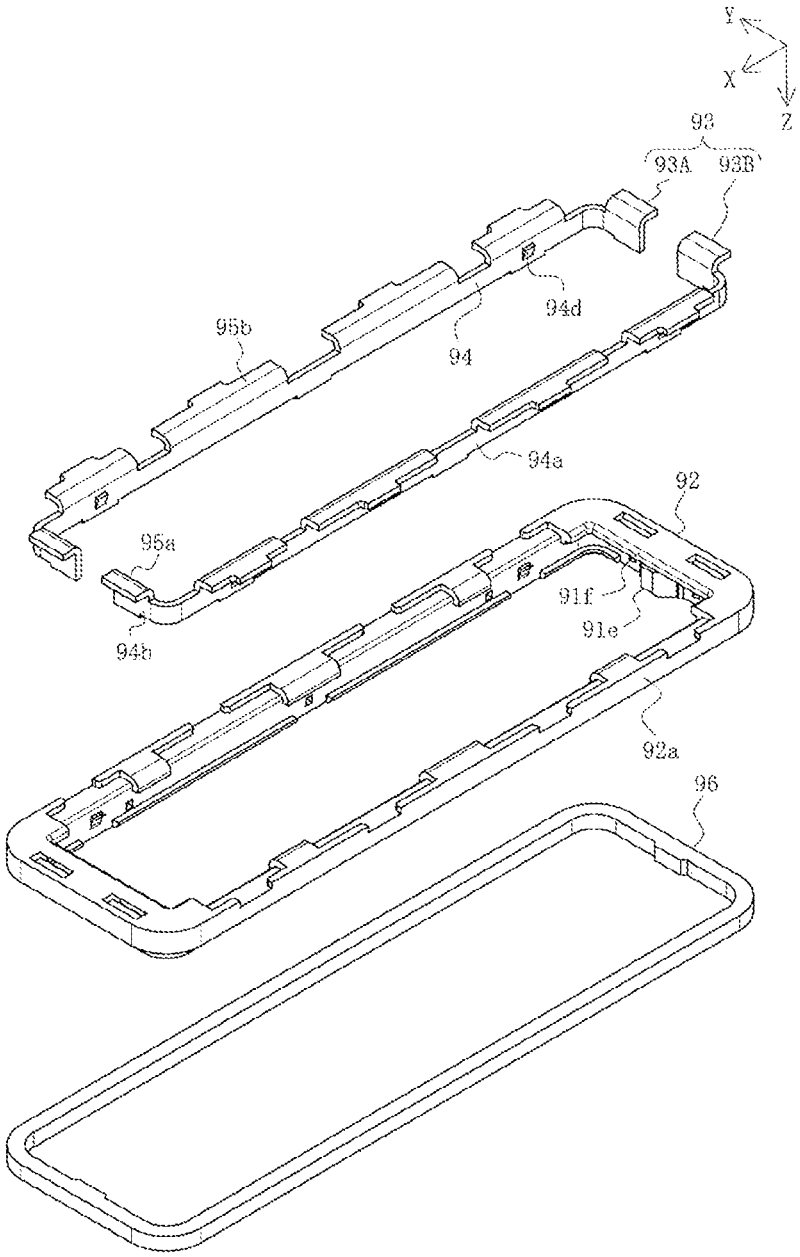
FIG. 20 is an exploded view illustrating the protective member of Embodiment 3.
Figure 21A:
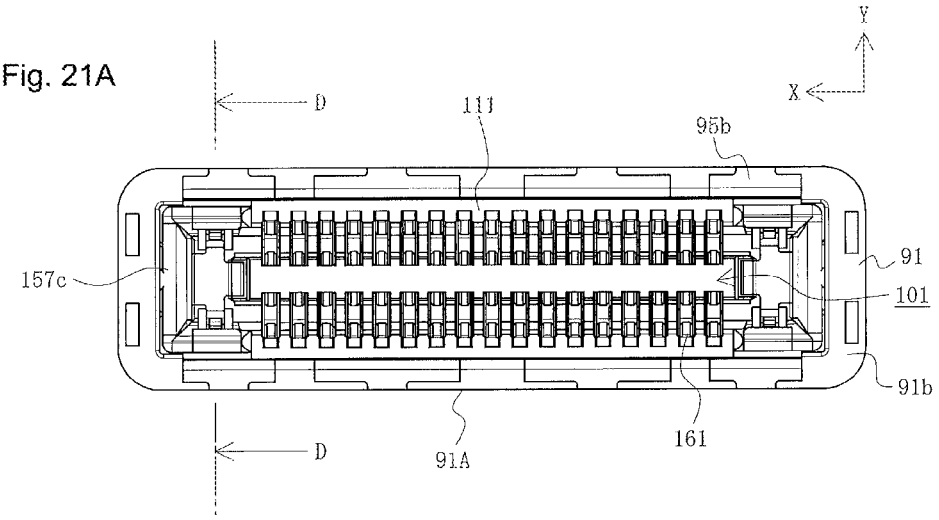
FIGS. 21A and 21B are two-plane drawings illustrating a state in which the protective member is temporarily held by the second connector in Embodiment 3.
Figure 21B:
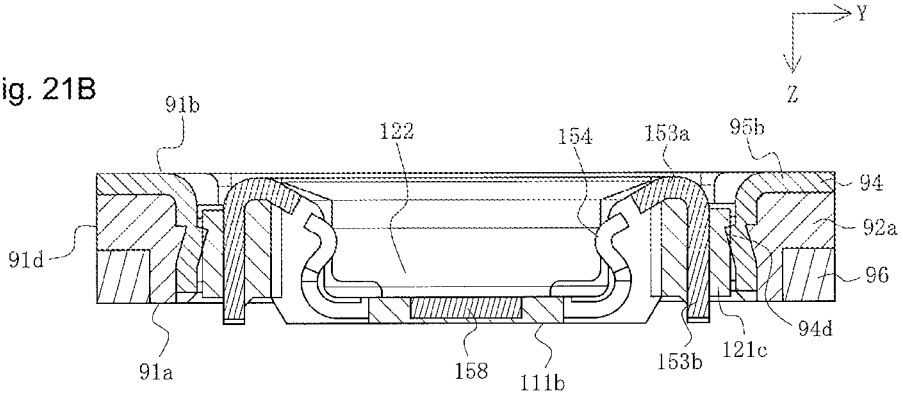

FIGS. 16A and 16B are perspective views illustrating a first connector and a second connector mounted on substrates in Embodiment 3, FIG. 17 is an exploded view illustrating the first connector of Embodiment 3, FIG. 18 is an exploded view illustrating the second connector of Embodiment 3, FIGS. 19A and 19B are perspective views illustrating the protective member of Embodiment 3, FIG. 20 is an exploded view illustrating the protective member of Embodiment 3, and FIGS. 21A and 21B are two-plane drawings illustrating a state in which the protective member is temporarily held by the second connector in Embodiment 3. FIG. 16A is a view illustrating the second connector mounted on the substrate, FIG. 16B is a view illustrating the first connector mounted on the substrate. FIG. 19A is a view illustrating the protective member seen obliquely from above, and FIG. 19B is a view illustrating the protective member seen obliquely from below. FIG. 21A is a top view, and FIG. 21B is a sectional view taken along a line D-D in FIG. 21A.

The connector assembly of Embodiments 1 and 2 includes the first connector 1 and the protective member 91, whereas the connector assembly of Embodiment 3 includes the second connector 101 and the protective member 91.

In Embodiments 1 and 2, an example has been described in which the protective member 91 is temporarily coupled to the first connector 1 by the interposing member 81 and is attached to the surface of the first substrate 98 together with the first connector 1. In contrast, in Embodiment 3, the protective member 91 is coupled to the second connector 101 without interposing the interposing member 81, and attached to the surface of the second substrate 198 together with the second connector 101.

In Embodiment 3, similarly to Embodiment 2, the protective member 91 includes the hot-melt unit 96 in a part of the protective housing 92 as the protective member body integrally made of an insulating material such as a synthetic resin. The hot-melt unit 96 is a portion made of the hot-melt material, and melts to exert the adhesive property when heated to about 80° C. to about 200° C., a portion other than the hot-melt unit 96 in the protective housing 92 is the non-hot-melt unit 92*a* having a higher melting temperature, and the protective member 91 is a member in which the non-hot-melt unit 92*a* and the hot-melt unit 96 are integrally formed by a resin molding method such as what is called two-color molding. More preferably, the hot-melt material that melts to exert the adhesive property when being heated to 150° C. to 200° C. In forming the protective member 91 by a resin molding method such as two-color molding, a difference between a temperature of a molding die and a melting temperature of the hot-melt material during formation of the hot-melt unit 96 can be increased using the hot-melt material, and the manufacturability of the protective member 91 and performance such as post-molding dimensional accuracy and a handling property can be improved.

In Embodiment 2, the hot-melt unit 96 is disposed on the outer peripheral side at the side end (the end in the negative Z-axis direction) of the first substrate side surface 91*b* in the protective housing 92, exposed to the first substrate side surface 91*b* and the outside surface 91*d* in the protective member 91, and formed so as to continuously surround the side end of the first substrate side surface 91*b* of the outside surface 91*d* in the protective member 91. In contrast, the hot-melt unit 96 of Embodiment 3 is disposed on the outer peripheral side at the side end (the end in the positive Z-axis direction) of the second substrate side surface 91*a* in the protective housing 92, exposed to the second substrate side surface 91*a* and the outside surface 91*d* in the protective member 91, and formed so as to continuously surround the side end of the second substrate side surface 91*a* of the outside surface 91*d* in the protective member 91. In Embodiment 3, the protective member 91 is mounted on the surface of the second substrate 198 together with the second connector 101, so that the second substrate side surface 91*a* can be referred to as a mounting substrate side surface, and the first substrate side surface 91*b* can be referred to as an opposing substrate side surface.

An end wall protrusion 91*e* protruding toward the center in the longitudinal direction (X-axis direction) of the protective member 91 and an end wall eaves 91*f* are provided on the inside surface 91*c* of the second wall 91B of the protective member 91. The end wall protrusion 91*e* is a protrusion portion integrally formed with the non-hot-melt unit 92*a* of the protective housing 92, and the tip of the end wall protrusion 91*e* elastically abuts on an outer end face of the second protrusion end 121 of the second connector 101, and more specifically, the outer surface of the end wall outer cover 157*b*.

A protrusion 94*d* protruding toward the center in the width direction (Y-axis direction) of the protective member 91 is formed on the first belt frame 94*a* of the belt frame 94. The protrusion 94*d* is a cut-and-raised piece formed so as to extend obliquely upward (the direction of the first substrate side surface 91*b*, the negative Z-axis direction) from the first belt frame 94*a*, and protrudes from the inside surface 91*c* of the first wall 91A of the protective member 91 toward the center in the width direction of the protective member 91, and the tip of the protrusion 94*d* bites into and engages with the outer surface of the sidewall of the second protrusion end 121 of the second connector 101, namely, the outer surface of the sidewall extension 121*c*.

As described above, because the interposing member 81 is not used in Embodiment 3, the shape of each unit of the protective metal fitting 93 is also partially different from that of Embodiments 1 and 2. First, in Embodiments 1 and 2, the first wall engaging unit 95*b* and the second wall engaging unit 95*a* are connected to the side end (the end in the positive Z-axis direction) of the second substrate side surface 91*a* in the belt frame 94. In contrast, in Embodiment 3, the first wall engaging unit 95*b* and the second wall engaging unit 95*a* are connected to the side end (the end in the negative Z-axis direction) of the first substrate side surface 91*b* in the belt frame 94. In Embodiments 1 and 2, the first wall engaging unit 95*b* and the second wall engaging unit 95*a* have the shape that is curved by about 180 degrees so as to swell in the direction (positive Z-axis direction) on the side of the first substrate side surface 91*b*. In contrast, in Embodiment 3, the first wall engaging unit 95*b* and the second wall engaging unit 95*a* have a shape that is curved by about 90 degrees such that the tips of the first wall engaging unit 95*b* and the second wall engaging unit 95*a* are oriented outward in the width direction (Y-axis direction) and outward in the longitudinal direction (X-axis direction) of the protective member 91. Furthermore, the first wall extension 95*c*, the second wall tail 94*c*, and the engagement recess 95*d*, which exist in Embodiments 1 and 2, are omitted in Embodiment 3.

In Embodiment 3, as illustrated in FIGS. 21A and 21B, the second connector 101 and the protective member 91 can be temporarily coupled and held with no use of the interposing member 81. That is, the second connector 101 and the protective member 91 can be integrally temporarily held with no use of the interposing member 81. Preferably, after the mounting surface 111*b* of the second housing 111 of the second connector 101 and the first substrate side surface 91*b* of the protective member 91 are opposed to each other, the second connector 101 and/or the protective member 91 is moved in the direction approaching the opposing side, and the second connector 101 is inserted into the accommodation unit 97 of the protective member 91 from the side of the first substrate side surface 91*b*. Consequently, the tips of the protrusions 94*d* extending toward the direction of the first substrate side surface 91*b* bite into and engage with the outer surfaces of the sidewall extensions 121*c* on both the left and right sides of the second protrusion end 121 of the second connector 101, so that the second connector 101 and the protective member 91 are coupled together. For the longitudinal direction (X-axis direction) of the second connector 101 and the protective member 91, the tip of the end wall protrusion 91*e* elastically abuts on the outer surface of the end wall outer cover 157*b* in the second protrusion end 121 of the second connector 101, so that the positional relationship between the second connector 101 and the protective member 91 is maintained constant.

The second connector 101 and the protective member 91 that are coupled and integrated in this manner can be held by the finger of the operator or the conveyance manipulator, whereby the second connector 101 and the protective member 91 are carried to predetermined positions on the surface of the second substrate 198 while the condition is maintained. The second connector 101 and the protective member 91 are mounted at predetermined positions on the surface of the second substrate 198 by a normal surface mounting technique. At this point, when the solder reflow treatment is performed, the hot-melt material constituting the hot-melt unit 96 melts together with the solder. The melted hot-melt material blocks the gap between the second substrate side surface 91*a* of the protective member 91 and the surface of the second substrate 198, covers the side end of the second substrate 91*a* of the outside surface 91*d* in the protective member 91 and the surface of the second substrate 198 near the side end of the second substrate side surface 91*a* of the outside surface 91*d* in the protective member 91, and solidifies and adheres with decreasing temperature. Consequently, the airtightness or the watertightness is maintained to the environment of the surface of the second substrate 198 on the outside of the protective member 91 in the accommodation unit 97 of the protective member 91 mounted on the surface of the second substrate 198. Potting is not required.

Subsequently, the first connector 1 and the second connector 101 are fitted together. In this case, the tail 62 of the first terminal 61, the lower end of the side cover 53 of the first reinforcing metal fitting 51, and the tail 57*c* of the center cover 57 of the first reinforcing metal fitting 51 are soldered to the connection pad formed on the surface of the first substrate 92, and the first connector 1 is surface-mounted on the first substrate 98 as illustrated in FIG. 16B. Desirably an adhesive is applied to the surface of the first substrate 98 around the first connector 1. Specifically, an adhesive made of a UV curable, two-pack curable, moisture curable, or thermosetting resin is continuously applied to a portion, which is located around the first connector 1 on the surface of the first substrate 98 and opposed to the first substrate side surface 91*b* of the protective member 91, so as to surround the first connector 1.

Note that other operations to fit the first connector 1 and the second connector 101 together are substantially the same as those of Embodiment 1, and the descriptions thereof will be omitted.

After the first connector 1 and the second connector 101 are fitted together, treatment such as heating, ultraviolet irradiation, and pressure imparting is performed to cure the adhesive between the surface of the first substrate 98 around the first connector 1 and the first substrate side surface 91*b* of the protective member 91. Consequently, the gap is blocked by the adhesive even when the gap exists between the first substrate side surface 91*b* of the protective member 91 and the surface of the first substrate 98, so that the airtightness or the watertightness is maintained to the environment of the surface of the first substrate 98 on the outside of the protective member 91 in the accommodation unit 97 of the protective member 91 opposed to the surface of the first substrate 98.

Note that configurations and operations of other components such as the first connector 1, the second connector 101, and the protective member 91 of Embodiment 3 are the same as those of Embodiments 1 and 2, and the description thereof will be omitted.

As described above, in Embodiment 3, the protective member 91 includes the protrusion 94*d* exposed to the inside surface 91*c* of the accommodation unit 97, and the second connector 101 and the protective member 91 can be coupled together by engaging the protrusion 94*d* with the second housing 111. Consequently, the interposing member 81 can be omitted.

Even when the hot-melt unit 96 is not used and even when the potting is not performed, a sufficient dust-proof effect should be obtained because the gap between the protective member 91 and the surfaces of the first substrate 98 and the second substrate 198 is small.

Embodiment 4 will be described below. Note that, for those having the same structure as that of Embodiments 1 to 3, the descriptions thereof will be omitted by giving the same reference numerals thereto. Moreover, the descriptions of the same operations and effects as those of Embodiments 1 to 3 will be omitted.

Figure 22A:
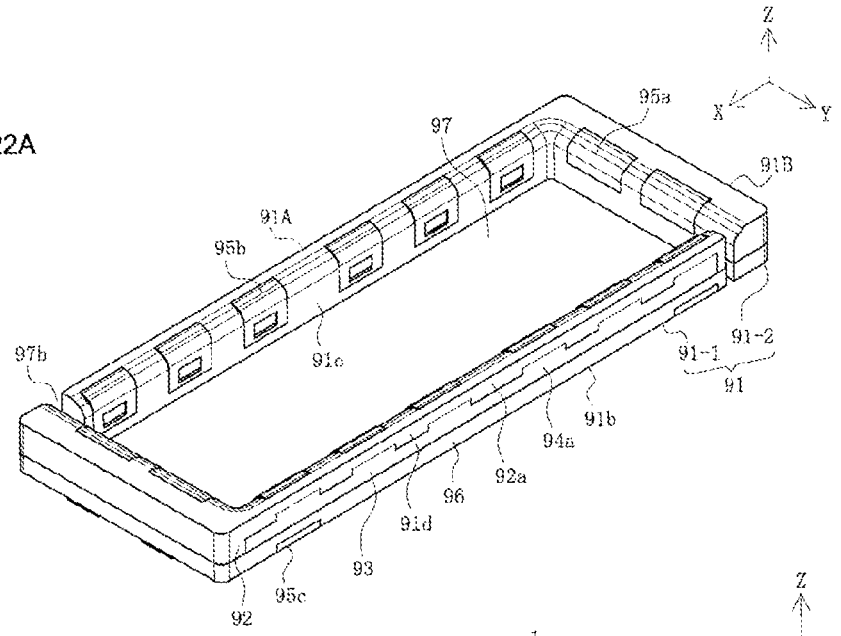
FIGS. 22A and 22B are perspective views illustrating a protective member and a first connector according to Embodiment 4.
Figure 22B:
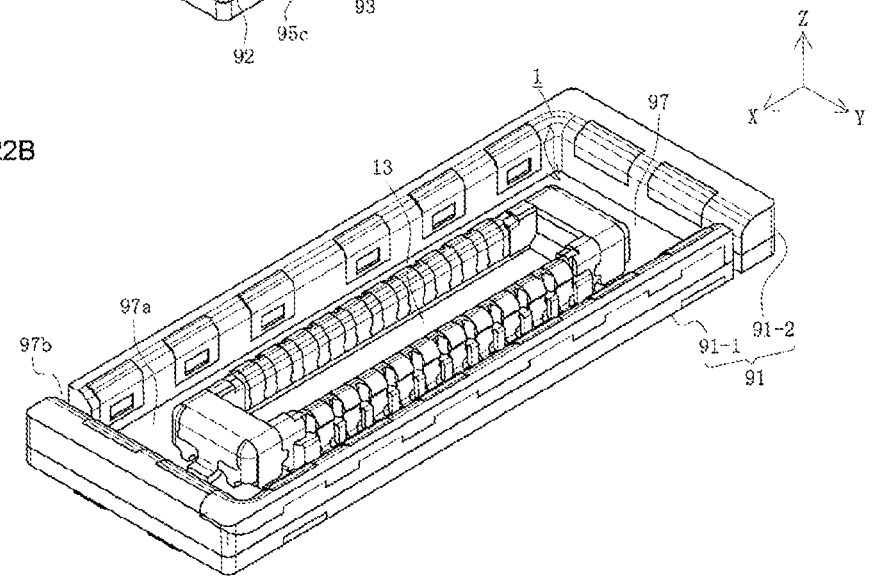
Figure 23:
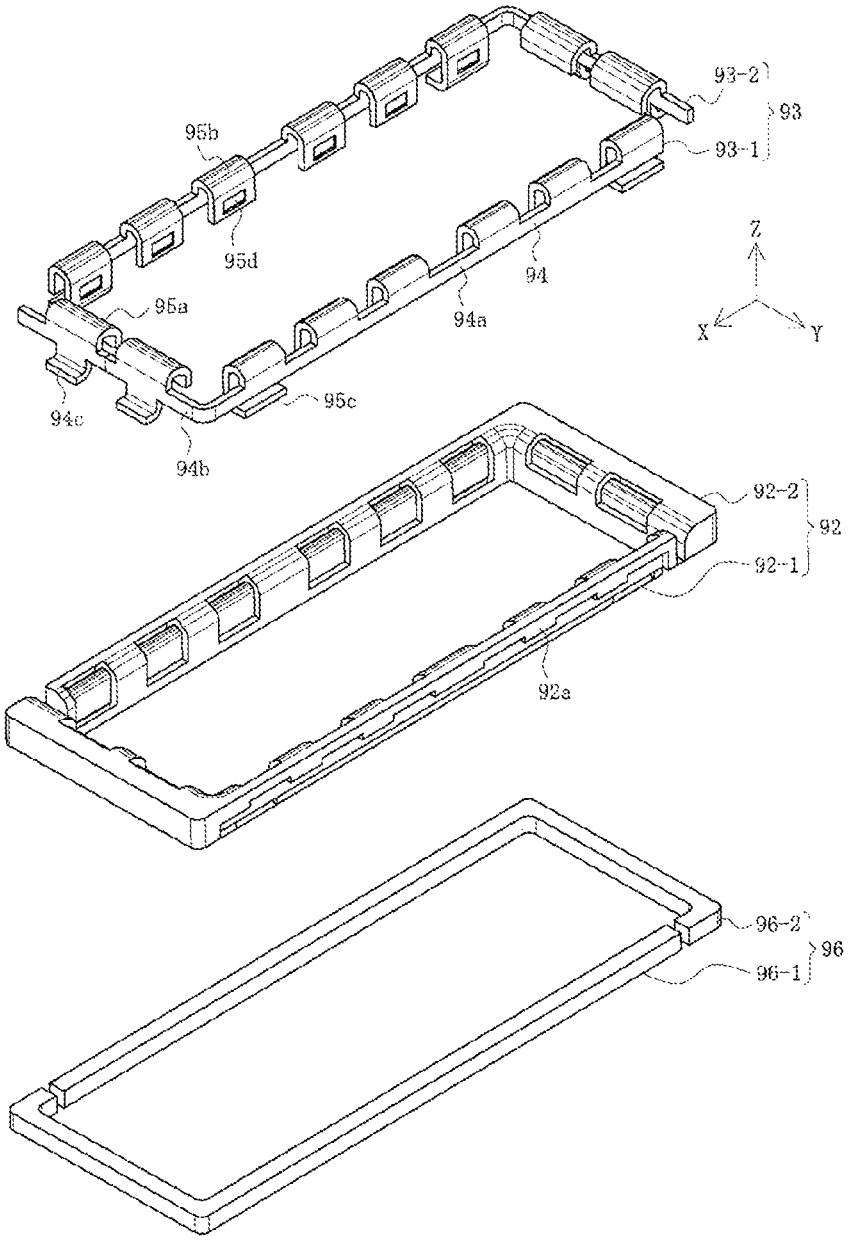
FIG. 23 is an exploded view illustrating the protective member of Embodiment 4.
Figure 24A:
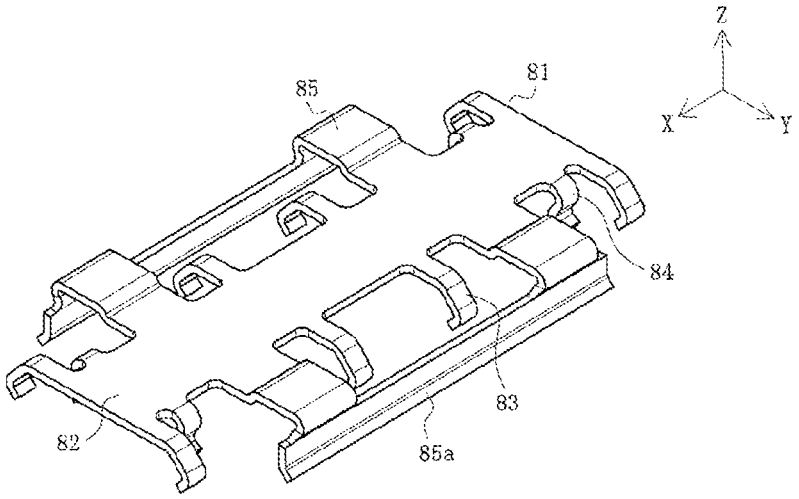
FIGS. 24A and 24B are perspective views illustrating an interposing member of Embodiment 4.
Figure 24B:
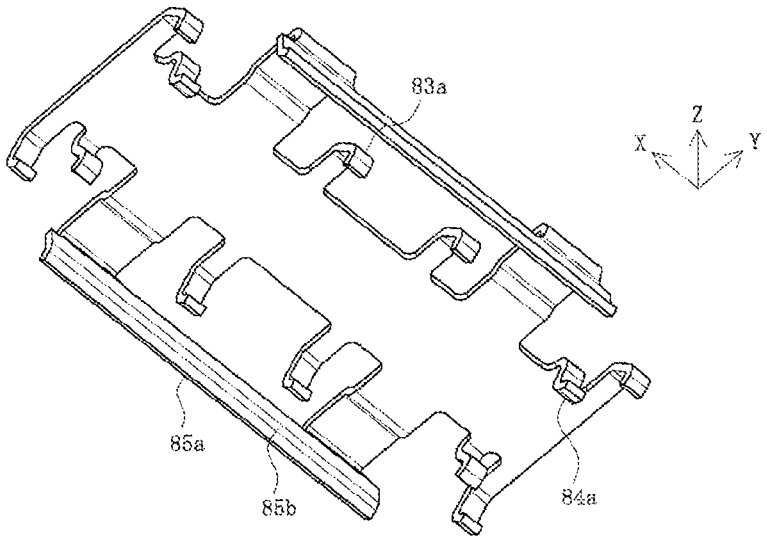
Figure 25:
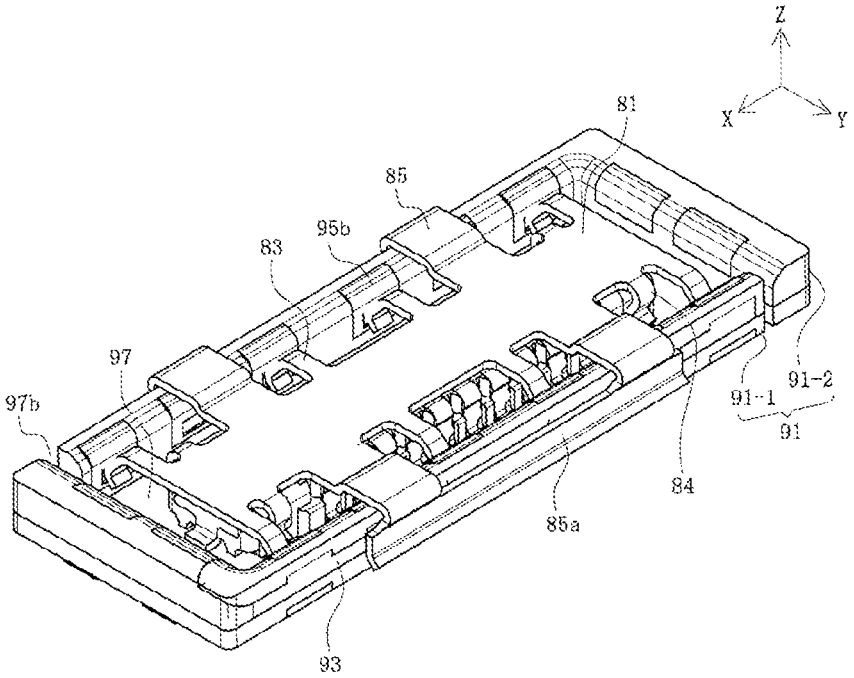
FIG. 25 is a perspective view illustrating a state in which the protective member is temporarily held by the first connector of Embodiment 4.
Figure 26A:
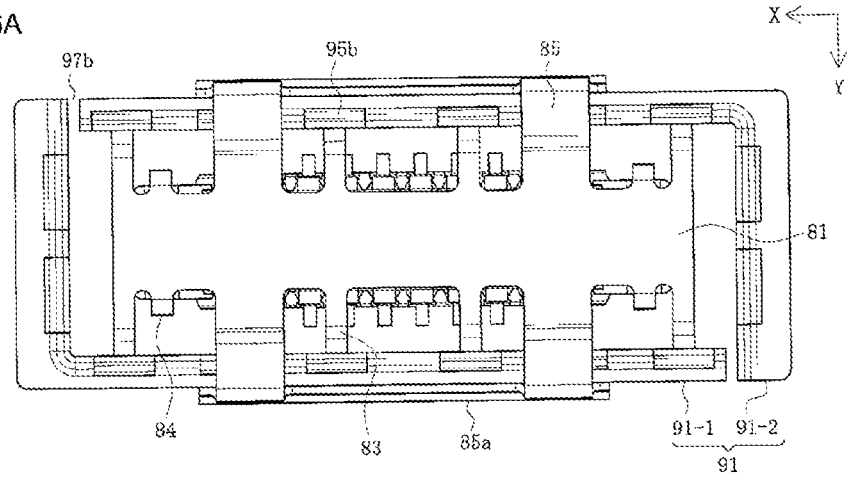
FIGS. 26A and 26B are top views illustrating the positional relationship between the first connector and the protective member of Embodiment 4.
Figure 26B:
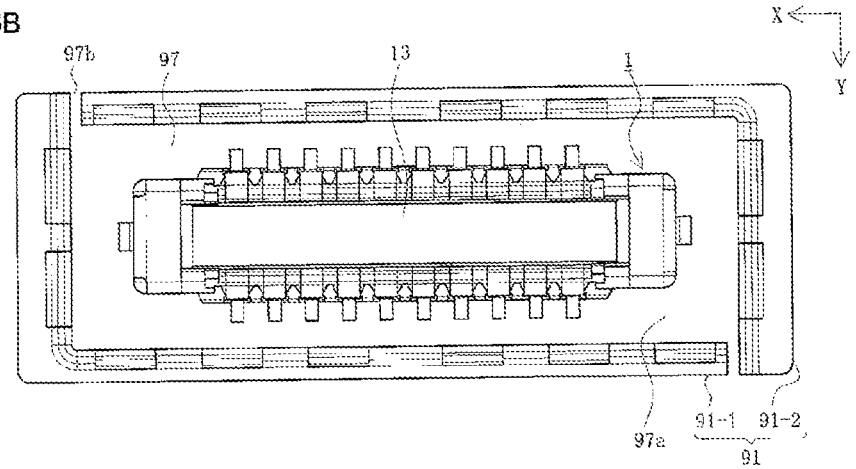

FIGS. 22A and 22B are perspective views illustrating a protective member and a first connector according to Embodiment 4, FIG. 23 is an exploded view illustrating the protective member of Embodiment 4, FIGS. 24A and 24B are perspective views illustrating an interposing member of Embodiment 4, FIG. 25 is a perspective view illustrating a state in which the protective member is temporarily held by the first connector of Embodiment 4, and FIGS. 26A and 26B are top views illustrating the positional relationship between the first connector and the protective member of Embodiment 4. FIG. 22A is a view illustrating only the protective member, and FIG. 22B is a view illustrating a positional relationship between the first connector and the protective member. FIG. 24A is a view illustrating the interposing member seen obliquely from above, and FIG. 24B is a view illustrating the interposing member seen obliquely from below. FIG. 26A is a view illustrating a state in which the protective member is temporarily held by the first connector, and FIG. 26B is a view illustrating a state in which the first connector and the protective member are mounted on the substrate.

In Embodiment 4, the protective member 91 is divided into a pair of left and right halves, namely, a left half body 91-1 and a right half body 91-2, and is an open unit 97*b* in which the protective member 91 does not exist is formed between the left half body 91-1 and the right half body 91-2. Each of the left half body 91-1 and the right half body 91-2 is constructed with the single first wall 91A and the single second wall 91B connected at right angles to one end of the first wall 91A, and has an L-shaped shape in planar view. The left half body 91-1 and the right half body 91-2 are members having the same shape, and thus, so that the left half body 91-1 and the right half body 91-2 will be described as the protective member 91 when collectively described. Similarly, each of the protective housing 92, the protective metal fitting 93, and the hot-melt unit 96 includes a protective housing left half body 92-1 and a protective housing right half body 92-2 corresponding to the left half body 91-1 and the right half body 91-2, a protective metal fitting left half body 93-1 and a protective metal fitting right half body 93-2, and a hot-melt left half body 96-1 and a hot-melt right half body 96-2. The left half body and the right half body of each component have the same shape, so that the left half body and the right half body of each component will be described as the protective housing 92, the protective metal fitting 93, and the hot-melt unit 96 when collectively described. Note that the configurations of other components in the protective member 91 of Embodiment 4 is the same as those of Embodiment 2, and the descriptions thereof will be omitted.

In Embodiment 4, the protective member 91 does not necessarily include the hot-melt unit 96, and may not include the hot-melt unit 96 similarly to the protective member 91 of Embodiment 1.

The interposing member 81 of Embodiment 4 includes a protective member outside holding arm 85 holding the first wall 91A of the protective member 91 from the outside, and the protective member holding arm 83 functions as a protective member inside holding arm holding the first wall 91A from the inside. As illustrated in FIGS. 24A and 24B, the protective member outside holding arm 85 is formed on at least a pair of left and right side portions so as to extend outward in the width direction from the left and right side end edge of the interposing body 82. A belt-shaped engagement member 85*a* extending in the longitudinal direction is connected to the tips of the left and right protective member outside holding arms 85, and an engagement protrusion 85*b* is formed on the engagement member 85*a* as an engagement unit protruding inward in the width direction. Note that the configurations of other components in the interposing member 81 of Embodiment 4 are substantially the same as those of Embodiment 1, and the descriptions thereof will be omitted.

As illustrated in FIG. 25, the engagement protrusion 83*a* of each protective member holding arm 83 engages with the engagement recess 95*d* of each first wall engaging unit 95*b* exposed to the inside surface 91*c* of the first wall 91A of the protective member 91, and the engagement protrusion 85*b* of each engagement member 85*a* abuts on the first belt frame 94*a* exposed to the outside face 91*d* of the first wall 91A of the protective member 91, and therefore the first wall 91A is sandwiched between the inside and the outside, so that the interposing member 81 can certainly hold the protective member 91.

In Embodiment 4, potting is preferably performed for the purpose of waterproofing after the first connector 1 and the protective member 91 are mounted on and fixed to the surface of the first substrate 98. The potting agent applied to the surface of the first substrate 98 in the liquid state flows through the open unit 97*b*, so that the potting agent spreads across a wide range of surfaces of the first substrate 98 on the inside and the outside of the protective member 91. Consequently, the surface of the first substrate 98 on the inside and the outside of the protective member 91 is certainly covered with the potting agent, so that the airtightness or the watertightness is maintained to a considerable degree to the environment of the surface of the first substrate 98 on the outside of the protective member 91 in the accommodation unit 97 of the protective member 91 attached to the surface of the first substrate 98.

If necessary, after the first connector 1 and the protective member 91 are mounted on and fixed to the surface of the first substrate 98, a tape and a filler can adhere or be applied to a desirable point of the open unit 97*b* or the protective member 91 to easily improve the airtightness or the watertightness.

Note that configurations and operations of other components such as the first connector 1, the second connector 101, the protective member 91, and interposing member 81 of Embodiment 4 are the same as those of Embodiments 1 to 3, and the description thereof will be omitted.

As described above, in Embodiment 4, the connector assembly includes: the first housing 11; the first terminal 61 attached to the first housing 11; the first connector 1 including the first reinforcing metal fitting 51 attached to the first housing 11 and being attachable to the surface of the first substrate 98; and the protective member 91 including the first wall 91A or the second wall 91B extending in the longitudinal or width direction of the first housing 11 and the accommodation unit 97 in which at least a part of the four peripheral sides is defined by the first wall 91A or the second wall 91B, the protective member 91 being attached to the surface of the first substrate 98 with the first connector 1 accommodated in the accommodation unit 97. The protective member 91 includes the protective housing 92 made of an insulating material and the protective metal fitting 93 made of a conductive metal integrally formed with the protective housing 92, and the protective member 91 can be placed on the surface of the first substrate 98 while coupled to the first connector 1 with the first connector 1 accommodated in the accommodation unit 97.

The protective member 91 is constructed with the left half body 91-1 and the right half body 91-2, and each of the left half body 91-1 and the right half body 91-2 includes the first wall 91A extending in the longitudinal direction of the first housing 11 and the second wall 91B extending in the width direction of the first housing 11, one end of second wall 91B being connected to one end of the first wall 91A, and the open unit 97*b* exists between the other end of the first wall 91A and the other end of the second wall 91B of the left half body 91-1 and between the other end of the second wall 91B and the other end of the first wall 91A of the right half body 91-2.

Consequently, although the connector assembly has the simple configuration, the connector assembly can be easily and certainly attached to the surface of the first substrate 98, and the airtightness or the watertightness can be maintained to improve the reliability. Furthermore, the strength of the protective member 91 is improved and the protective metal fitting 93 functions as the electromagnetic shield, so that the shielding properties of the first connector 1 and the second connector 101 are improved.

Even when the hot-melt unit 96 is not used and even when the potting is not performed, a sufficient dust-proof effect should be obtained because the open unit 97*b* or the gap between the protective member 91 and the surfaces of the first substrate 98 and the second substrate 198 is small.

Embodiment 5 will be described below. Note that, for those having the same structure as that of Embodiments 1 and 4, the descriptions thereof will be omitted by giving the same reference numerals thereto. Moreover, the descriptions of the same operations and effects as those of Embodiments 1 to 4 will also be omitted.

Figure 27A:
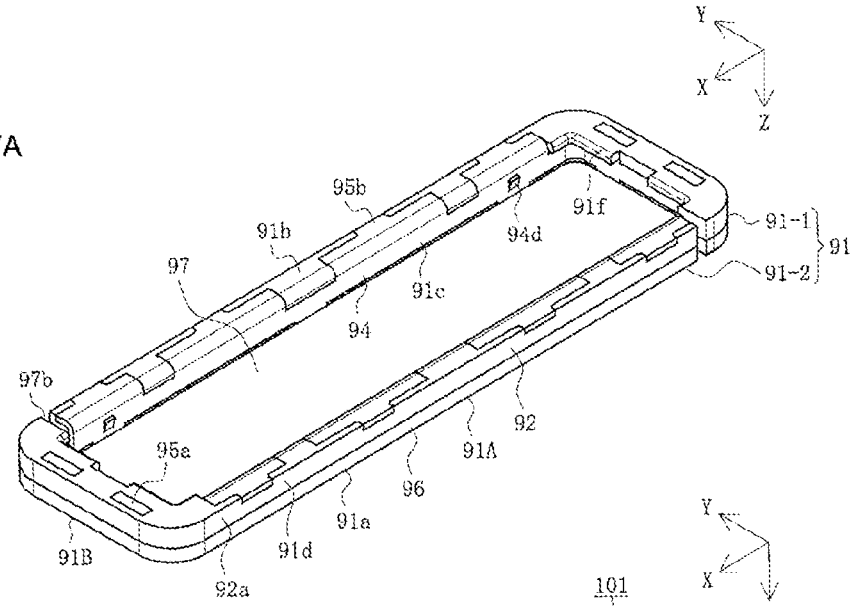
FIGS. 27A and 27B are perspective views illustrating a protective member and a second connector according to Embodiment 5.
Figure 27B:
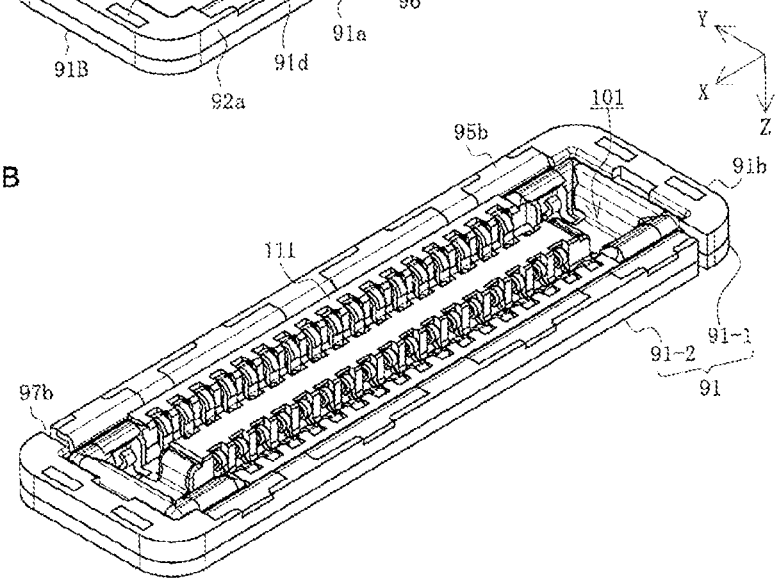
Figure 28:
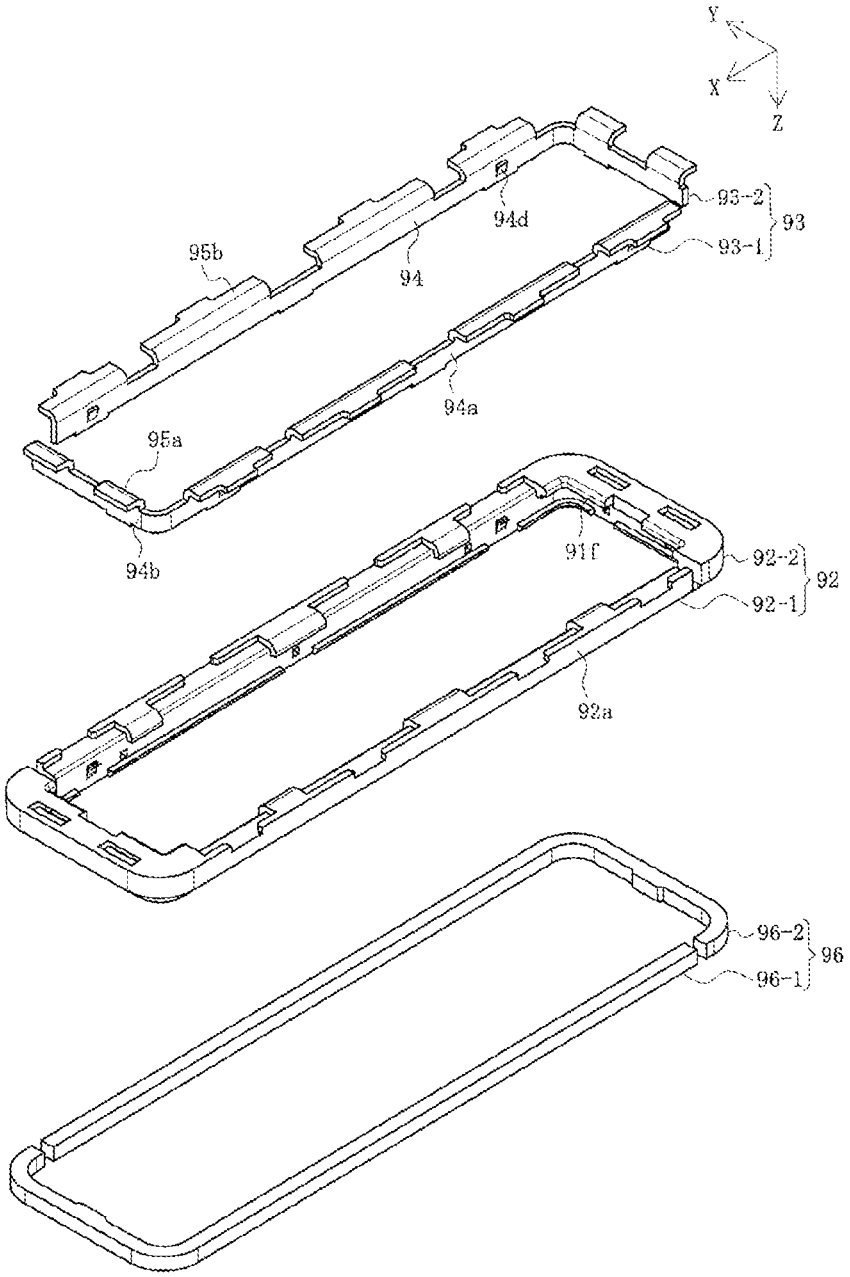
FIG. 28 is an exploded view illustrating the protective member of Embodiment 5.
Figure 29A:
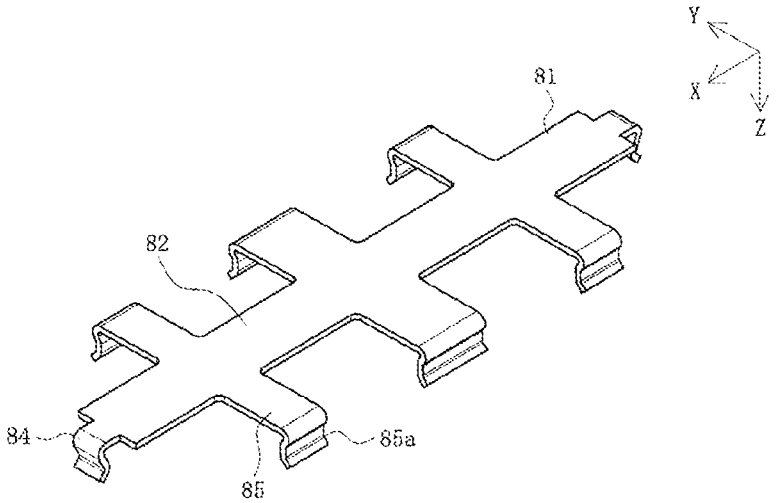
FIGS. 29A and 29B are perspective views illustrating an interposing member of Embodiment 5.
Figure 29B:
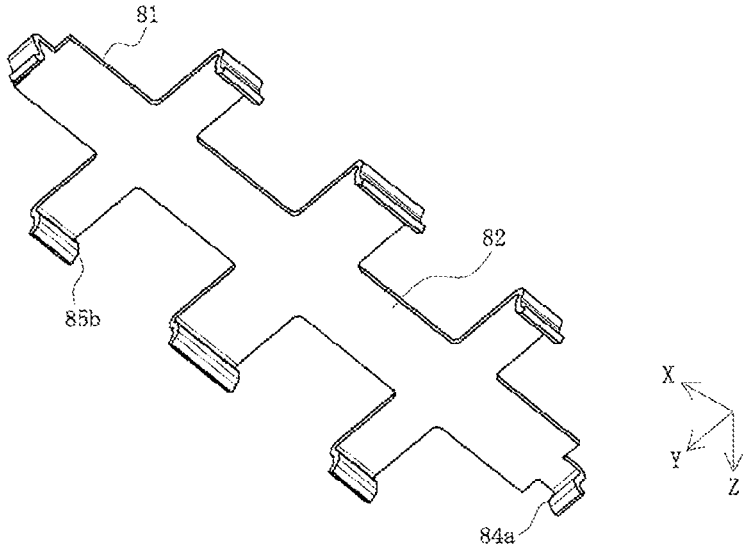
Figure 30:
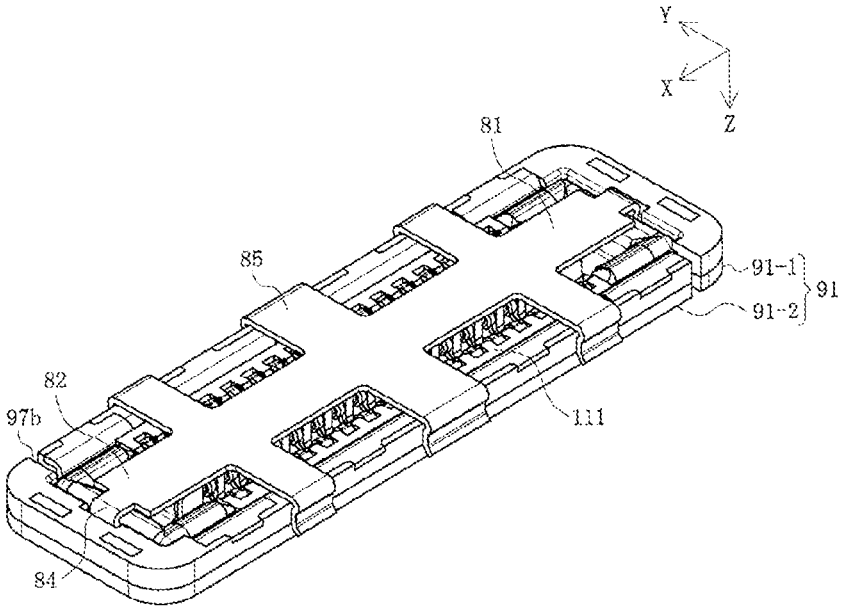
FIG. 30 is a perspective view illustrating a state in which the protective member is temporarily held by the second connector in Embodiment 5.
Figure 31A:
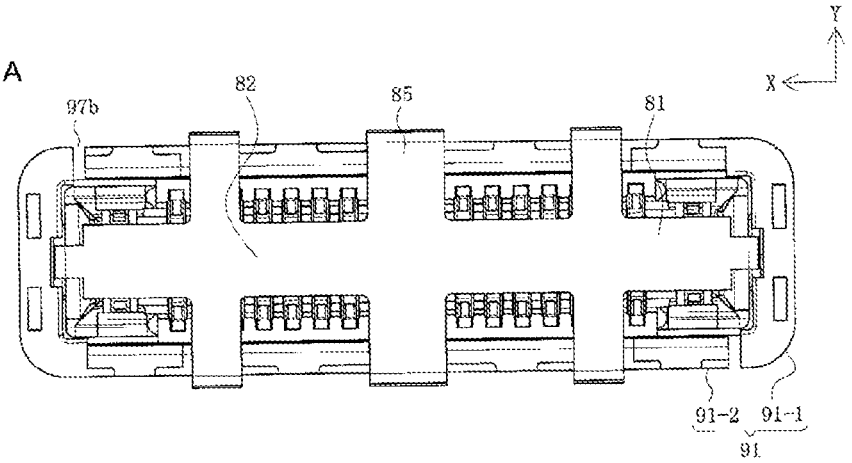
FIGS. 31A and 31B are top views illustrating the positional relationship between the second connector and the protective member of Embodiment 5.
Figure 31B:
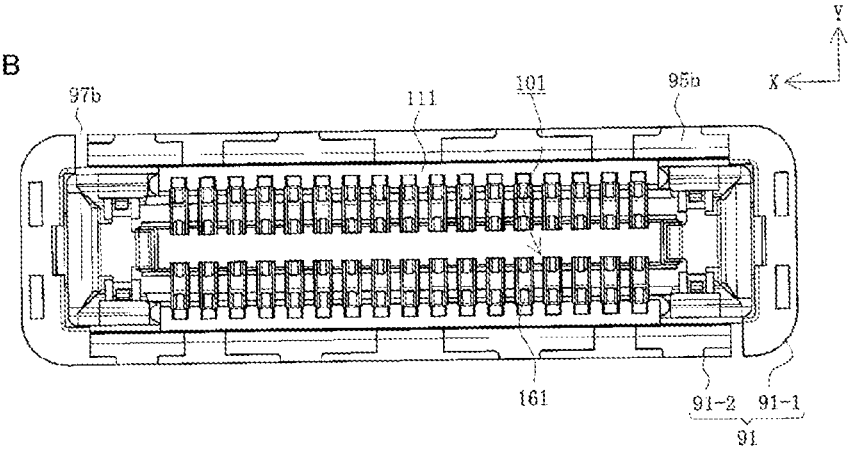

FIGS. 27A and 27B are perspective views illustrating a protective member and a second connector according to Embodiment 5, FIG. 28 is an exploded view illustrating the protective member of Embodiment 5, FIGS. 29A and 29B are perspective views illustrating an interposing member of Embodiment 5, FIG. 30 is a perspective view illustrating a state in which the protective member is temporarily held by the second connector in Embodiment 5, and FIGS. 31A and 31B are top views illustrating the positional relationship between the second connector and the protective member of Embodiment 5. FIG. 27A is a view illustrating only the protective member, and FIG. 27B is a view illustrating the positional relationship between the second connector and the protective member. FIG. 29A is a view illustrating the interposing member seen obliquely from above, and FIG. 29B is a view illustrating the interposing member seen obliquely from below. FIG. 31A is a view illustrating a state in which the protective member is temporarily held by the second connector, and FIG. 31B is a view illustrating a state in which the second connector and the protective member are mounted on the substrate.

Similarly to Embodiment 4, the protective member 91 of Embodiment 5 is divided into the left half body 91-1 and the right half body 91-2, and the open unit 97*b* in which the protective member 91 does not exist is formed between the left half body 91-1 and the right half body 91-2. Each of the left half body 91-1 and the right half body 91-2 is constructed with the single first wall 91A and the single second wall 91B connected at right angles to one end of the first wall 91A, and has an L-shaped shape in planar view. The left half body 91-1 and the right half body 91-2 are members having the same shape, and thus, so that the left half body 91-1 and the right half body 91-2 will be described as the protective member 91 when collectively described. Similarly, each of the protective housing 92, the protective metal fitting 93, and the hot-melt unit 96 includes a protective housing left half body 92-1 and a protective housing right half body 92-2 corresponding to the left half body 91-1 and the right half body 91-2, a protective metal fitting left half body 93-1 and a protective metal fitting right half body 93-2, and a hot-melt left half body 96-1 and a hot-melt right half body 96-2. The left half body and the right half body of each component have the same shape, so that the left half body and the right half body of each component will be described as the protective housing 92, the protective metal fitting 93, and the hot-melt unit 96 when collectively described. Note that the configurations of other components in the protective member 91 of Embodiment 5 is the same as those of Embodiment 3, and the descriptions thereof will be omitted.

In Embodiment 5, the protective member 91 does not necessarily include the hot-melt unit 96, and may not include the hot-melt unit 96 similarly to the protective member 91 of Embodiment 1.

In Embodiment 5, similarly to Embodiment 3, the protective member 91 is coupled to the second connector 101, and attached to the surface of the second substrate 198 together with the second connector 101. However, in Embodiment 5, the interposing member 81 is also used to couple the protective member 91 and the second connector 101 together unlike Embodiment 3.

The interposing member 81 of Embodiment 5 includes the protective member outside holding arm 85 holding the first wall 91A of the protective member 91 from the outside similarly to Embodiment 4, but does not include the protective member holding arm 83. Thus, in the interposing member 81, the protective member outside holding arm 85 holds the protective member 91 by grasping the first wall 91A only from the outside. The connector holding arm 84 does not extend from the left and right side edges of the interposing body 82 toward the outside in the width direction (Y-axis direction), but extends from the front and rear end edges of the interposing body 82 toward the outside in the longitudinal direction (X-axis direction). The holding protrusion 84*a* of the connector holding arm 84 presses the end wall cover 157 of the second reinforcing metal fitting 151 attached to the second protrusion end 121 of the second housing 111 of the second connector 101 from front and rear, thereby holding the second connector 101.

In Embodiment 5, after the second connector 101 and the protective member 91 are fixed to and mounted on the surface of the second substrate 198, potting is preferably performed for the purpose of waterproofing. The potting agent applied to the surface of the second substrate 198 in the liquid state flows through the open unit 97*b*, so that the potting agent spreads across a wide range of surfaces of the second substrate 198 on the inside and the outside of the protective member 91. Consequently, the surface of the second substrate 198 on the inside and the outside of the protective member 91 is certainly covered with the potting agent, so that the airtightness is maintained to a considerable degree to the environment of the surface of the second substrate 198 on the outside of the protective member 91 in the accommodation unit 97 of the protective member 91 attached to the surface of the second substrate 198.

If necessary, after the first connector 1 and the protective member 91 are mounted on and fixed to the surface of the first substrate 98, a tape and a filler can adhere or be applied to a desirable point of the open unit 97*b* or the protective member 91 to easily improve the airtightness or the watertightness.

Note that configurations and operations of other components such as the first connector 1, the second connector 101, the protective member 91, and interposing member 81 of Embodiment 5 are the same as those of Embodiments 1 to 4, and the description thereof will be omitted.

As described above, in Embodiment 5, the protective member 91 is constructed with the left half body 91-1 and the right half body 91-2, and each of the left half body 91-1 and the right half body 91-2 includes the first wall 91A extending in the longitudinal direction of the second housing 111 and the second wall 91B extending in the width direction of the second housing 111, one end of second wall 91B being connected to one end of the first wall 91A, and the open unit 97*b* exists between the other end of the first wall 91A and the other end of the second wall 91B of the left half body 91-1 and between the other end of the second wall 91B and the other end of the first wall 91A of the right half body 91-2.

Consequently, although the connector assembly has a simple configuration, the connector assembly can be easily and certainly attached to the surface of the second substrate 198, and the airtightness or the watertightness can be maintained to improve the reliability.

Even when the hot-melt unit 96 is not used and even when the potting is not performed, sufficient dust-proof effect should be obtained because the open unit 97*b* or the gap between the protective member 91 and the surfaces of the first substrate 98 and the second substrate 198 is small.

Embodiment 6 will be described below. Note that, for those having the same structure as that of Embodiments 1 and 5, the descriptions thereof will be omitted by giving the same reference numerals thereto. Moreover, the descriptions of the same operations and effects as those of Embodiments 1 to 5 will be omitted.

Figure 32A:
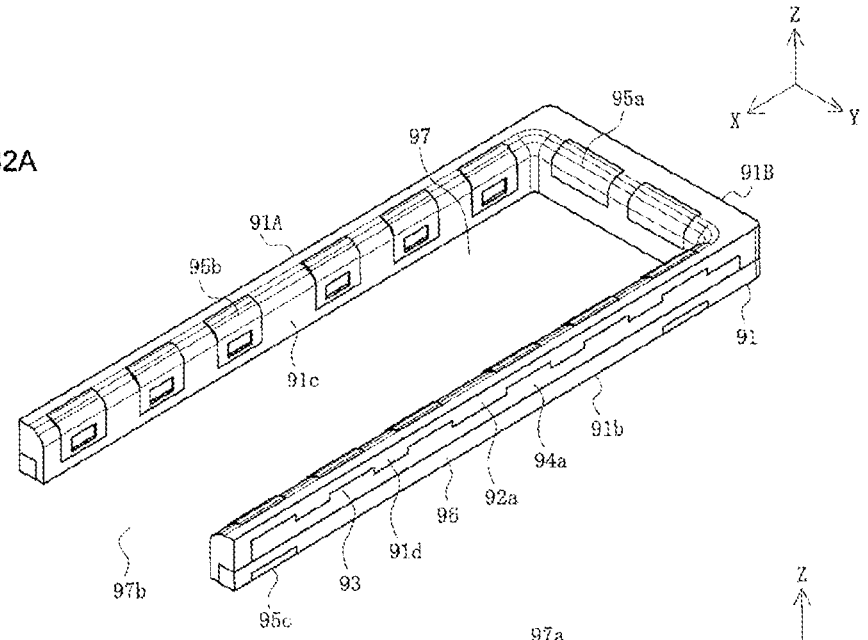
FIGS. 32A and 32B are perspective views illustrating a protective member according to Embodiment 6.
Figure 32B:
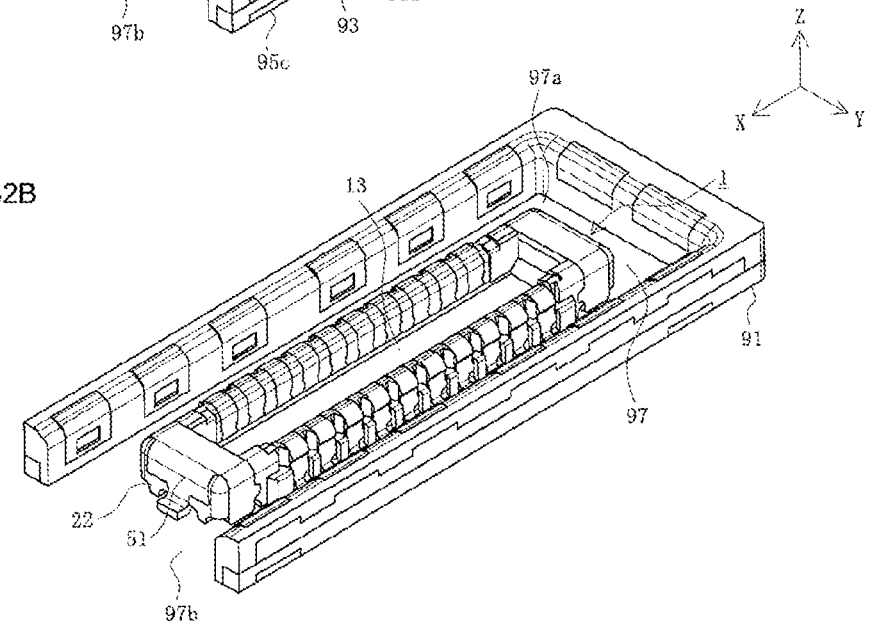
Figure 33:
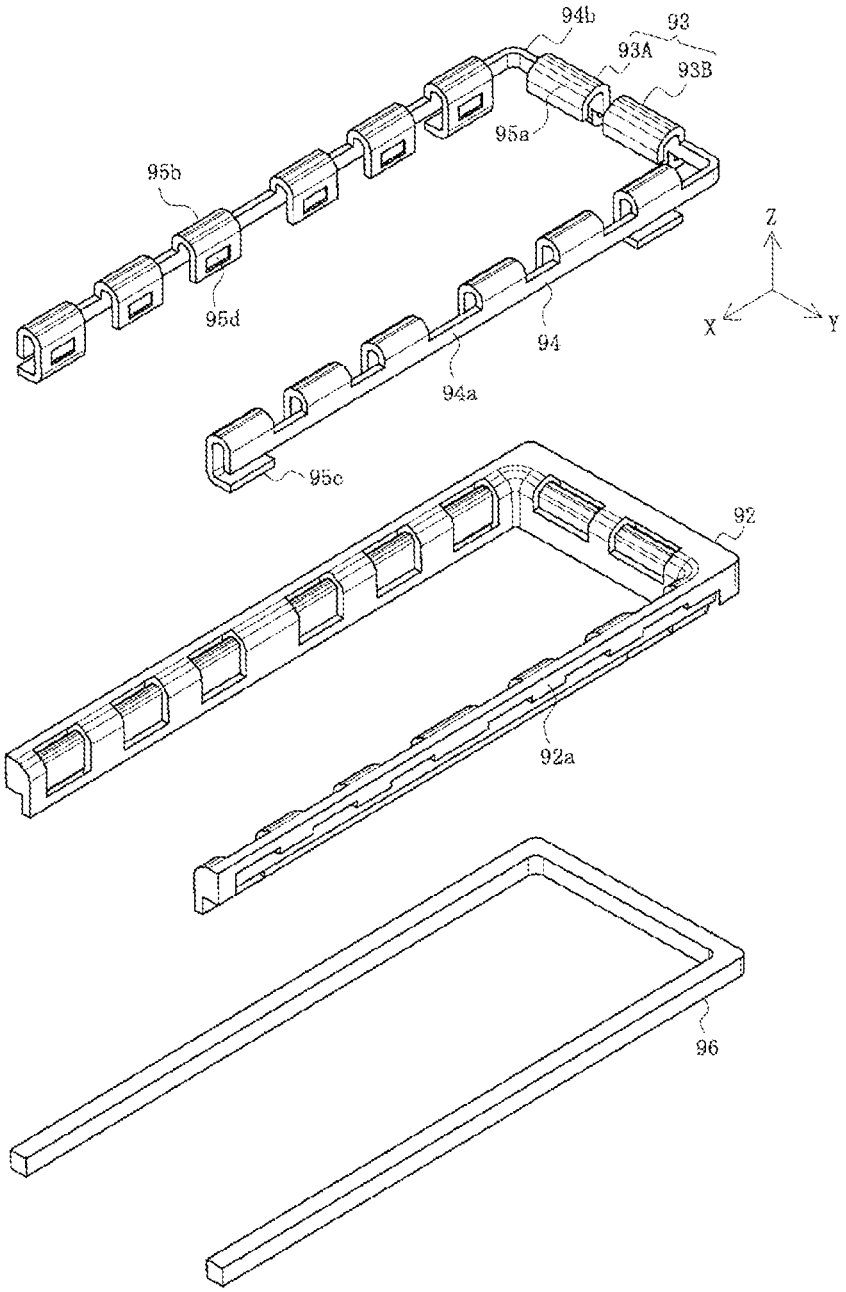
FIG. 33 is an exploded view illustrating the protective member of Embodiment 6.
Figure 34A:
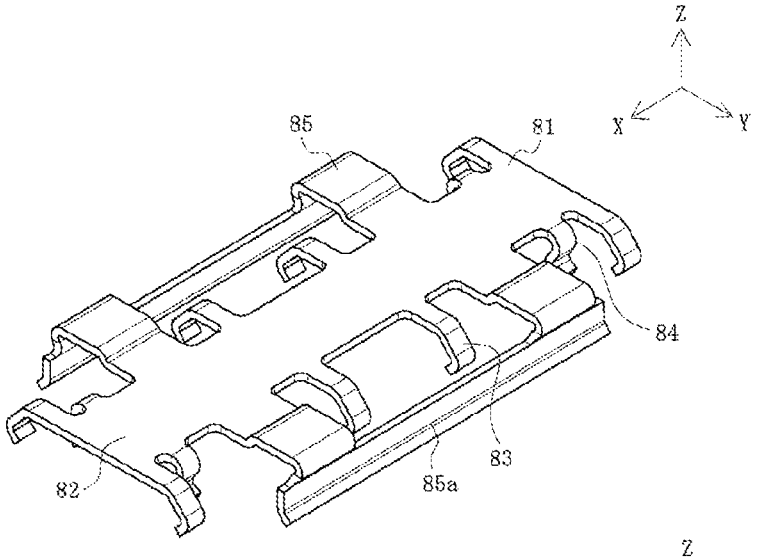
FIGS. 34A and 34B are perspective views illustrating an interposing member of Embodiment 6.
Figure 34B:
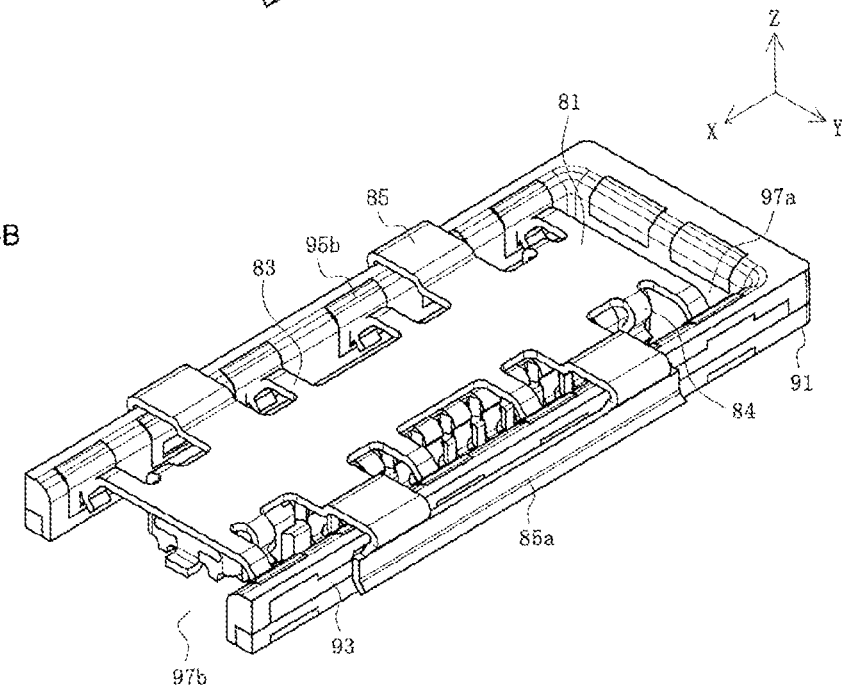

FIGS. 32A and 32B are perspective views illustrating a protective member according to Embodiment 6, FIG. 33 is an exploded view illustrating the protective member of Embodiment 6, and FIGS. 34A and 34B are perspective views illustrating an interposing member of Embodiment 6. FIG. 32A is a view illustrating only the protective member, and FIG. 32B is a view illustrating a positional relationship between a first connector and the protective member. FIG. 34A is a view illustrating only the interposing member, and FIG. 34B is a view illustrating a state in which the first connector and the protective member are coupled together using the interposing member.

In Embodiment 6, the protective member 91 is a frame member having a U-shaped shape in planar view in which one of the short sides of the rectangle is lacking. As illustrated in the drawings, the protective member 91 includes a pair of parallel first walls 91A extending linearly in the longitudinal direction (X-axis direction), and includes only one second wall 91B extending linearly in the width direction (Y axis direction). Thus, one end of the first wall 91A is connected to both the ends of the second wall 91B so as to form right angles, and the second wall 91B does not exist at the other end of the first wall 91A, but the open unit 97*b* exists. Similarly, the hot-melt unit 96 and the protective metal fitting 93 constructed with the protective housing 92, the protective metal fitting right member 93A, and the protective metal fitting left member 93B have the U-shaped shape in planar view as illustrated in FIG. 33. Note that the configurations of other components in the protective member 91 of Embodiment 6 is the same as those of Embodiments 2 and 4, and the descriptions thereof will be omitted.

In Embodiment 6, the protective member 91 does not necessarily include the hot-melt unit 96, and may not include the hot-melt unit 96 similarly to the protective member 91 of Embodiment 1.

In Embodiment 6, potting is preferably performed for the purpose of waterproofing after the first connector 1 and the protective member 91 are mounted on and fixed to the surface of the first substrate 98. The potting agent applied to the surface of the first substrate 98 in the liquid state flows through the open unit 97*b*, so that the potting agent spreads across a wide range of surfaces of the first substrate 98 on the inside and the outside of the protective member 91. Consequently, even when the protective member 91 has the U-shaped shape in planar view in which one of the short sides of the rectangle is lacking, the surface of the first substrate 98 on the inside and the outside of the protective member 91 is certainly covered with the potting agent, so that the airtightness and the watertightness are maintained to a considerable degree to the environment of the surface of the first substrate 98 on the outside of the protective member 91 in the accommodation unit 97 of the protective member 91 attached to the surface of the first substrate 98.

If necessary, after the first connector 1 and the protective member 91 are mounted on and fixed to the surface of the first substrate 98, a tape and a filler can adhere or be applied to a desirable point of the open unit 97*b* or the protective member 91 to easily improve the airtightness or the watertightness.

Note that configurations and operations of other components such as the first connector 1, the second connector 101, the protective member 91, and interposing member 81 of Embodiment 6 are the same as those of Embodiments 1 to 5, and the description thereof will be omitted.

As described above, in Embodiment 6, the protective member 91 includes one second wall 91B extending in the width direction of the first housing 11 and a first wall 91A extending in the longitudinal direction of the first housing 11, one ends of the pair of first walls 91A being connected to both the ends of the second wall 91B, and the open unit 97*b* exists between the other end of one of the first walls 91A and the other end of the other first wall 91A.

Consequently, although the connector assembly has the simple configuration, the connector assembly can be easily and certainly attached to the surface of the first substrate 98, and the airtightness or the watertightness can be maintained to improve the reliability.

Even when the hot-melt unit 96 is not used and even when potting is not performed, the protective member 91 protects the tail 62 of the first terminal 61 and the tail 162 of the second terminal 161 from outside, so that the sufficient dust-proof effect should be obtained.

Embodiment 7 will be described below. Note that, for those having the same structure as that of Embodiments 1 and 6, the descriptions thereof will be omitted by giving the same reference numerals thereto. Moreover, descriptions of the same operations and effects as those of Embodiments 1 to 6 will be omitted.

Figure 35A:
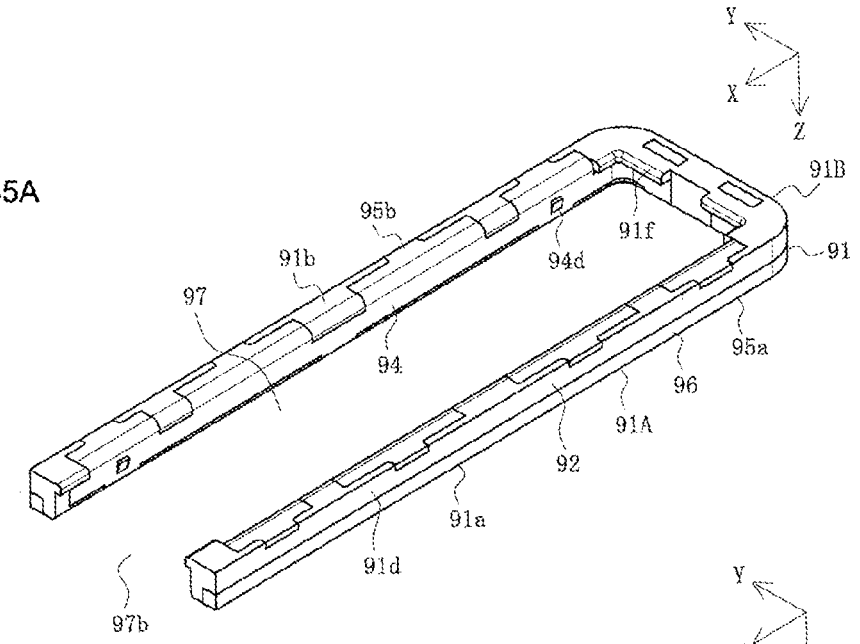
FIGS. 35A and 35B are perspective views illustrating a protective member according to Embodiment 7.
Figure 35B:
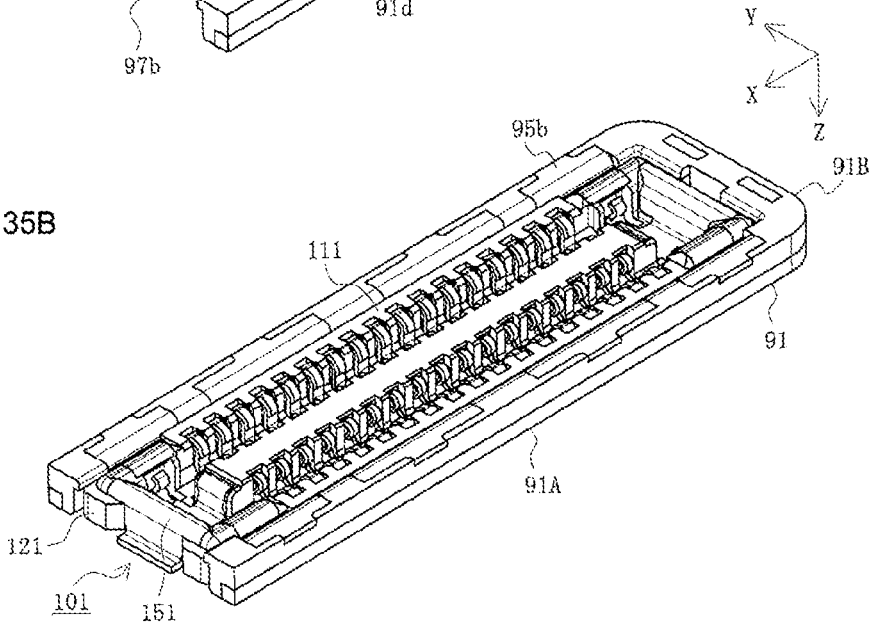
Figure 36:
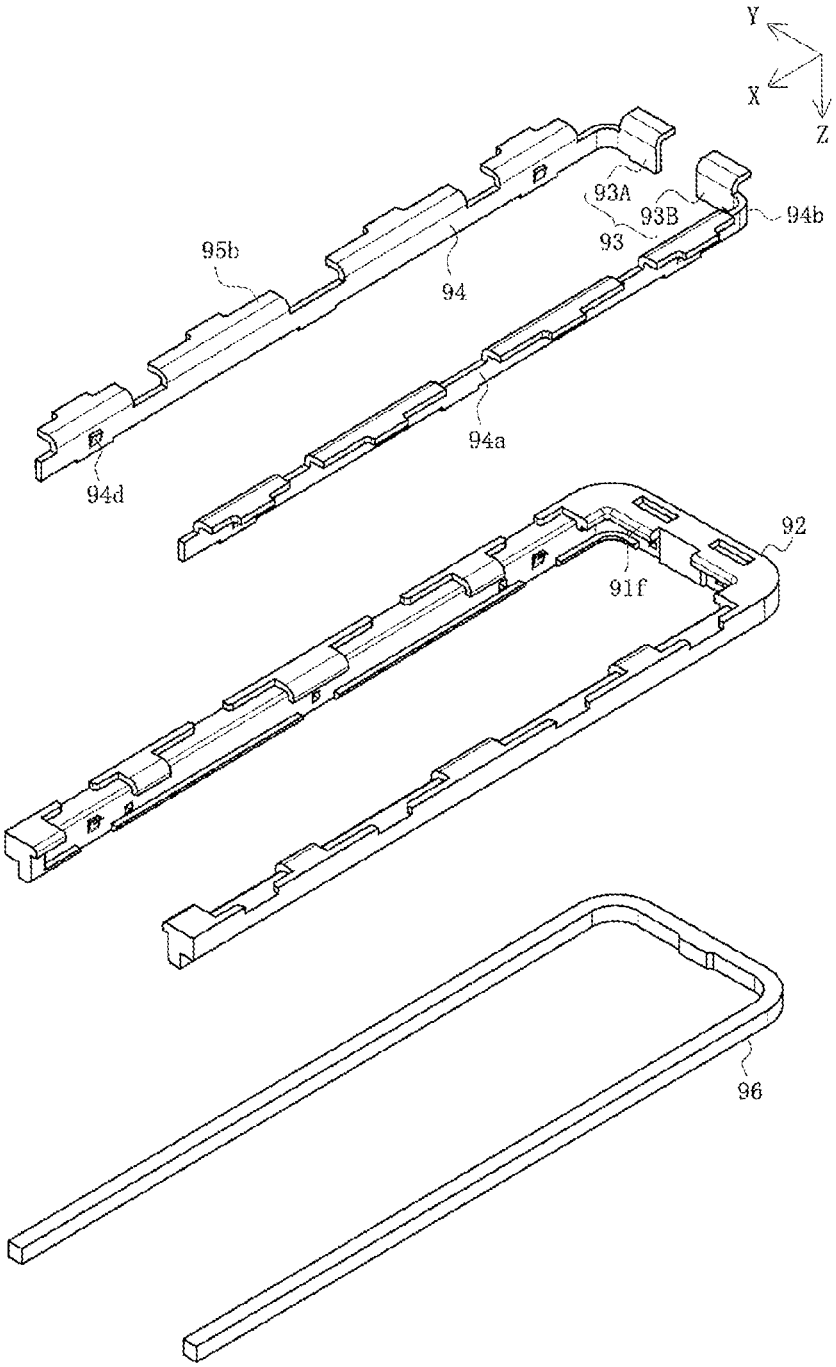
FIG. 36 is an exploded view illustrating the protective member of Embodiment 7.
Figure 37A:
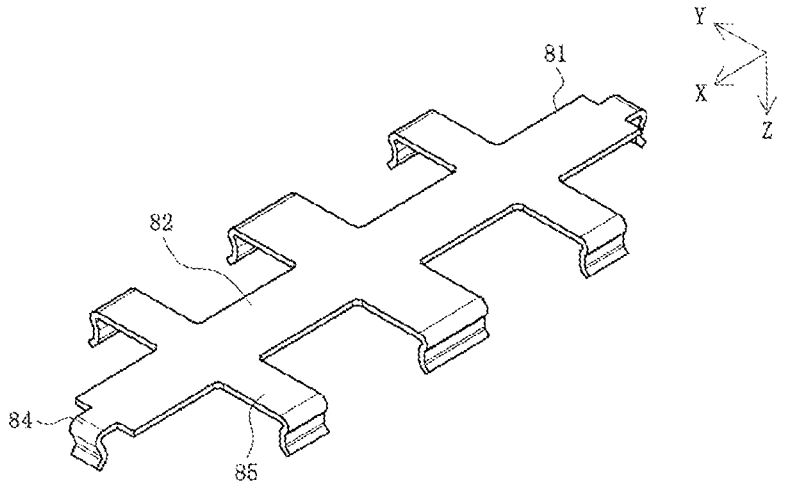
FIGS. 37A and 37B are perspective views illustrating an interposing member of Embodiment 7.
Figure 37B:
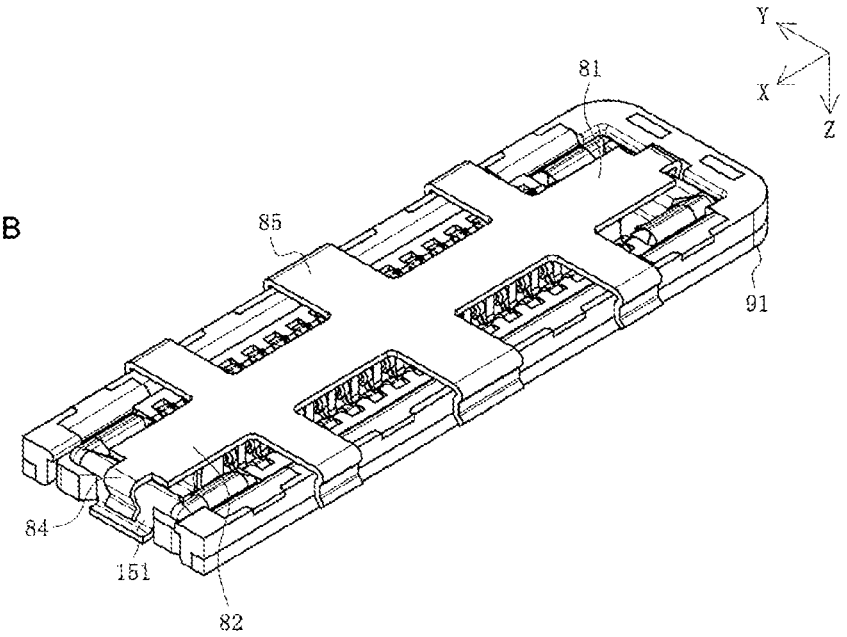

FIGS. 35A and 35B are perspective views illustrating a protective member according to Embodiment 7, FIG. 36 is an exploded view illustrating the protective member of Embodiment 7, and FIGS. 37A and 37B are perspective views illustrating an interposing member of Embodiment 7. FIG. 35A is a view illustrating only the protective member, and FIG. 35B is a view illustrating a positional relationship between a second connector and the protective member. FIG. 37A is a view illustrating only the interposing member, and FIG. 37B is a view illustrating a state in which the second connector and the protective member are coupled together using the interposing member.

In Embodiment 7, the protective member 91 is a frame member having a U-shaped shape in planar view in which one of the short sides of the rectangle is lacking similarly to Embodiment 6. As illustrated in the drawings, the protective member 91 includes a pair of parallel first walls 91A extending linearly in the longitudinal direction, and includes only one second wall 91B extending linearly in the width direction. Thus, one end of the first wall 91A is connected to both the ends of the second wall 91B so as to form right angles, and the second wall 91B does not exist at the other end of the first wall 91A, but the open unit 97*b* exists. Similarly, the protective metal fitting 93 formed from the protective housing 92, the protective metal fitting right member 93A, and the protective metal fitting left member 93B, and the hot-melt unit 96 have a U-shaped shape in planar view as illustrated in FIG. 36. Note that the configurations of other components in the protective member 91 of Embodiment 7 is the same as those of Embodiments 3 and 5, and the descriptions thereof will be omitted.

In Embodiment 7, the protective member 91 does not necessarily include the hot-melt unit 96, and may not include the hot-melt unit 96 similarly to the protective member 91 of Embodiment 1.

In Embodiment 7, similarly to Embodiment 3, the protective member 91 is coupled to the second connector 101, and attached to the surface of the second substrate 198 together with the second connector 101. However, in Embodiment 7, similarly to Embodiment 5, the interposing member 81 is also used to couple the protective member 91 and the second connector 101 together.

In Embodiment 7, after the second connector 101 and the protective member 91 are fixed to and mounted on the surface of the second substrate 198, potting is preferably performed for the purpose of waterproofing. The potting agent applied to the surface of the second substrate 198 in the liquid state flows through the open unit 97*b*, so that the potting agent spreads across a wide range of surfaces of the second substrate 198 on the inside and the outside of the protective member 91. Consequently, even when the protective member 91 has the U-shaped shape in planar view in which one of the short sides of the rectangle is lacked, the surface of the second substrate 198 on the inside and the outside of the protective member 91 is certainly covered with the potting agent, so that the airtightness and the watertightness are maintained to a considerable degree to the environment of the surface of the second substrate 198 on the outside of the protective member 91 in the accommodation unit 97 of the protective member 91 attached to the surface of the second substrate 198.

If necessary, after the first connector 1 and the protective member 91 are mounted on and fixed to the surface of the second substrate 198, a tape and a filler can adhere or be applied to a desirable point of the open unit 97*b* or the protective member 91 to easily improve the airtightness or the watertightness.

Note that configurations and operations of other components such as the first connector 1, the second connector 101, the protective member 91, and interposing member 81 of Embodiment 7 are the same as those of Embodiments 1 to 6, and the description thereof will be omitted.

As described above, in Embodiment 7, the protective member 91 includes one second wall 91B extending in the width direction of the second housing 111 and a first wall 91A extending in the longitudinal direction of the second housing 111, one ends of the pair of first walls 91A being connected to both the ends of the second wall 91B, and the open unit 97*b* exists between the other end of one of the first walls 91A and the other end of the other first wall 91A.

Consequently, although the connector assembly has a simple configuration, the connector assembly can be easily and certainly attached to the surface of the second substrate 198, and the high airtightness or watertightness can be certainly maintained to improve reliability. Furthermore, the strength of the protective member 91 is improved and the protective metal fitting 93 functions as the electromagnetic shield, so that the shielding properties of the first connector 1 and the second connector 101 are improved.

Even when the hot-melt unit 96 is not used and even when potting is not performed, the protective member 91 protects the tail 62 of the first terminal 61 and the tail 162 of the second terminal 161 from outside, so that the sufficient dust-proof effect should be obtained.

Embodiment 8 will be described below. Note that, for those having the same structure as that of Embodiments 1 to 7, descriptions thereof are omitted by giving the same reference numerals thereto. Moreover, descriptions of the same operations and effects as those of Embodiments 1 to 7 will be omitted.

Figure 38A:
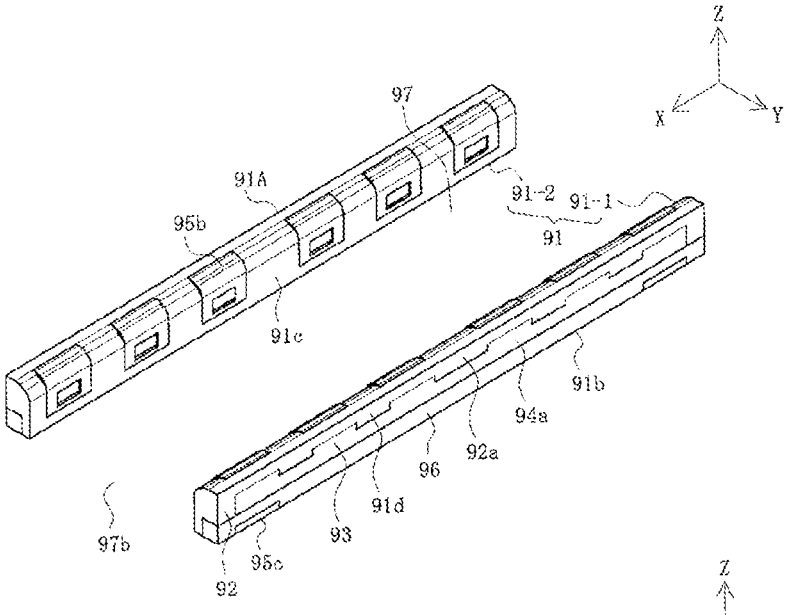
FIGS. 38A and 38B are perspective views illustrating a protective member according to Embodiment 8.
Figure 38B:
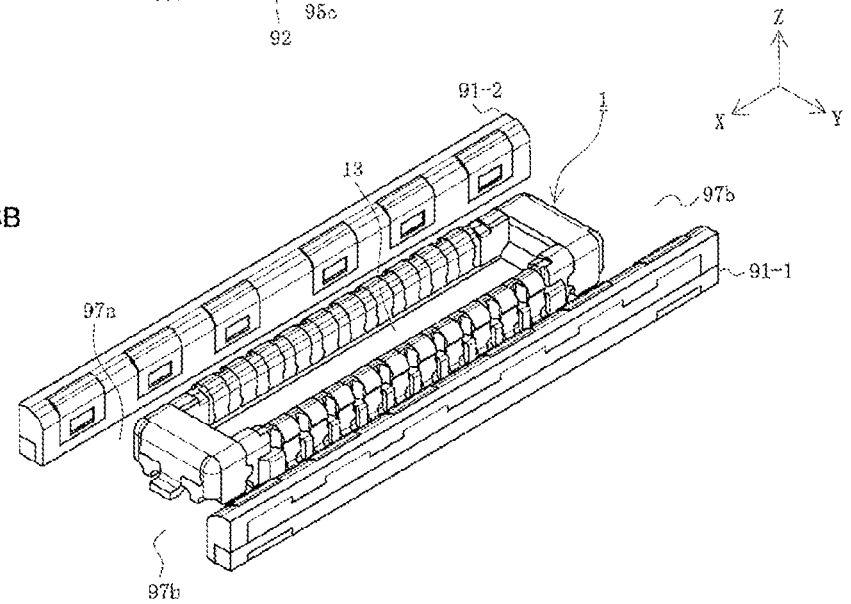
Figure 39:
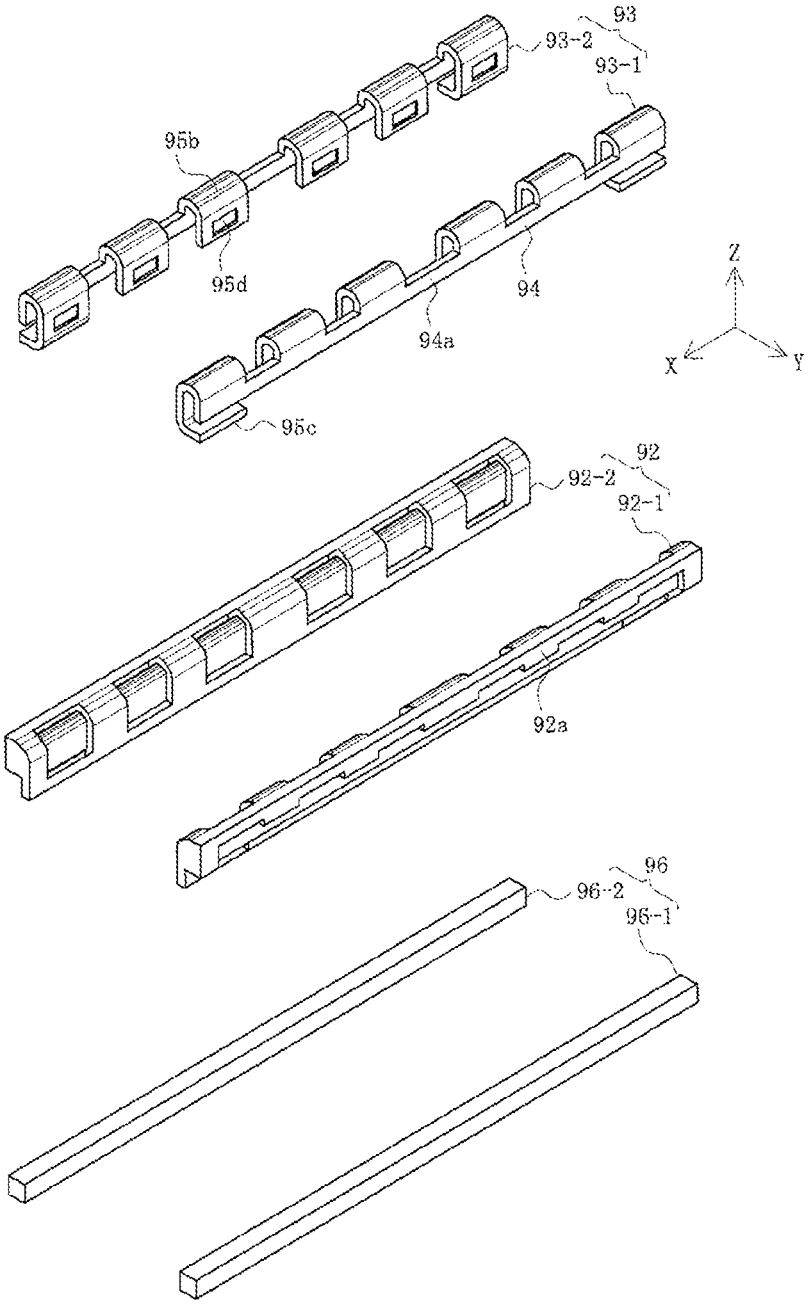
FIG. 39 is an exploded view illustrating the protective member of Embodiment 8.
Figure 40A:
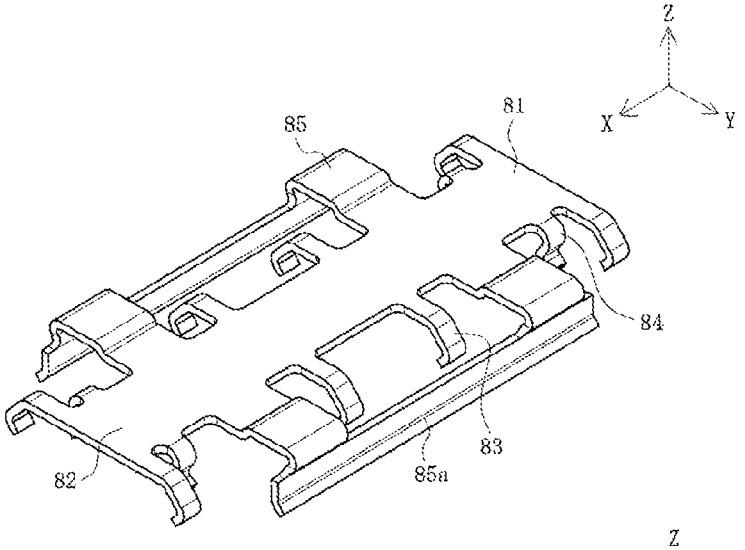
FIGS. 40A and 40B are perspective views illustrating an interposing member of Embodiment 8.
Figure 40B:
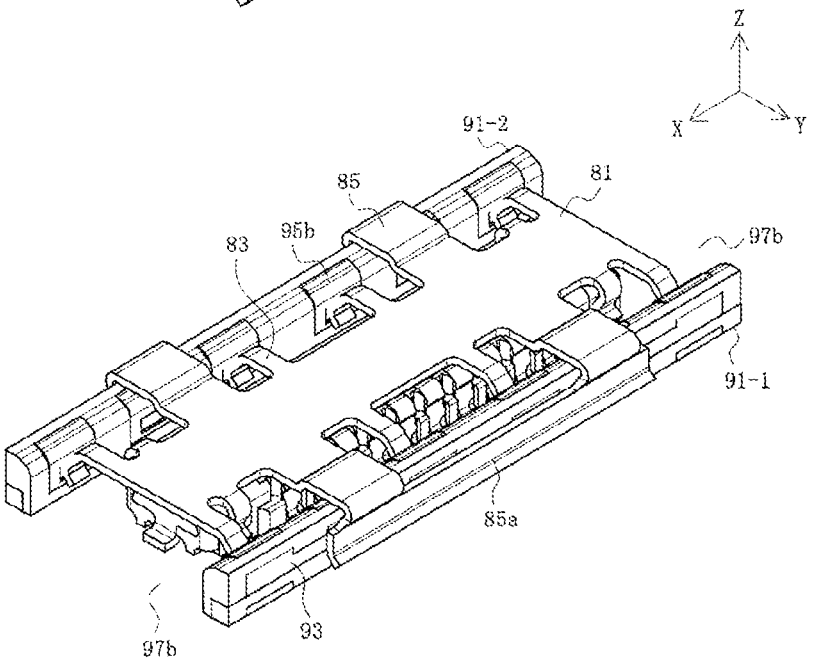

FIGS. 38A and 38B are perspective views illustrating a protective member according to Embodiment 8, FIG. 39 is an exploded view illustrating the protective member of Embodiment 8, and FIGS. 40A and 40B are perspective views illustrating an interposing member of Embodiment 8. FIG. 38A is a view illustrating only the protective member, and FIG. 38B is a view illustrating a positional relationship between a first connector and the protective member. FIG. 40A is a view illustrating only the interposing member, and FIG. 40B is a view illustrating a state in which the first connector and the protective member are coupled together using the interposing member.

In Embodiment 8, the protective member 91 is a frame member having a parallel shape in planar view in which a pair of short sides of a rectangle is lacking. As illustrated in the drawings, the protective member 91 includes a pair of parallel first walls 91A extending linearly in the longitudinal direction, but does not include the second wall 91B extending linearly in the width direction. For this reason, both the ends of the first wall 91A are not coupled together, but are the open units 97*b*. Similarly, the protective housing 92, the protective metal fitting 93, and the hot-melt unit 96 have the parallel shape in planar view as illustrated in FIG. 39. Note that the configurations of other components in the protective member 91 of Embodiment 8 is the same as those of Embodiments 2, 4, and 6, and the descriptions thereof will be omitted.

In Embodiment 8, the protective member 91 does not necessarily include the hot-melt unit 96, and may not include the hot-melt unit 96 similarly to the protective member 91 of Embodiment 1.

In Embodiment 8, potting is preferably performed for the purpose of waterproofing after the first connector 1 and the protective member 91 are mounted on and fixed to the surface of the first substrate 98. The potting agent applied to the surface of the first substrate 98 in the liquid state flows through the open unit 97*b*, so that the potting agent spreads across a wide range of surfaces of the first substrate 98 on the inside and the outside of the protective member 91. Consequently, even when the protective member 91 has the parallel shape in planar view in which the pair of short sides of the rectangle is lacking, the surface of the first substrate 98 on the inside and the outside of the protective member 91 is certainly covered with the potting agent, so that the airtightness and the watertightness are maintained to a considerable degree to the environment of the surface of the first substrate 98 on the outside of the protective member 91 in the accommodation unit 97 of the protective member 91 attached to the surface of the first substrate 98.

If necessary, after the first connector 1 and the protective member 91 are mounted on and fixed to the surface of the first substrate 98, a tape and a filler can adhere or be applied to a desirable point of the open unit 97*b* or the protective member 91 to easily improve the airtightness or the watertightness.

Note that configurations and operations of other components such as the first connector 1, the second connector 101, the protective member 91, and interposing member 81 of Embodiment 8 are the same as those of Embodiments 1 to 7, and the description thereof will be omitted.

As described above, in Embodiment 8, the protective member 91 is constructed with the pair of first walls 91A extending in the longitudinal direction of the first housing 11, and an open unit 97*b* exists between both the ends of one of the first walls 91A and both the ends of the other first wall 91A.

Consequently, although the connector assembly has the simple configuration, the connector assembly can be easily and certainly attached to the surface of the first substrate 98, and the airtightness or the watertightness can be maintained to improve the reliability.

Even when the hot-melt unit 96 is not used and even when potting is not performed, the protective member 91 protects the tail 62 of the first terminal 61 and the tail 162 of the second terminal 161 from outside, so that the sufficient dust-proof effect should be obtained.

Embodiment 9 will be described below. Note that, for those having the same structure as that of Embodiments 1 to 8, descriptions thereof are omitted by giving the same reference numerals thereto. Moreover, descriptions of the same operations and effects as those of Embodiments 1 to 8 will be omitted.

Figure 41A:
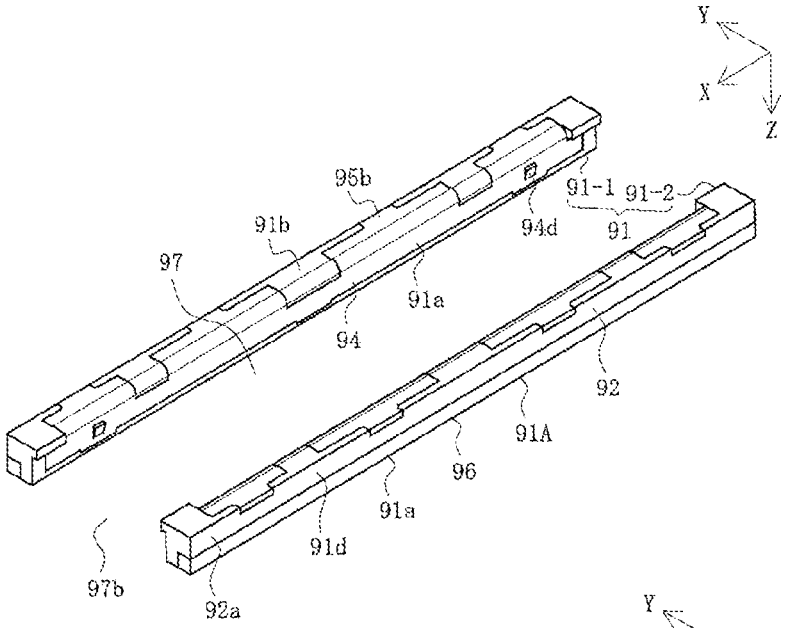
FIGS. 41A and 41B are perspective views illustrating a protective member according to Embodiment 9.
Figure 41B:
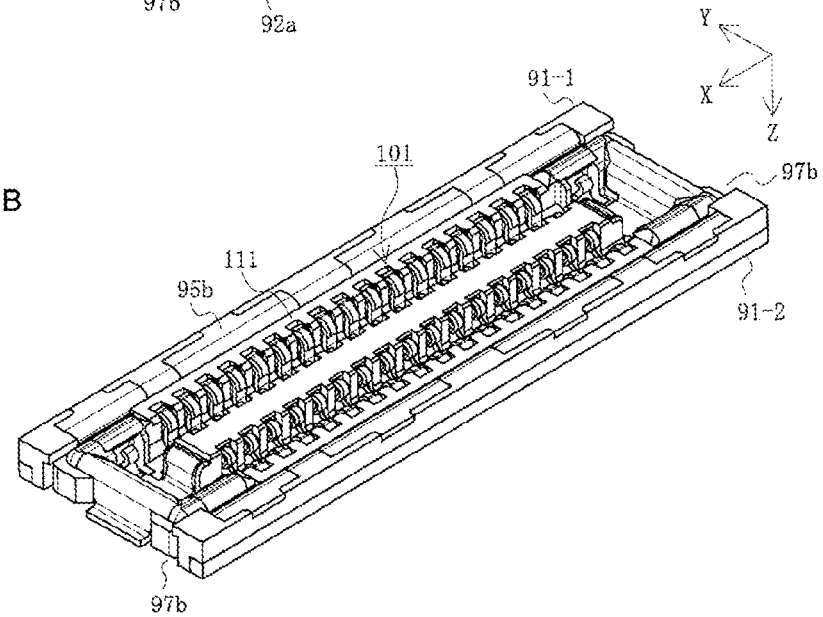
Figure 42:
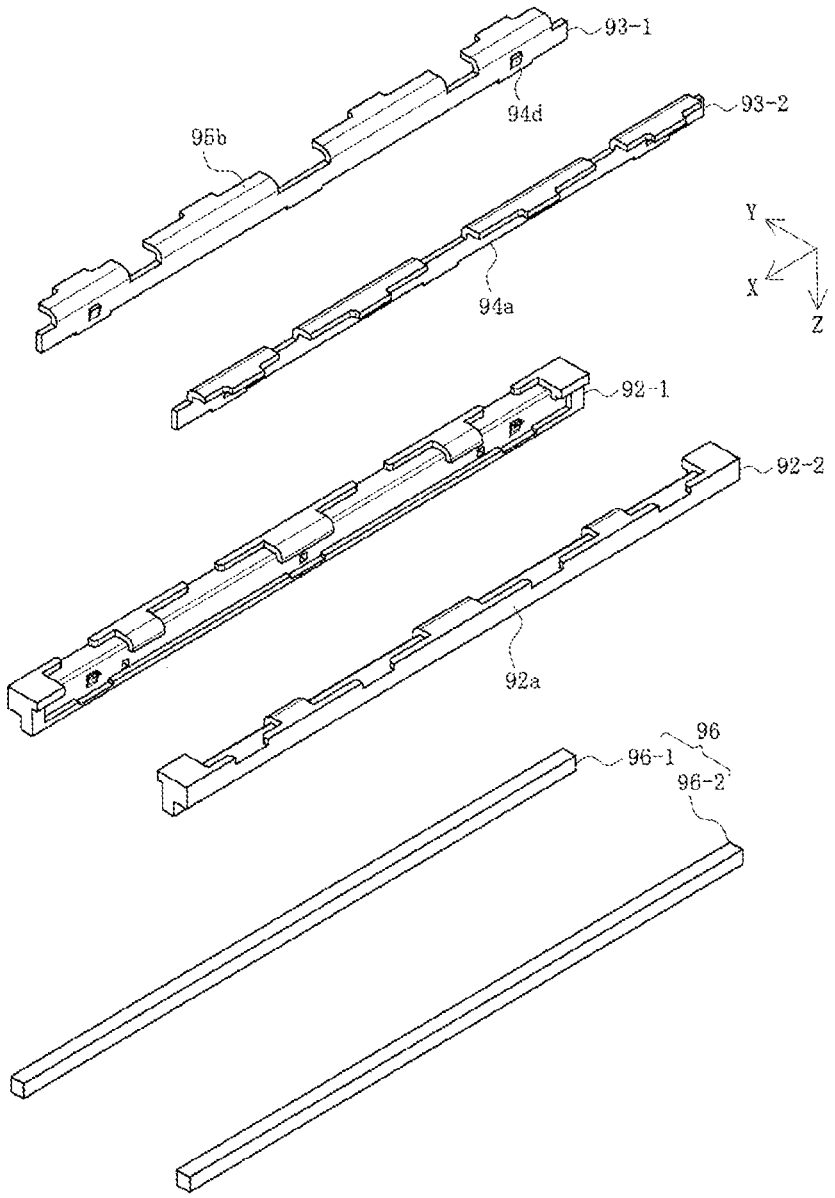
FIG. 42 is an exploded view illustrating the protective member of Embodiment 9.
Figure 43A:
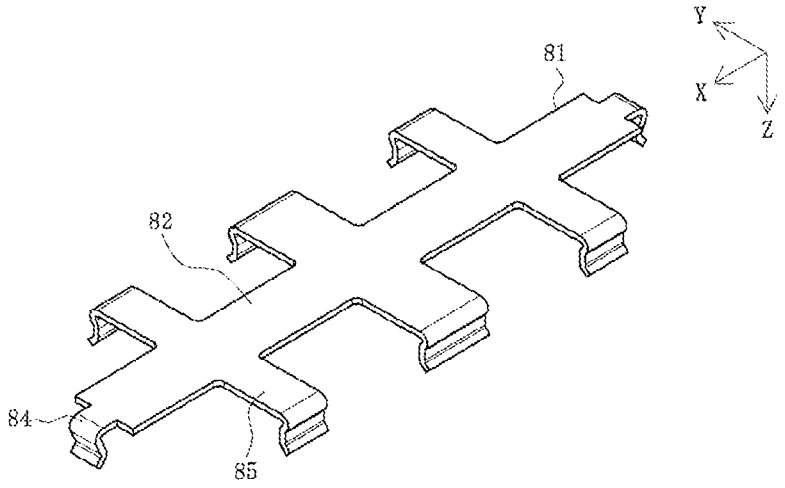
FIGS. 43A and 43B are perspective views illustrating an interposing member of Embodiment 9.
Figure 43B:
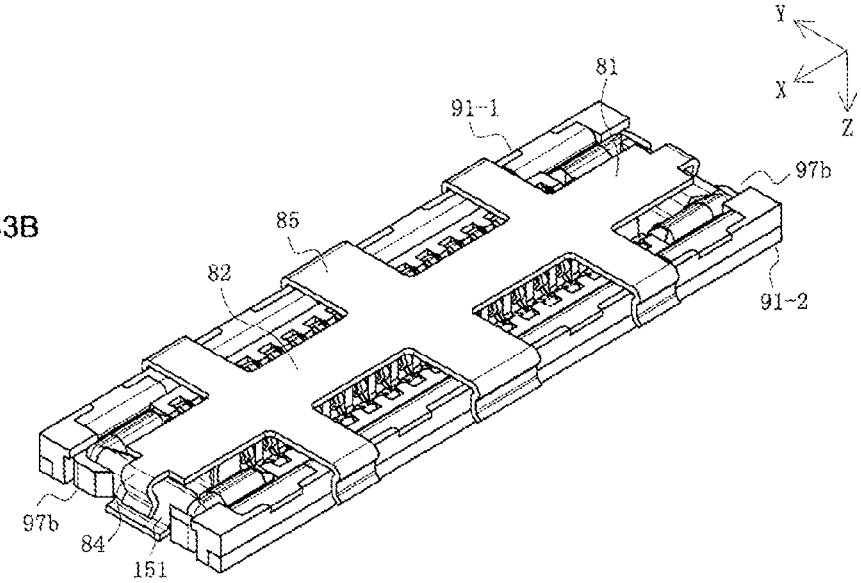
Figure 44:
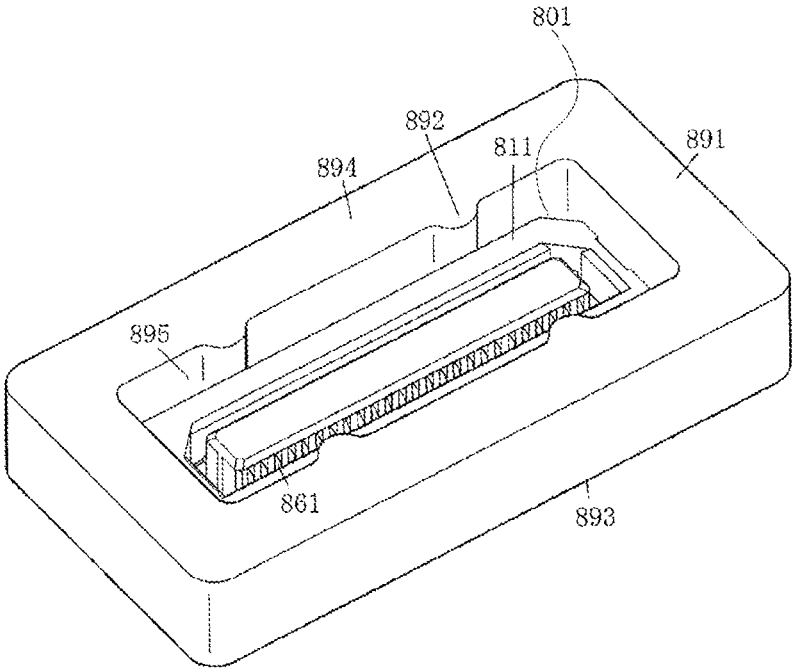
FIG. 44 is a perspective view illustrating a known connector assembly.

FIGS. 41A and 41B are perspective views illustrating a protective member according to Embodiment 9, FIG. 42 is an exploded view illustrating the protective member of Embodiment 9, and FIGS. 43A and 43B are perspective views illustrating an interposing member of Embodiment 9. FIG. 41A is a view illustrating only the protective member, and FIG. 41B is a view illustrating a positional relationship between a second connector and the protective member.

FIG. 43A is a view illustrating only the interposing member, and FIG. 43B is a view illustrating a state in which the second connector and the protective member are coupled together using the interposing member.

In Embodiment 9, the protective member 91 is a frame member having a parallel shape in planar view in which a pair of short sides of the rectangle is lacked similarly to Embodiment 8. As illustrated in the drawings, the protective member 91 includes a pair of parallel first walls 91A extending linearly in the longitudinal direction, but does not include the second wall 91B extending linearly in the width direction. For this reason, both the ends of the first wall 91A are not coupled together, but are the open units 97*b*. Similarly, the protective housing 92, the protective metal fitting 93, and the hot-melt unit 96 have a parallel shape in planar view as illustrated in FIG. 42. Note that the configurations of other components in the protective member 91 of Embodiment 9 is the same as those of Embodiments 3 and 5, and the descriptions thereof will be omitted.

In Embodiment 9, the protective member 91 does not necessarily include the hot-melt unit 96, and may not include the hot-melt unit 96 similarly to the protective member 91 of Embodiment 1.

In Embodiment 9, similarly to Embodiment 7, the protective member 91 is coupled to the second connector 101, and attached to the surface of the second substrate 198 together with the second connector 101. However, in Embodiment 9, the interposing member 81 is also used to couple the protective member 91 and the second connector 101 together.

In Embodiment 9, after the second connector 101 and the protective member 91 are fixed to and mounted on the surface of the second substrate 198, potting is preferably performed for the purpose of waterproofing. The potting agent applied to the surface of the second substrate 198 in the liquid state flows through the open unit 97*b*, so that the potting agent spreads across a wide range of surfaces of the second substrate 198 on the inside and the outside of the protective member 91. Consequently, even when the protective member 91 has the parallel shape in planar view in which the pair of short sides of the rectangle is lacked, the surface of the second substrate 198 on the inside and the outside of the protective member 91 is certainly covered with the potting agent, so that the airtightness or the watertightness is maintained to a considerable degree to the environment of the surface of the second substrate 198 on the outside of the protective member 91 in the accommodation unit 97 of the protective member 91 attached to the surface of the second substrate 198.

If necessary, after the first connector 1 and the protective member 91 are mounted on and fixed to the surface of the second substrate 198, a tape and a filler can adhere or be applied to a desirable point of the open unit 97*b* or the protective member 91 to easily improve the airtightness or the watertightness.

Note that configurations and operations of other components such as the first connector 1, the second connector 101, the protective member 91, and interposing member 81 of Embodiment 9 are the same as those of Embodiments 1 to 8, and the description thereof will be omitted.

As described above, in Embodiment 9, the protective member 91 is constructed with the pair of first walls 91A extending in the longitudinal direction of the second housing 111, and an open unit 97*b* exists between both the ends of one of the first walls 91A and both the ends of the other first wall 91A.

Consequently, although the connector assembly has a simple configuration, the connector assembly can be easily and certainly attached to the surface of the second substrate 198, and the airtightness or the watertightness can be maintained to improve the reliability.

Even when the hot-melt unit 96 is not used and even when potting is not performed, the protective member 91 protects the tail 62 of the first terminal 61 and the tail 162 of the second terminal 161 from outside, so that a sufficient dustproof effect should be obtained.

Note that the invention herein describes features relating to suitable exemplary embodiments. Various other embodiments, modifications, and variations within the scope and spirit of Scope of the Patent Claims appended hereto will naturally be conceived of by those skilled in the art upon review of the invention herein.

The present invention can be applied to a connector assembly and a connector pair.

The invention claimed is:

1. A connector assembly comprising:

a connector including a connector body and a terminal attached to the connector body, the connector being configured to be attached to a surface of a substrate; and a protective member including a wall extending in a longitudinal direction or a width direction of the connector body and an accommodation unit in which at least a part of four sides of a periphery is defined by the wall, the protective member configured to be attached to the surface of the substrate with the connector accommodated in the accommodation unit, wherein the protective member includes a protective member body made of an insulating material and a protective metal fitting made of a conductive metal integrally formed with the protective member body, and the protective member is configured to be placed on the surface of the substrate while coupled to the connector with the connector accommodated in the accommodation unit, and wherein the protective member is constructed with a pair of half bodies, the half bodies are constructed with the first wall extending in the longitudinal direction of the connector body and the second wall extending in the width direction of the connector body, one end of the second wall being connected to one end of the first wall, and an open unit exists between the other end of the first wall and the other end of the second wall of one of the half bodies and between the other end of the second wall and the other end of the first wall of the other half body.

2. The connector assembly according to claim 1, wherein the protective metal fitting includes a portion exposed from the protective member body in an inside surface of the protective member and a portion exposed from the protective member body in an opposing substrate side surface of the protective member.

3. The connector assembly according to claim 2, wherein the portion exposed from the protective member body in the inside surface includes a portion that holds a connector body of the connector accommodated in the accommodation unit while engaging with the connector body.

4. The connector assembly according to claim 1, wherein the protective metal fitting includes a portion exposed from the protective member body in inside surfaces of a first wall of the protective member extending in the longitudinal direction of the connector body and a second wall of the protective member extending in the width direction of the connector body and a portion exposed from the protective member body in a side surface of a mounting substrate of the protective member.

5. The connector assembly according to claim 1, further comprising an interposing member interposed between the connector and the protective member, wherein the interposing member couples the connector and the protective member together while maintaining a positional relationship between the connector and the protective member constant.

6. The connector assembly according to claim 5, wherein:

the connector further includes a reinforcing metal fitting attached to the connector body, and the interposing member includes a main body and a protective member outside holding arm and a connector holding arm, which extend from the main body, the protective member outside holding arm includes an engagement unit holding the protective member from an outside, and the connector holding arm includes a holder holding the reinforcing metal fitting.

7. The connector assembly according to claim 6, wherein the interposing member further includes a protective member inside holding arm extending from the main body, and the protective member inside holding arm includes an engagement unit holding the protective member from an inside.

8. A connector pair comprising: the connector assembly described in claim 1; and an opposing connector fitted in the connector.

9. The connector pair according to claim 8, wherein the opposing connector is fitted in the connector in a state in which the connector and protective member are fixed to the surface of the substrate after coupled together and placed on the surface of the substrate.

10. A connector assembly comprising:

a connector including a connector body and a terminal attached to the connector body, the connector being configured to be attached to a surface of a substrate; and a protective member including a wall extending in a longitudinal direction or a width direction of the connector body and an accommodation unit in which at least a part of four sides of a periphery is defined by the wall, the protective member configured to be attached to the surface of the substrate with the connector accommodated in the accommodation unit, wherein the protective member includes a protective member body made of an insulating material and a protective metal fitting made of a conductive metal integrally formed with the protective member body, and the protective member is configured to be placed on the surface of the substrate while coupled to the connector with the connector accommodated in the accommodation unit, and wherein the protective member includes one second wall extending in the width direction of the connector body and a pair of first walls extending in the longitudinal direction of the connector body, one ends of the first walls being connected to both ends of the second wall, and an open unit exists between the other end of one of the first walls and the other end of the other first wall.

11. The connector assembly according to claim 10, wherein the protective metal fitting includes a portion exposed from the protective member body in an inside surface of the protective member and a portion exposed from the protective member body in an opposing substrate side surface of the protective member.

12. The connector assembly according to claim 11, wherein the portion exposed from the protective member body in the inside surface includes a portion that holds a connector body of the connector accommodated in the accommodation unit while engaging with the connector body.

13. The connector assembly according to claim 10, wherein the protective metal fitting includes a portion exposed from the protective member body in inside surfaces of a first wall of the protective member extending in the longitudinal direction of the connector body and a second wall of the protective member extending in the width direction of the connector body and a portion exposed from the protective member body in a side surface of a mounting substrate of the protective member.

14. The connector assembly according to claim 10, further comprising an interposing member interposed between the connector and the protective member, wherein the interposing member couples the connector and the protective member together while maintaining a positional relationship between the connector and the protective member constant.

15. The connector assembly according to claim 14, wherein:

the connector further includes a reinforcing metal fitting attached to the connector body, and the interposing member includes a main body and a protective member outside holding arm and a connector holding arm, which extend from the main body, the protective member outside holding arm includes an engagement unit holding the protective member from an outside, and the connector holding arm includes a holder holding the reinforcing metal fitting.

16. The connector assembly according to claim 15, wherein the interposing member further includes a protective member inside holding arm extending from the main body, and the protective member inside holding arm includes an engagement unit holding the protective member from an inside.

17. A connector pair comprising: the connector assembly described in claim 10; and an opposing connector fitted in the connector.

18. The connector pair according to claim 17, wherein the opposing connector is fitted in the connector in a state in which the connector and protective member are fixed to the surface of the substrate after coupled together and placed on the surface of the substrate.

19. A connector assembly comprising:

a connector including a connector body and a terminal attached to the connector body, the connector being configured to be attached to a surface of a substrate; and a protective member including a wall extending in a longitudinal direction or a width direction of the connector body and an accommodation unit in which at least a part of four sides of a periphery is defined by the wall, the protective member configured to be attached to the surface of the substrate with the connector accommodated in the accommodation unit, wherein the protective member includes a protective member body made of an insulating material and a protective metal fitting made of a conductive metal integrally formed with the protective member body, and the protective member is configured to be placed on the surface of the substrate while coupled to the connector with the connector accommodated in the accommodation unit, and wherein the protective member constructed with a pair of first walls extending in the longitudinal direction of the connector body, and an open unit exists between both ends of one of the first walls and both ends of the other first wall.

20. The connector assembly according to claim 19, wherein the protective metal fitting includes a portion exposed from the protective member body in an inside surface of the protective member and a portion exposed from the protective member body in an opposing substrate side surface of the protective member.

21. The connector assembly according to claim 20, wherein the portion exposed from the protective member body in the inside surface includes a portion that holds a connector body of the connector accommodated in the accommodation unit while engaging with the connector body.

22. The connector assembly according to claim 19, wherein the protective metal fitting includes a portion exposed from the protective member body in inside surfaces of a first wall of the protective member extending in the longitudinal direction of the connector body and a second wall of the protective member extending in the width direction of the connector body and a portion exposed from the protective member body in a side surface of a mounting substrate of the protective member.

23. The connector assembly according to claim 19, further comprising an interposing member interposed between the connector and the protective member, wherein the interposing member couples the connector and the protective member together while maintaining a positional relationship between the connector and the protective member constant.

24. The connector assembly according to claim 23, wherein:

the connector further includes a reinforcing metal fitting attached to the connector body, and the interposing member includes a main body and a protective member outside holding arm and a connector holding arm, which extend from the main body, the protective member outside holding arm includes an engagement unit holding the protective member from an outside, and the connector holding arm includes a holder holding the reinforcing metal fitting.

25. The connector assembly according to claim 24, wherein the interposing member further includes a protective member inside holding arm extending from the main body, and the protective member inside holding arm includes an engagement unit holding the protective member from an inside.

26. A connector pair comprising: the connector assembly described in claim 19; and an opposing connector fitted in the connector.

27. The connector pair according to claim 26, wherein the opposing connector is fitted in the connector in a state in which the connector and protective member are fixed to the surface of the substrate after coupled together and placed on the surface of the substrate.

* * * * *